US009309680B2

(12) United States Patent
Awashima et al.

(10) Patent No.: US 9,309,680 B2
(45) Date of Patent: Apr. 12, 2016

(54) FORMING DEVICE AND CONSTRUCTION METHOD USING FORMING DEVICE

(75) Inventors: Ichiro Awashima, Soja (JP); Masato Komura, Soja (JP)

(73) Assignee: Ooparts Asia PTE., LTD., Singapore (SG)

( * ) Notice: Subject to any disclaimer, the term of this patent is extended or adjusted under 35 U.S.C. 154(b) by 0 days.

(21) Appl. No.: 14/371,817

(22) PCT Filed: Mar. 2, 2012

(86) PCT No.: PCT/JP2012/055484
§ 371 (c)(1),
(2), (4) Date: Nov. 6, 2014

(87) PCT Pub. No.: WO2013/105273
PCT Pub. Date: Jul. 18, 2013

(65) Prior Publication Data

US 2015/0047292 A1 Feb. 19, 2015

(30) Foreign Application Priority Data

Jan. 12, 2012 (JP) ..... 2012-004528

(51) Int. Cl.
*E04F 15/02* (2006.01)
*B05C 17/10* (2006.01)
(Continued)

(52) U.S. Cl.
CPC ..... *E04F 15/02044* (2013.01); *B05C 17/10* (2013.01); *E04F 15/02038* (2013.01); *E04F 21/162* (2013.01); *E04F 21/20* (2013.01); *E04F 21/24* (2013.01); *E04F 2015/02127* (2013.01)

(58) Field of Classification Search
CPC ..... B05C 17/10; E04F 13/0892; E04F 15/02038; E04F 15/02044; E04F 15/02452; E04F 15/02464; E04F 15/02476; E04F 2015/02127; E04F 21/0092; E04F 21/18; E04F 21/1838; E04F 21/20; E04F 21/22; E04F 21/24; E04F 21/162; F16B 35/005
USPC ..... 33/526, 527, 813–815; 52/125.2, 126.1, 52/126.3, 126.5, 126.6, 126.7, 127.5, 52/127.7, 263, 392, 509, 747.11, 749.11; 411/178, 393
See application file for complete search history.

(56) References Cited

U.S. PATENT DOCUMENTS 3,308,587 A * 3/1967 Gilroy et al. ..... 52/126.5
3,318,057 A * 5/1967 Norsworthy ..... 52/126.6
(Continued)

FOREIGN PATENT DOCUMENTS

DE 1008897 5/1957
DE 1074251 1/1960
(Continued)

OTHER PUBLICATIONS

European search report for PCT/JP2012055484.

*Primary Examiner* — Charles A Fox
*Assistant Examiner* — Joseph J Sadlon
(74) *Attorney, Agent, or Firm* — Trojan Law Offices

(57) ABSTRACT

Provided is a forming device for forming an adhesive composition so that tiles can be reliably laid on a laying surface. A forming device for forming an adhesive composition into a ridged shape in a laying surface on which tiles are laid is characterized by being provided with: a stationary blade (40*a*) in which a plurality of plate-shaped tongue parts are disposed in a planar fashion, and the respective base ends of the tongue parts are linearly arranged with a gap having a predetermined length therebetween; a graspable main body (21) which secures the stationary blade and is disposed on the stationary blade so as to be movable sideways while pressing the stationary blade from above; a storage space (70) which is defined on the underside of the main body (21) and on the traveling direction side of the lateral movement of the stationary blade (40*a*); a weir member (81) which is affixed to the main body (21) or the stationary blade (40*a*) so as to be movable relative to the stationary blade (40*a*), and is able to define the upper ends of the gaps (42) formed in the stationary blade (40*a*), and characterized in that in the ridged shape, the volume filling factor between the tiles and the laying surface is adjusted in consideration of the pressure-bonding margin of the tiles.

8 Claims, 40 Drawing Sheets

(51) Int. Cl.

| | |
|---|---|
| ***E04F 21/20*** | (2006.01) |
| ***E04F 21/16*** | (2006.01) |
| ***E04F 21/24*** | (2006.01) |

(56) References Cited

U.S. PATENT DOCUMENTS

| | | | | |
|---|---|---|---|---|
| 3,780,480 | A * | 12/1973 | Cvijanovic et al. | 52/223.4 |
| 5,072,557 | A * | 12/1991 | Naka et al. | 52/126.6 |
| 8,156,701 | B2 * | 4/2012 | Tsukada et al. | 52/263 |
| 2005/0053723 | A1 | 3/2005 | Brzoska | |
| 2006/0185269 | A1 | 8/2006 | Kufner et al. | |
| 2006/0185319 | A1 | 8/2006 | Kufner et al. | |
| 2012/0279169 | A1 | 11/2012 | Kim et al. | |

FOREIGN PATENT DOCUMENTS

| | | | |
|---|---|---|---|
| DE | 2546574 | | 4/1977 |
| EP | 2327845 | | 6/2011 |
| JP | 021151-1977 | | 2/1977 |
| JP | 56-153054 | A | 11/1981 |
| JP | 098577/1986 | | 6/1986 |
| JP | 02-101254 | A | 4/1990 |
| JP | 047202-1993 | | 6/1993 |
| JP | A1996-284377 | | 10/1996 |
| JP | 11-062211 | A | 3/1999 |
| JP | 2007-270605 | A | 10/2007 |
| WO | WO2010030117 | | 3/2010 |

* cited by examiner (b)

(a)

FORMING DEVICE AND CONSTRUCTION METHOD USING FORMING DEVICE

CROSS REFERENCE TO RELATED APPLICATIONS

This application is a filing under 35 U.S.C. §371 and claims priority to International Application No. PCT/JP2012/055484, filed Mar. 2, 2012, which claims priority to Japanese Patent Application No. 2012-004528, filed Jan. 12, 2012, both of which are hereby incorporated by reference in their entireties.

TECHNICAL FIELD

The present invention relates to a forming apparatus, more specifically, it relates to a forming apparatus which forms an upper surface of adhesive substance in a shape of ridge-and-groove, the adhesive substance being adapted to adhere tiles to a laying surface.

BACKGROUND ART

Tiles such as natural stone plates and artificial stone plates have been used very often in order to form mainly a floor surface and the like. Large-scale tiles recently have been used so often because of their ornamental features and there are two conventional methods for tile flooring construction: a laid mortar method and a pressure bonding method. The former is a method of applying and laying mortar having a low water content together with cements and the like evenly all over an underlying surface and laying tiles on the laid mortar, and is excellent for laying tiles over a large area. However, a concave-convex shape of the underlying surface tends to reflect on an upper surface on which tiles are laid such that the concave-convex shape is thought to prevent uniform adhesion between the tiles and the underlying surface, and tend to cause defects in workmanship by so-called air pockets. On the other hand, the pressure bonding method is to apply and lay adhesive substance (typically mortar) on the underlying surface and to lay and pressure-bond tiles on the laid adhesive substance. However, the trowel with which the mortar is applied and laid is rather small if compared to the large-scale tile such that a craftsman provides the substance to the underlying surface for several times and forms an even top surface of the substance by sweeping for many times the trowel over a laying surface on which a tile is to be laid, which also requires a very high proficiency. And in the pressure bonding method, the mortar is applied and laid, a tile is laid thereon and then pressed by a hammer or the like, and a settling distance during a period of pressing is considered such that it is generally conducted that a concave-convex shape is formed on the top surface of the laid mortar. For example, in order to lay the tile, the adhesive substance (typically mortar) to bond the tile and the underlying surface over which the tile is laid is applied and laid on the underlying surface, the top surface of the laid adhesive substance (typically mortar) is formed in a ridge-and-groove shape where a concave streak and a convex streak are alternately formed in a series. Various things have been proposed to form the top surface of the adhesive substance in such a ridge-and-groove shape (for example, patent reference 1 and so on).

According to this invention, it is described, "the unit rock slab to be adhered to the upper surface of the mortar is positioned at the even level and an even adhesive surface without including air bubbles or the like in the mortar is formed as the mortar flows smoothly to the valley part without collapse of the mortar when the unit rock slab is placed and pressed such that the adhesive efficiency may be improved," (paragraphs [0010] in detailed explanation of the invention of Patent Reference 1).

PRIOR ART REFERENCE

Patent Reference

Patent Reference 1: Japanese Patent Application Publication No. H11(1999)-62211

SUMMARY OF THE INVENTION

Problems to be Solved by the Invention

The technique of the craftsman who conducts actions of applying and laying the mortar (adhesive substance) with a trowel (forming apparatus) affects favorable or unfavorable results of movement of forming end face of the trowel (forming apparatus) very much such that it is significantly affected by the craftsman whether the upper surface of the mortar (adhesive substance) is good or not.

Then, according to the present invention, a forming apparatus to form an upper surface of adhesive substance in a ridge-and-groove shape could be provided such that the upper surface of the adhesive substance could be prevented from being formed in a wavy shape or unexpectedly inclined without requiring any high technical skills. Also, a forming apparatus and a forming method could be provided such that the upper surface could be formed stably in the case of using and applying the apparatus and the method to an inclined surface. Further, a forming apparatus and a forming method having advantages in applying particularly a large-scale tile and an assist device or an assist jig or an assist part are provided.

Means to Solve the Problems

Provided is a forming apparatus (hereinafter, referred to as "present apparatus") of the present invention to form in a ridge-and-groove shape an upper surface of adhesive substance which adheres a tile and a laying surface on which the tile is laid. The forming apparatus comprises: a stationary blade to which a plurality of flat tongue parts extending in an extending direction from respective base ends to respective tip ends are connected respectively with gaps of predetermined spaces between two neighboring tongue parts among the plurality of tongue parts as the tip ends are aligned and both tip and base ends of the respective tongue parts are lined up in the same direction wherein the plurality of tongue parts are aligned in a plane and linearly in a direction substantially perpendicular to the extending direction; a main body securing the stationary blade, extending in the direction substantially perpendicular to the extending direction, and having a grasping portion provided with a workspace therearound so as to be capable of being grasped that is arranged on an opposite side to the tip ends of the tongue parts in the extending direction with respect to the stationary blade; a pressing surface being provided to the main body on the movement direction side of the tongue parts of the stationary blade and facing the laying surface wherein the pressing surface facing the laying surface, the laying surface, and a surface provided on the movement direction side of the tongue parts receive mortar entering from the movement direction side; and end parts defining an upper surface of a formed ridge-and-groove shape and being provided in the predetermined gaps between the two neighboring tongue parts. The forming apparatus may be provided wherein the formed ridge-and-groove shape is formed such that a volume packing factor between the tile and the laying surface is from 50% to 100% in consideration of the allowance for the pressure bonding of the tile being placed on the upper surface.

Also, a surface height adjustment apparatus to be used, when tiles are laid on a laying surface, and capable of being utilized in a floor construction with such a forming apparatus may be provided. The surface height adjustment apparatus may comprise: a base bottom part to define a reference height from the laying surface; a protrusion member capable of engaging with the base bottom part and further protruding from the base bottom part; a lower part receiving member to be kept at a predetermined height from the base bottom part; an upper part pressing member capable of clamping a side end part of a tile between the lower part receiving member and the upper part pressing member; a distance adjustment member capable of being secured by engaging with the protrusion member and changing the distance between the lower part receiving member and the upper part pressing member when having a constant relationship with the lower part receiving member through the base bottom part, and an engaging movable body capable of engaging with the distance adjustment member so as to shorten the distance between the lower part receiving member and the upper part pressing member.

An efficient floor construction of laying tiles may be enabled by the forming apparatus and the surface height adjustment apparatus configured as described above. Further features of the present invention, its nature, and various advantages will be more apparent from the accompanying drawings and the following description of the preferred embodiment.

BRIEF DESCRIPTIONS OF THE DRAWINGS

DETAILED EXPLANATION TO IMPLEMENT THE INVENTION

In the following, the detailed explanation of examples of the present invention is made with reference to the drawings. However, the present invention is not limited thereto.

Figure 1:
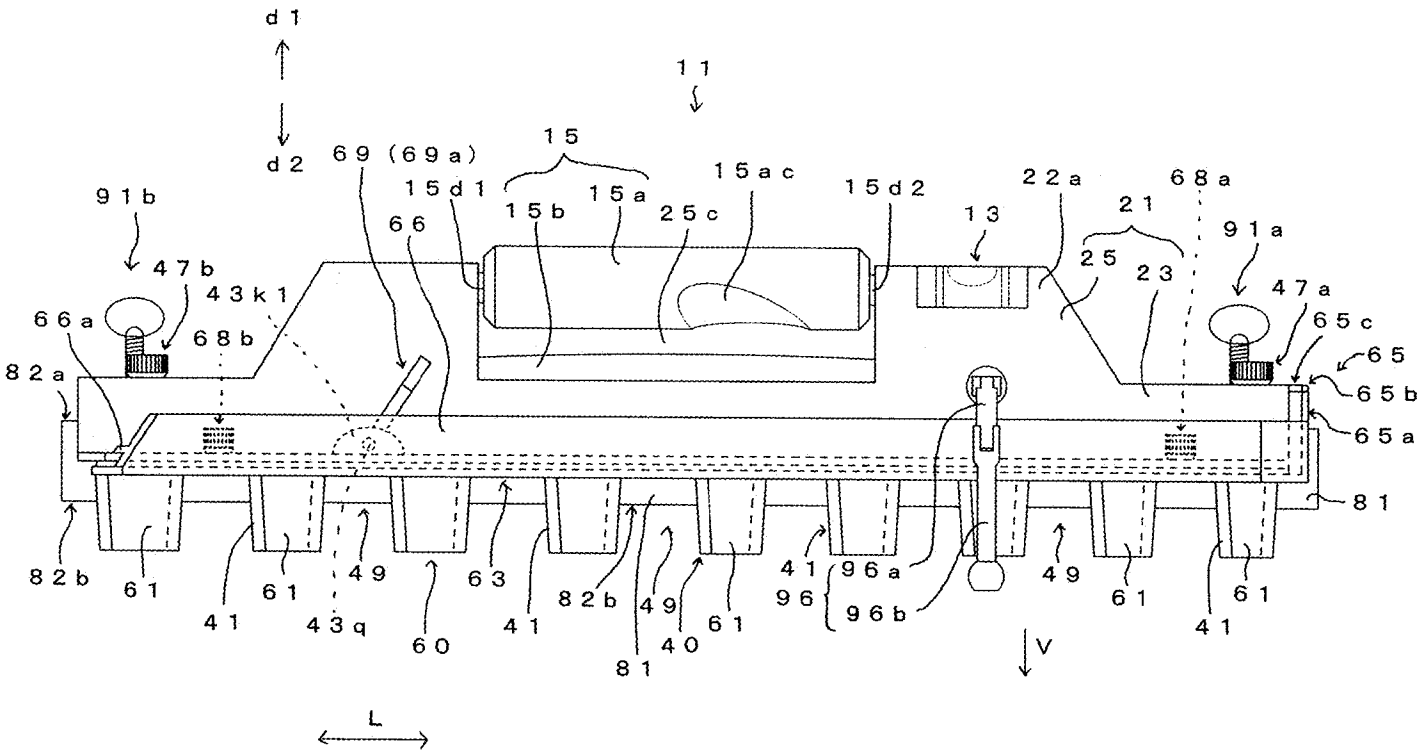
FIG. 1 is a front view showing a forming apparatus (present apparatus) of one embodiment according to the present invention.
Figure 2:
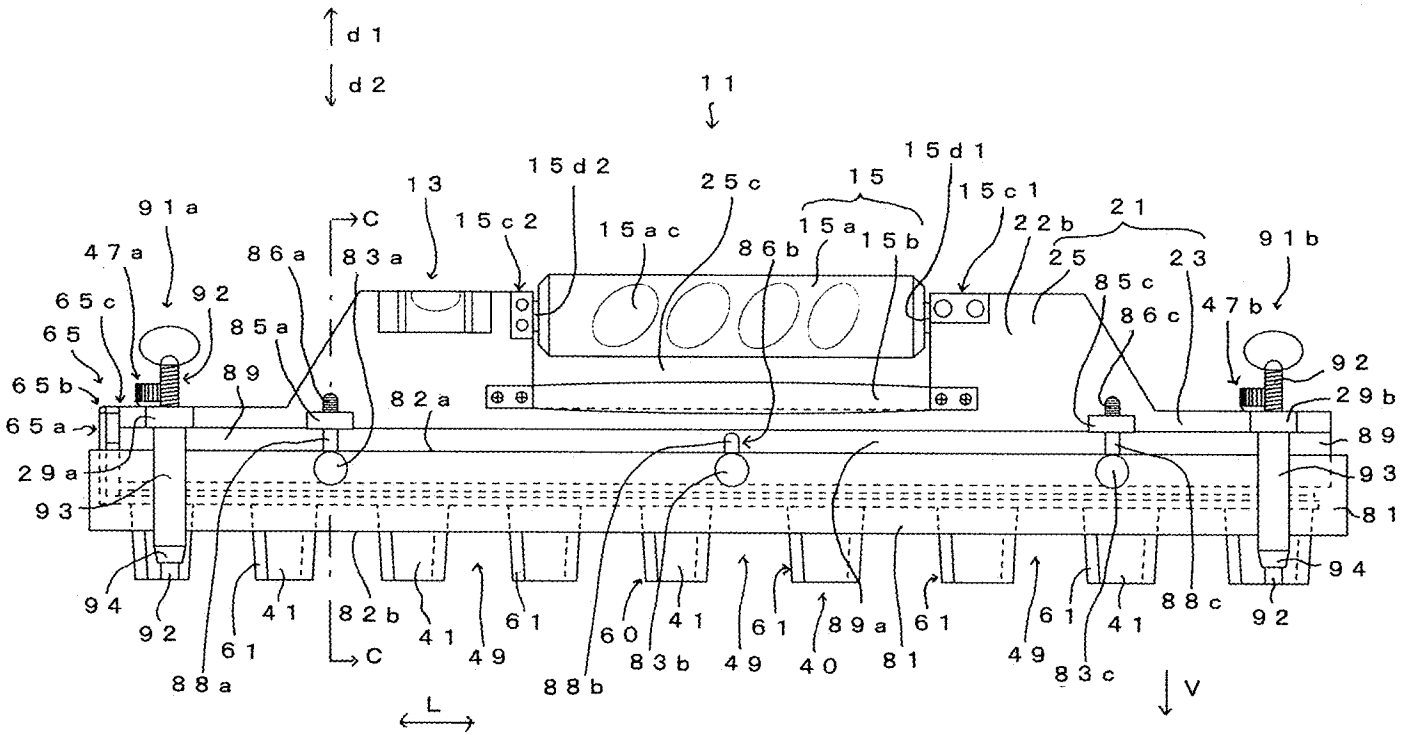
FIG. 2 is a rear view of the present apparatus as shown in FIG. 1.
Figure 3:
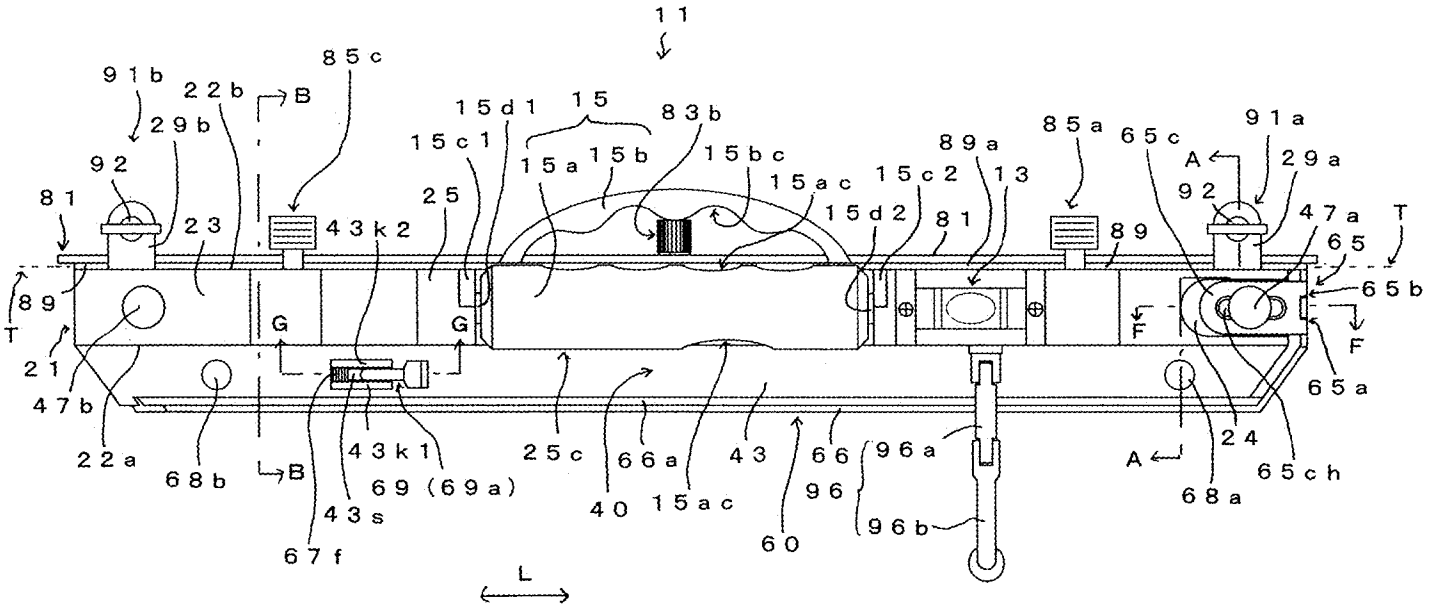
FIG. 3 is a plan view of the present apparatus as shown in FIG. 1.
Figure 4:
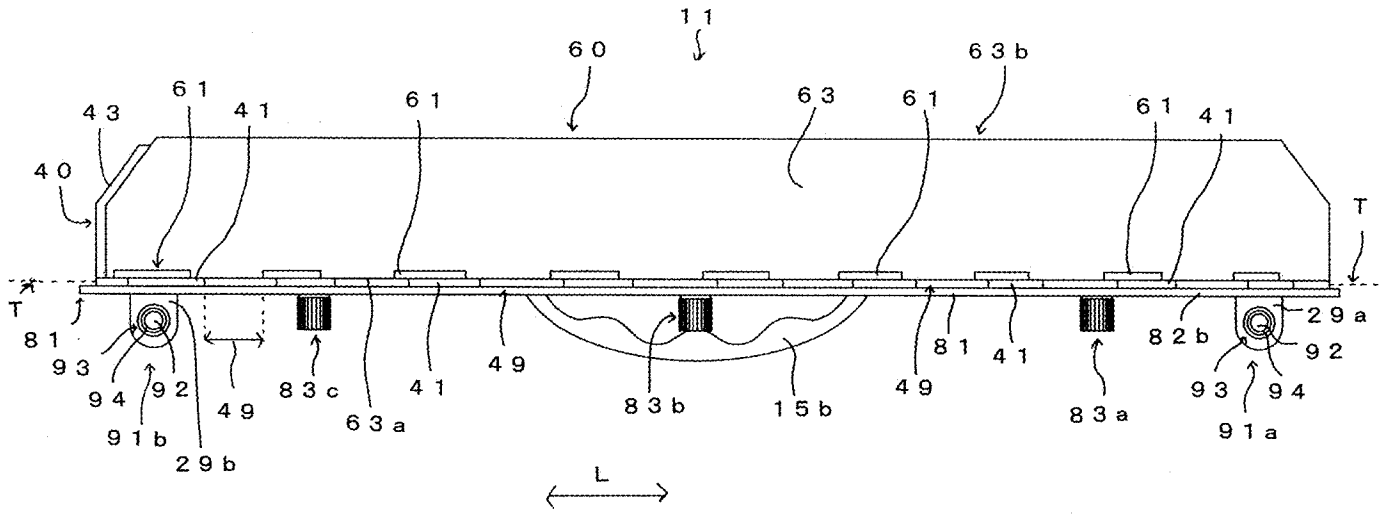
FIG. 4 is a bottom view of the present apparatus (in a state where a stand is removed) as shown in FIG. 1.
Figure 5:
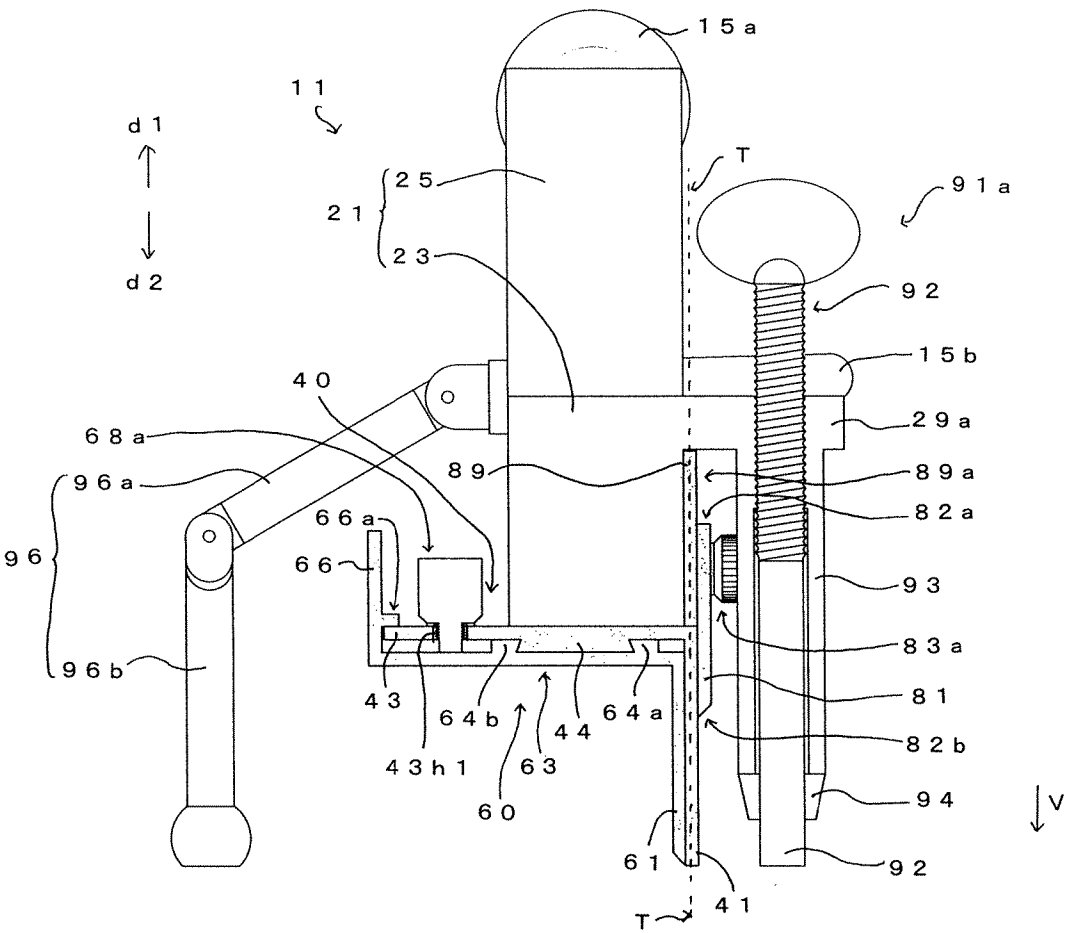
FIG. 5 is a cross-section view along A-A line of FIG. 3.
Figure 6:
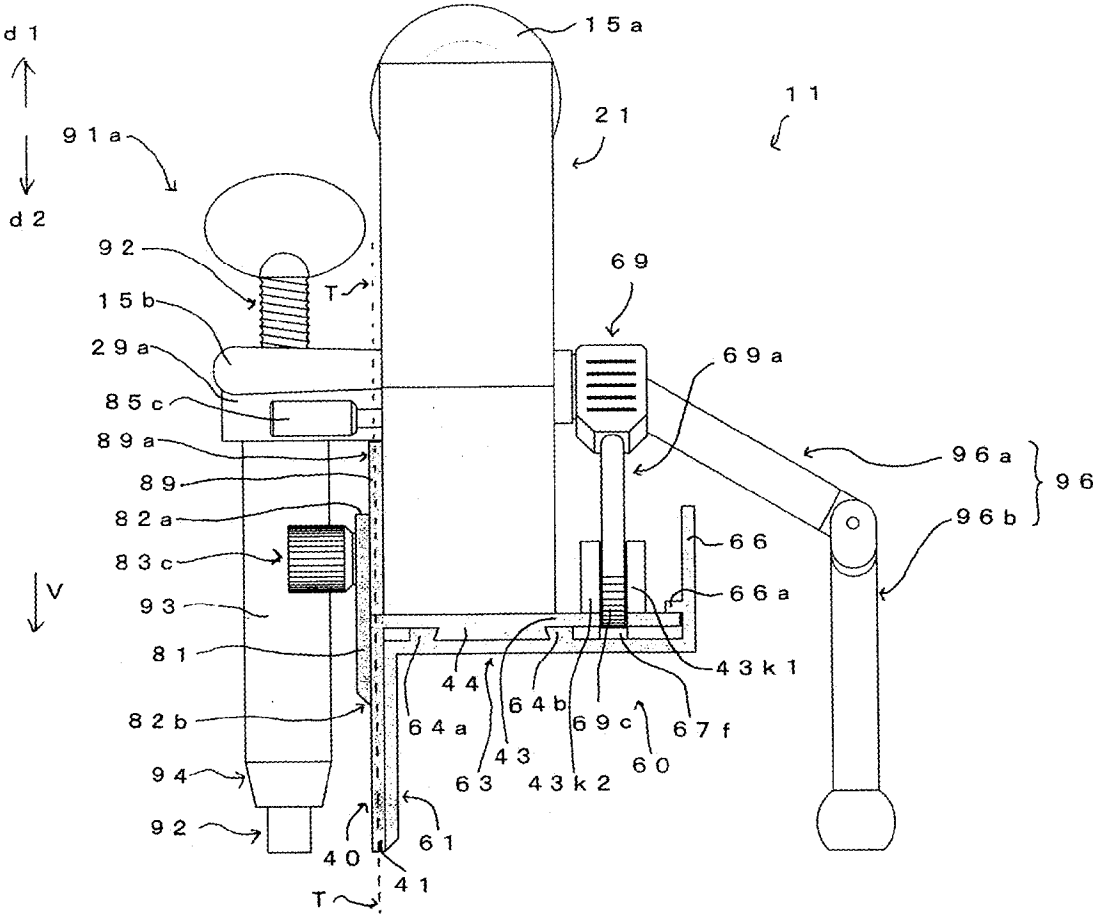
FIG. 6 is a cross-section view along B-B line of FIG. 3.
Figure 7:
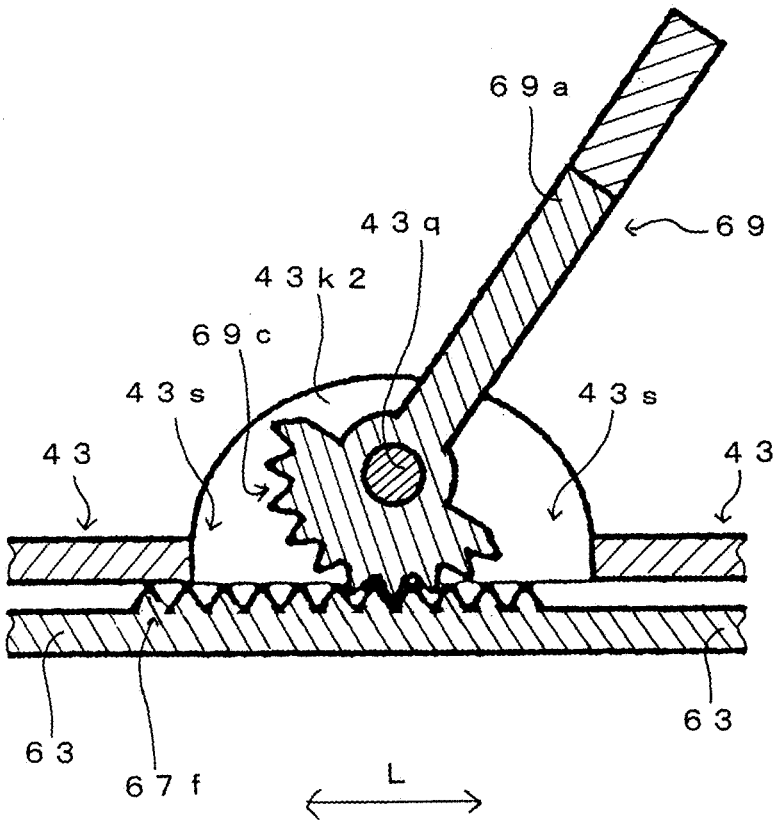
FIG. 7 is a cross-section view (partial cross-section view) along G-G line of FIG. 3.
Figure 8:
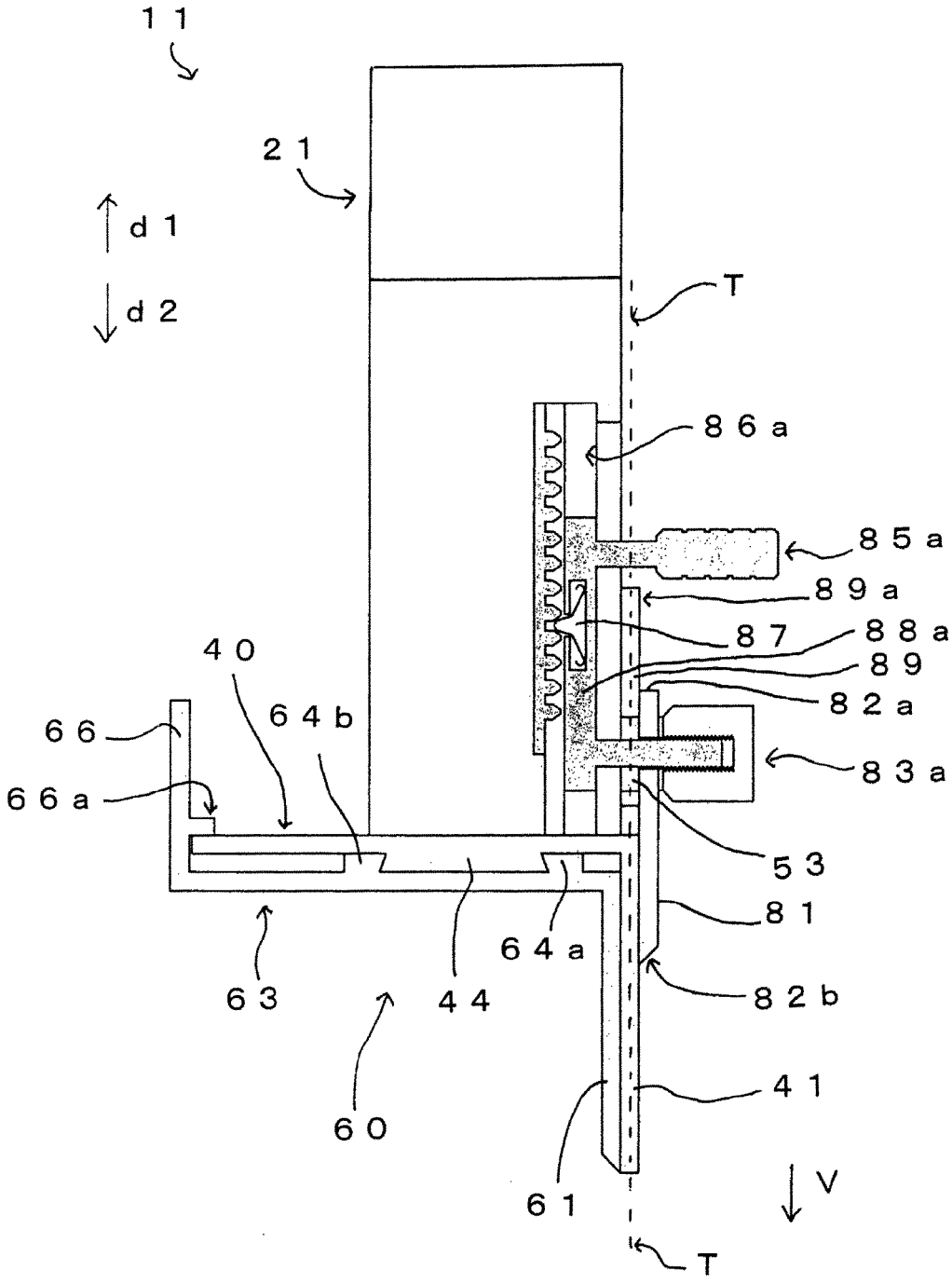
FIG. 8 is a cross-section view (some parts are omitted from the view) along C-C line of FIG. 2.

FIG. 1 is a front view showing a forming apparatus (present apparatus) 11 of one embodiment of the present invention; FIG. 2 is a rear view of the present apparatus 11; FIG. 3 is a plan view of the present apparatus 11; FIG. 4 is a bottom view (in a state that the stand 96 to be described later is removed) of the present apparatus 11; FIG. 5 is a cross section view along A-A line of FIG. 3; FIG. 6 is a cross section view along B-B line of FIG. 3; FIG. 7 is a cross section view along G-G line of FIG. 3; and FIG. 8 is a cross section view along C-C line of FIG. 2 (here, the stand 96 to be described later, the grasping portion 15*a*, and the like are not shown). The present apparatus 11 is explained with reference to FIGS. 1 to 8.

The present apparatus 11 generally comprises: a main body 21 formed with a plate member with a large thickness (here, it is made of wood); a securing portion 40 fixed to the main body 21; a lateral slide portion 60 fixed to the main body 21; a vertical slide edge 81 fixed to the main body 21; a height adjusting part 91 (including a pair of height adjusting parts 91*a*, 91*b*) fixed to the main body 21; and a stand 96 fixed to the main body 21.

Here, "up" and "down" means an vertical up direction and a vertical down direction in the case where the present apparatus 11 is placed on the horizontal plane and main surfaces of tongue parts 41 and tongue parts 61 to be described later represent a vertical plane, and are indicated by an arrow d1 (up) and an arrow d2 (down) in the drawings.

The main body 21 comprises a main body lower portion 23 of a rectangular bar extending along the longitudinal direction L and a main body upper portion 25 formed integrally together with the main body lower portion 23 wherein the main body is formed integrally of wood.

At approximately a center position in the longitudinal direction L of the main body upper portion 25, a grasping portion 15 is provided for a user (not shown) of the present apparatus 11 to grasp it with his hand. The grasping portion 15 includes a bar-shaped grasping portion 15*a* (made of rubber and with a recess 15*ac*) formed in an approximately circular cylindrical shape extending along a longitudinal direction L and fixed to the main body upper portion 25 in a freely-attachable-and-detachable manner; and a finger catch 15*b* (made of hard synthetic resin and with a convex-and-concave portion 15*bc*) with which fingers of a hand surely engages when the grasping portion 15*a* is grasped by the hand. A notch (or a recess) 25*c* to accommodate the grasping portion 15*a* is provided and the grasping portion 15*a* has fixing brackets 15*d*1, 15*d*2 on both ends and is disposed to the main body upper portion 25 with engaging parts 15*c*1, 15*c*2 capable of being freely engageable and disengageable therewith, respectively.

On an upper portion of the main body 21, a bubble tube level 13 is arranged so as to make a horizontal check.

Figure 10A:
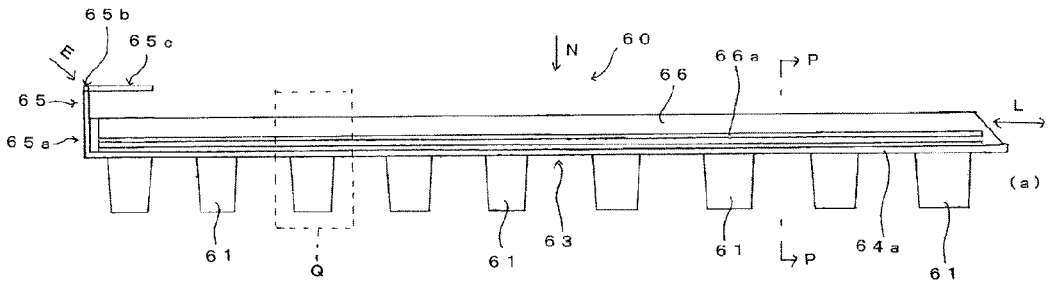
FIG. 10A is a diagram (rear view) showing a lateral slide portion.
Figure 10B:
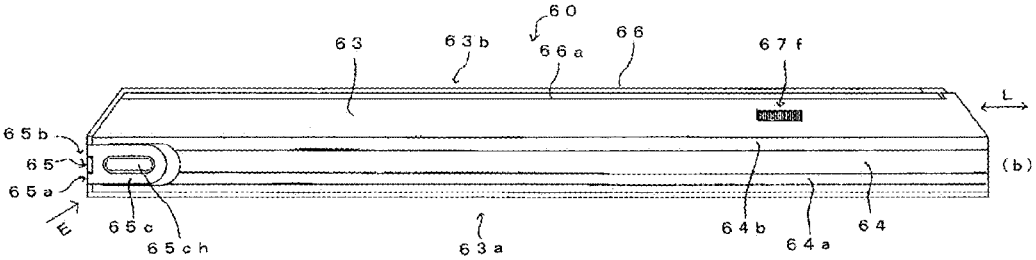
FIG. 10B is a diagram (plan view) showing the lateral slide portion.
Figure 11A:
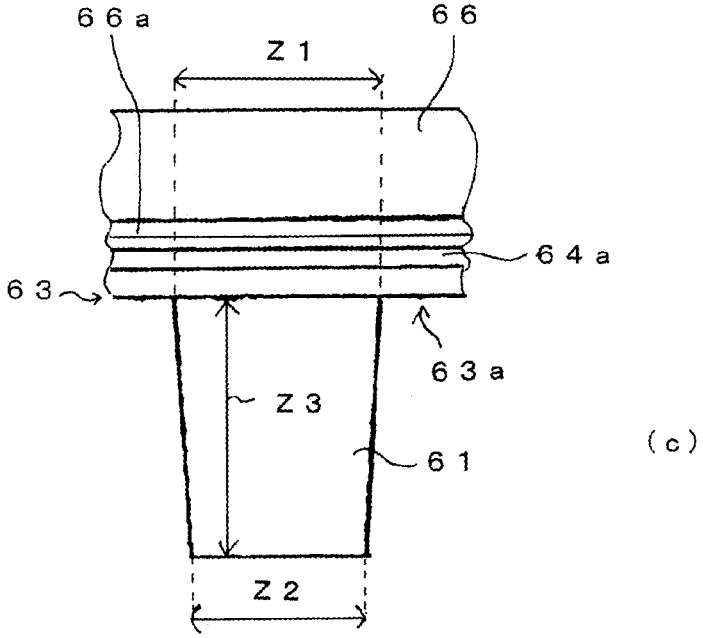
FIG. 11A is a diagram (enlarged view of Q in FIG. 10A) mainly illustrating details of a tongue part of a securing portion and a tongue part of the lateral slide portion.
Figure 11B:
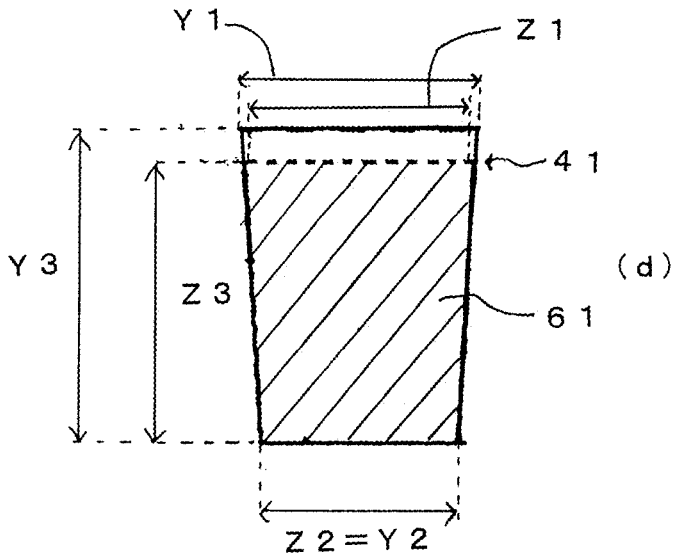
FIG. 11B is a diagram mainly illustrating details of the tongue part of the securing portion and the tongue part of the lateral slide portion.
Figure 12A:
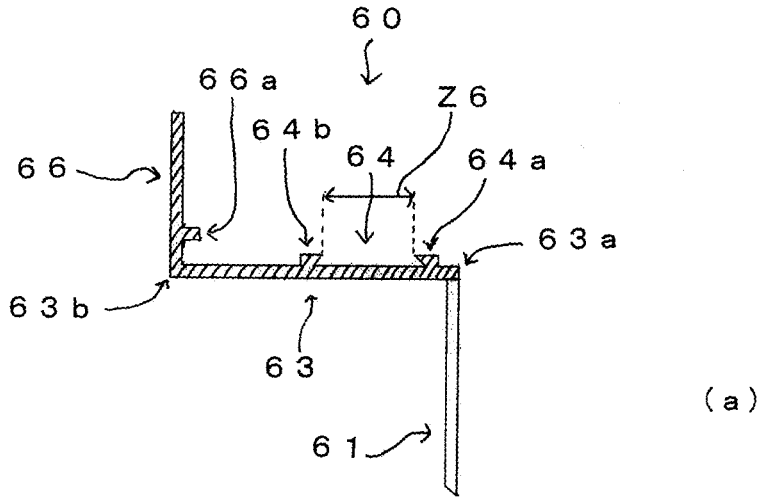
FIG. 12A is an enlarged cross-section view (cross-section view along P-P line in FIG. 10A) of the lateral slide portion.
Figure 12B:
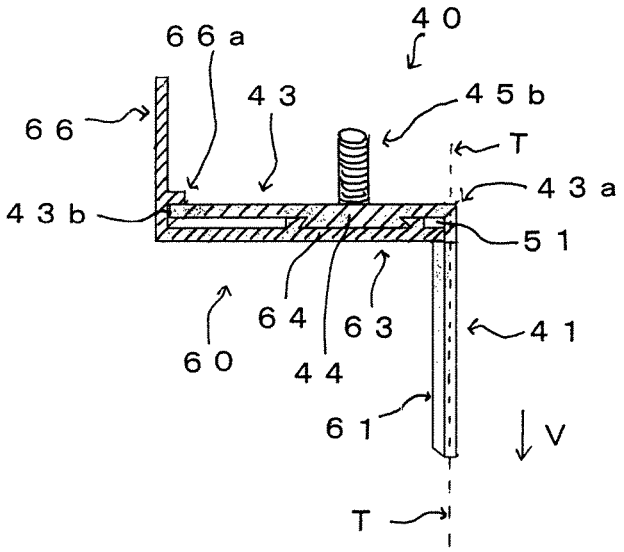
FIG. 12B is an enlarged cross-section view of the securing portion and the lateral slide portion.
Figure 13A:
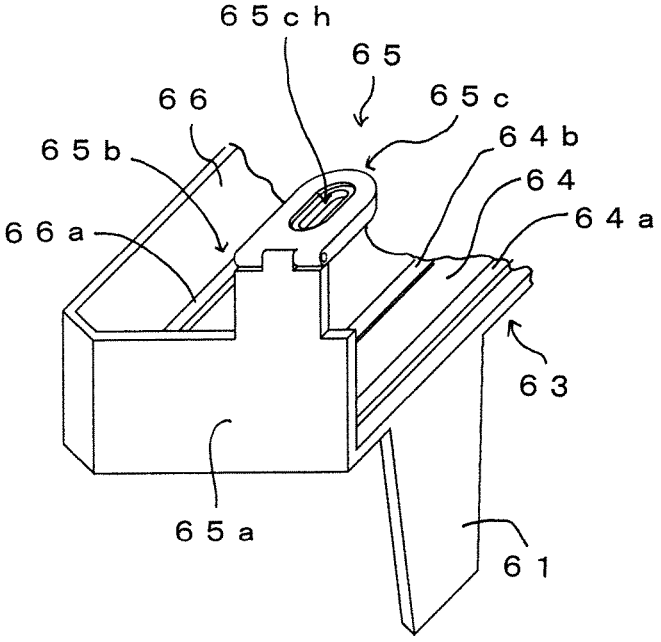
FIG. 13A is a partial perspective view of the lateral slide portion indicated by arrow E in FIG. 10A.
Figure 13B:
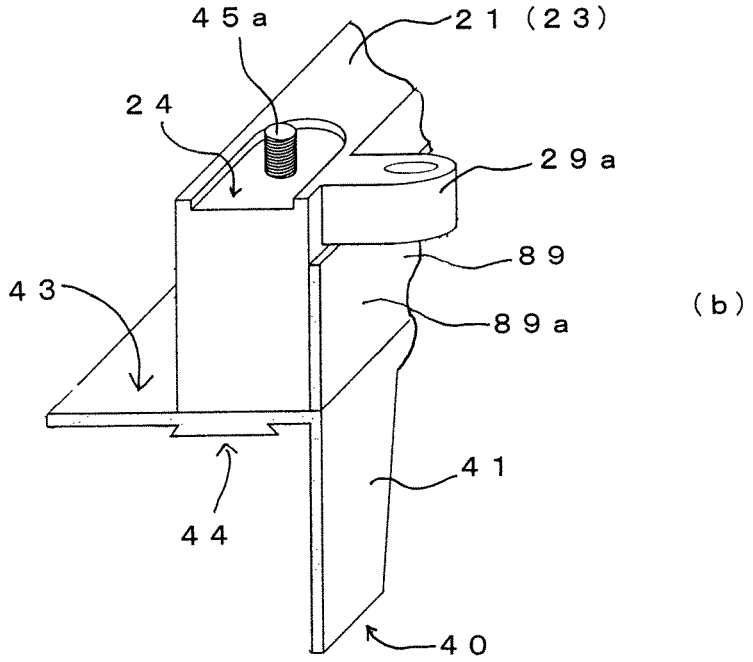
FIG. 13B is a partial enlarged view of a main body (lower part of the main body) and the securing potion engaging with a portion of the lateral slide portion as shown in FIG. 13A.
Figure 14:
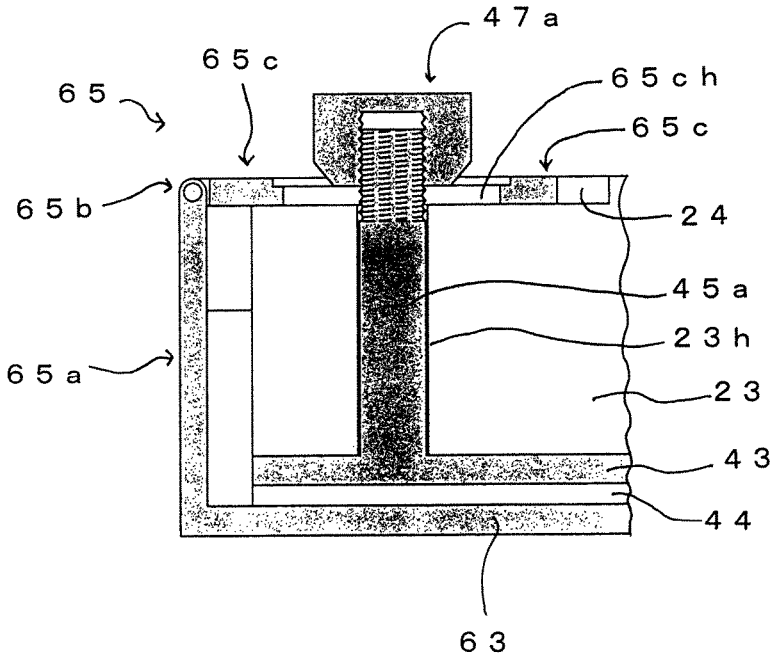
FIG. 14 is a cross-section view along F-F line of FIG. 3.

Next, with respect to the securing portion 40 and the lateral slide portion 60, explanation will be made with reference to FIGS. 9A, 9B, 9C, 9D, 10A, 10B, 11A, 11B, 12A, 12B, 13A, 13B, and 14. FIGS. 9A-9D are diagrams showing the securing portion 40. FIGS. 10A-10B are diagrams showing the lateral slide portion 60. FIGS. 11A-11B are diagrams illustrating mainly details of a tongue part 61 and a tongue part 41. FIGS. 12A-12B are enlarged cross-section views showing the securing portion 40 and the lateral slide portion 60. FIG. 13A is a perspective view of part of the lateral slide portion 60, which is indicated by the arrow E in FIG. 10A. FIG. 13B is a partial enlarged view of the main body 21 (main body lower portion 23) and the securing portion 40 engaging with a part of the lateral slide portion 60 shown in FIG. 13A. FIG. 14 is a cross-section view along F-F line of FIG. 3.

Figure 9A:
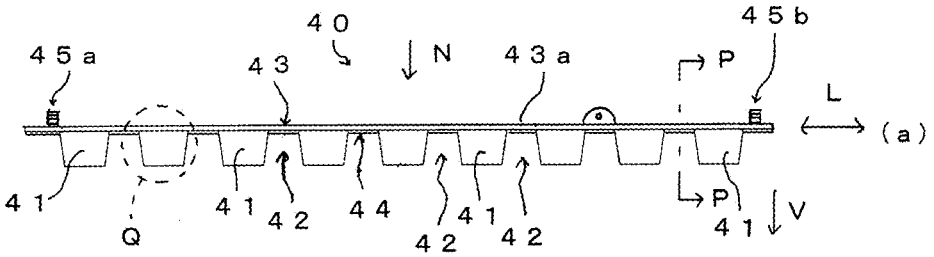
FIG. 9A is a diagram (rear view) showing a securing potion.
Figure 9B:
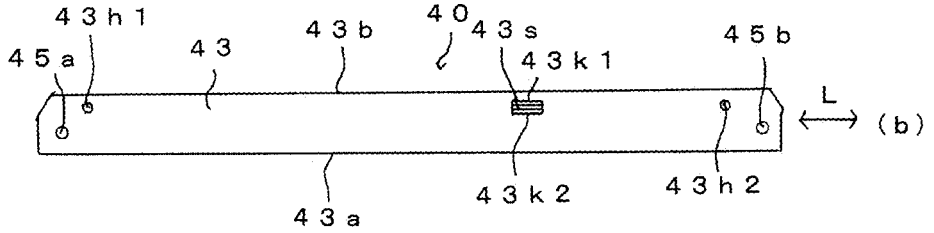
FIG. 9B is a diagram (plan view) showing the securing potion.
Figure 9C:
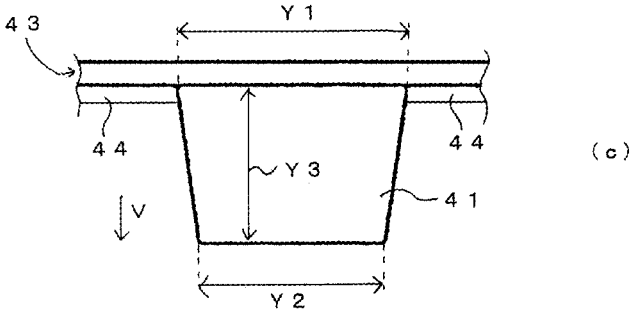
FIG. 9C is a diagram (enlarged view of Q in FIG. 9A) showing the securing potion.
Figure 9D:
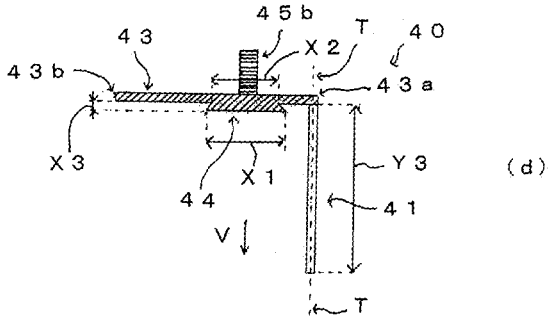
FIG. 9D is a diagram (cross-section view along P-P line of FIG. 9A) showing the securing potion.

FIGS. 9A-9D are diagrams showing the securing portion 40. More specifically, FIG. 9A is a rear view of the securing portion 40, FIG. 9B is a plan view of the securing portion 40, FIG. 9C is an enlarged view of Q circled with a dotted line in FIG. 9A, and FIG. 9D shows a cross-section view along P-P line of FIG. 9A.

The securing portion 40 generally comprises: a securing portion base plate 43 of a reed shape having both main surfaces of a rectangle shape with a pair of long sides 43*a*, 43*b* in approximately parallel along the longitudinal direction L; securing portion fixing bolts 45*a*, 45*b* having base ends fixed by welding to one main surface (upper surface) so as to stick out in an up direction with respect to the one main surface (top surface) of the securing portion base plate 43; a plurality of tongue parts 41 fixed by welding to another main surface at approximately even intervals along the long side 43*a* so as to project in a vertical direction with respect to the other main surface (bottom surface) of the securing portion base plate 43; and a ridge 44 formed on the other main surface of the securing portion base plate 43 in approximately parallel to a pair of long sides 43*a*, 43*b*, wherein the securing portion 40 is made of metal material in one piece.

The securing portion base plate 43 of the reed shape has a pair of tapped holes 43*h*1, 43*h*2 and comprises a slit 43*s* formed in a rectangle shape along the longitudinal direction L and lever support plates 43*k*1, 43*k*2 fixed to a pair of edges opposing to each other along the longitudinal direction L of the slit 43*s*.

The plurality of tongue parts 41 are all in the same shape and size, and are formed in a plate member having both main surfaces shaped in an isosceles trapezoid (an isosceles trapezoid having a pair of legs which are not parallel) having an upper base Y1 and a lower base Y2 (Y2<Y1) and a height Y3. These tongue parts 41 are provided along the long side 43*a* at approximately even intervals and have their respective upper bases Y1 fixed thereto so as to be approximately vertical to the other main surface.

The ridge 44 is formed in approximately parallel with the longitudinal direction L and cross-sections of the ridge 44 across any planes perpendicular thereto have approximately the same shape and size. Each of the cross-sections exhibits an isosceles trapezoid having an upper base X2, a lower base, X1 (X2<X1), and a height X3, and the upper base X2 is fixed to the other main surface of the securing portion base plate 43.

FIG. 10A is a rear view of the lateral slide portion 60; FIG. 10B is a plan view of the lateral slide portion 60; FIG. 11A is an enlarged view of Q circled with a dotted line in FIG. 10A; and FIG. 11B is a diagram (although the main surface of the tongue part 61 is hatched for easy understanding, but the hatching does not indicate a cross-section) showing a relationship between a main surface shape of the tongue part 61 to be described later and a main surface shape of the tongue part 41 described above. And FIG. 12A shows a cross-section view along P-P line of FIG. 10A.

The lateral slide portion 60 generally comprises: a lateral slide base plate 63 of a reed shape having both main surfaces exhibiting approximately a rectangle with a pair of long sides 63*a*, 63*b* approximately parallel to the longitudinal direction L; a front wall part 66 of a reed shape having both main surfaces of a rectangle with a pair of long sides in approximately parallel with the longitudinal direction L and having a long side thereof fixed by welding to a long side 63*b* of one main surface such that a main surface of the front wall part 66 is perpendicular to the one main surface (upper surface) of the lateral slide base plate 63; a plurality of tongue parts 61 fixed by welding to another main surface at approximately even intervals along the long side 63*a* so as to project in a vertical direction with respect to the other main surface (a main surface opposite to the one main surface, bottom surface) of the securing portion base plate 63; and ridges 64*a*, 64*b* formed on the one main surface (top surface) of the lateral slide base plate 63 in approximately parallel and forming a groove 64 (refer to FIG. 12A); a ridge 66*a* formed on one main surface of the front wall member 66 facing one main surface side of the lateral slide base plate 63 along the longitudinal direction L with a predetermined distance away therefrom; and a lateral slide portion supporting portion 65 formed on one end along the longitudinal direction L of the lateral slide base plate 63, wherein the lateral slide portion 60 is made of metal material (for example, aluminum, stainless steel, and so on). A rack part 67*f* formed along the longitudinal direction L is arranged on the one main surface of the lateral slide base plate 63 (refer to FIG. 10B).

The plurality of tongue parts 61 have the same shape and size, and are formed a plate member having both main surfaces in an isosceles trapezoid shape having an upper base Z1 and a lower base Z2 (Z2<Z1) and a height Z3 (Z3<Y3) (refer to FIG. 11A). Any one of the tongue parts 61 has the upper base Z1 fixed along the long side 63*a* and any of main surfaces thereof are approximately perpendicular to the other main surface of the securing portion base plate 63. These tongue parts 61 are fixed thereto and aligned along the long side 63*a* at approximately even intervals.

With respect to the groove 64 as described above, a cross-section shape thereof across a plane perpendicular to the longitudinal direction L has approximately the same shape and size and exhibits a little larger isosceles trapezoid similar to the above-mentioned isosceles trapezoid exhibited by the ridge 44. Since a width (lateral length) Z6 of an upper opening of a rectangle shape of the groove 64 is smaller than the lower base X1 X1 (refer to FIG. 12A), the above-mentioned ridge 44 can slide in the longitudinal direction L, once the ridge 44 is engaged with (or inserted into) the above-mentioned groove 64, but it is regulated (or almost prohibited) to remove the ridge 44 in a vertical direction thereto (refer to FIG. 12B).

And a rubber gasket 51 is inserted between the securing portion base place 43 and the lateral slide base plate 63 along the long side 43*a* and the long side 63*a* (refer to FIG. 12B). The gasket 51 can prevent or reduce the degree of entering the mortar (not shown in the figure) between the securing portion base place 43 and the lateral slide base plate 63 from the side of the tongue part 41 or 61.

Here, since an edge portion of the long side 43*b* of the securing portion base plate 43 engages with the ridge 66*a*, it can slide freely in the longitudinal direction L and be prevented from dropping off.

In this way, when the securing portion 40 and the lateral slide portion 60 are slid to a predetermined position, the main surface of the tongue part 61 and the main surface of the tongue part 41 are just overlaid completely with each other. At the sliding position where both are just overlaid completely with each other (hereinafter referred to as "overlaying slide position", gaps 42 formed between the respective tongue parts 41 themselves are not covered by the tongue parts 61. However, if it is slid in the longitudinal direction L, the gaps 42 between the respective tongue parts 41 themselves are covered by the tongue parts 61, respectively. A covering ratio (amount) of each gap 42 between the tongue parts 41 themselves varies depending on a sliding amount in the longitudinal direction L. In this way, the amount that the gap 42 is covered by the tongue part 61 can be freely changed by the sliding amount and the width of the slit 49 can be adjusted.

The securing portion fixing bolts 45*a*, 45*b* are inserted into the through holes 23*h* formed in the main body 21, securing portion fixing nuts 47*a*, 47*b* are engaged with the securing portion fixing bolts 45*a*, 45*b* such that the securing portion 40 is secured to the main body 21. And the ridge 44*b* is inserted slidably into the groove 64 (refer to FIGS. 1-8 and 12B).

A lateral slide portion supporting portion 65 is fixed to one end of the lateral slide base plate 63 along the longitudinal direction L. The lateral slide portion supporting portion 65 comprises: a plate-like rising portion 65*a* fixed to an edge portion such that the rising portion rises upward from the edge portion of the end of the lateral slide base plate 63 along the longitudinal direction L; a hinge portion 65*b* fixed to the rising portion 65*a* in a vicinity of a top end thereof; and a tongue part 65*c* fixed rotatably with the hinge portion 65*b* to the rising portion 65*a*. The tongue part 65*c* has an elongated hole 65*ch* (refer to FIGS. 3, 10B, 13A, and 14) formed as a longitudinal direction of the hole is along the longitudinal direction L, and a securing portion fixing bolt 45*a* is inserted into the elongated hole 65*ch* and engaged with a securing portion fixing nut 47*a* at the top end of the bolt. Also, a tongue part receiving groove 24 which receives slidably the tongue part 65*c* is formed in the main body 21 (main body lower portion 23).

A securing portion fixing bolt 45*b* is inserted into the through hole 23*h* formed in the main body 21 and engaged with a securing portion fixing nut 47*b* at the top end of the bolt such that the nut is so tightened as to directly contact the top surface of the main body 21 (main body lower portion 23).

As described above, the lateral slide portion 60 can slide along the longitudinal direction L for the play of the elongated hole 65*ch* with respect to the securing portion fixing bolt 45*a* of the securing portion 40 along the longitudinal direction L.

While female threads of a pair of tapped holes 43*h*1, 43*h*2 formed in the securing portion base plate 43 engage with a pair of lateral slide portion securing screws 68*a*, 68*b* (male threads), the lateral slide portion securing screws 68*a*, 68*b* are turned in a normal direction or a reverse direction with respect to the lateral slide base plate 43 such that the tip end of the screws is made to contact the lateral slide base plate 63 (top surface) so as to prevent the lateral slide portion 60 from sliding or made to be separated therefrom so as to allow the lateral slide portion 60 to slide.

A lateral slide portion slide lever 69 is supported rotatably by the lever support bar 43*q* inserted into a bearing provided in the lever support plates 43*k*1, 43*k*2 of the above-mentioned slit 43*s* (refer to FIGS. 7A-7D). Since a pinion portion 69*c* arranged on a base end side of a bar main body 69*a* along a semicircle about the lever support bar 43*q* and a rack portion 67*f* formed in the lateral slide base plate 63 engage with each other, by operating the lateral slide portion slide lever 69 to turn around the lever support bar 43*q*, the lateral slide portion 60 can be made to slide in any direction of the longitudinal direction L with respect to the securing portion 40 (securing portion base plate 43). Then, the present apparatus can be used with the lever shifted to the desired slide position.

In the following, another embodiment of the forming apparatus 11 according to the present invention will be shown. Since the basic configuration of the forming apparatus 11 is the same, the duplicated explanation will be omitted. The forming apparatus 11 of the present invention comprises: tongue parts 41 capable of forming mortar in a ridge-and-groove shape even if the apparatus is used alone; gaps 42 therebetween; and a member defining top ends of the gaps 42 and connecting the plurality of tongue parts 41 at the base ends thereof and linking the plurality of tongue parts 41 at respective intervals of the gaps 42 (hereinafter, the part comprising: the plurality of tongue parts 41, the gaps 42 therebetween, and the linking member is referred to as "stationary blade 40*a*"). Further, a lateral slide portion 60 of another embodiment may be provided, and the lateral slide portion 60 may comprise: a plurality of tongue parts 61; gaps 62 therebetween; and a member linking the plurality of tongue parts 61 at respective intervals of the gaps 62 (hereinafter, the part comprising: the plurality of tongue parts 61, the gaps 62 therebetween, and the linking member is referred to as "lateral slide blade 60*a*"). As described above, the variable slit may be employed or the securing portion 40 provided with various kinds of stationary blades 40*a* may be prepared such that one of the stationary blades 40*a* may be replaced with another thereof as appropriate depending on the condition. Further, various lengths of forming apparatuses 11 are prepared and any of them can be appropriately selected or combined as appropriate on site. Here, an example in which the lateral slide portion 60 is provided with different kinds of lateral slide blades 60*a* will be explained.

Figure 21A:
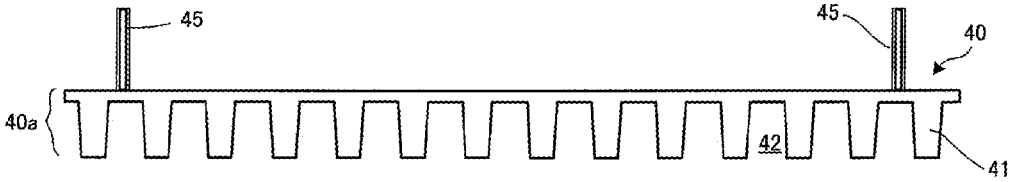
FIG. 21A is a rear view showing a securing potion according to another embodiment.
Figure 21B:
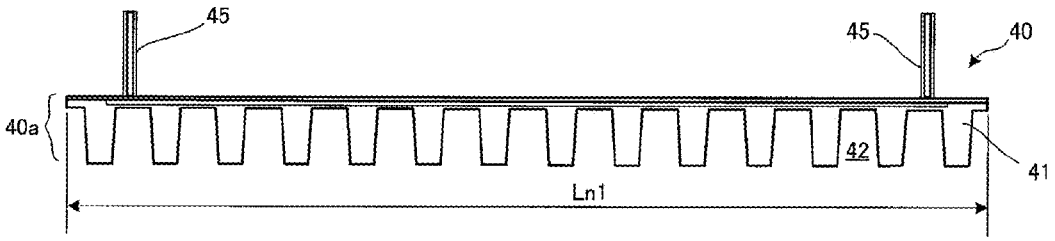
FIG. 21B is a rear view showing a securing potion according to yet another embodiment.

FIGS. 21A and 21B are a rear view and a front view of the securing portion 40 having a total length Ln1 of about 600 mm according to another embodiment, respectively. The total length of about 600 mm corresponds to a width of a tile to be laid. That is, a necessary and sufficient amount of mortar can be provided in a desired form by a single application along the tile width to be described later if the forming apparatus 11 having the same or a little shorter length than the tile width. Here, the notched trowel of the prior art has the length of at most 300 mm or so such that a necessary amount of mortar for the tile having the width of 600 mm cannot be applied by a single application. That is, when a larger scale tile is laid, a forming apparatus 11 having a securing portion 40 (here, the reference length is the distance between tongue parts 41 arranged on both ends plus about one-half of the width of the gap 42 between the tongue parts 41 (substantial length of the stationary blade 40*a*) Ln1) having the same length or a shorter length (for example, being preferably shorter by the working clearance of 20 mm or so), as compared to the width of the tile, may be employed. The securing portion 40 of this forming apparatus 11 comprises fourteen (14) tongue pars 41 aligned at even intervals. The shape of each tongue part 41 is the same as that of the example described above.

Figure 22A:
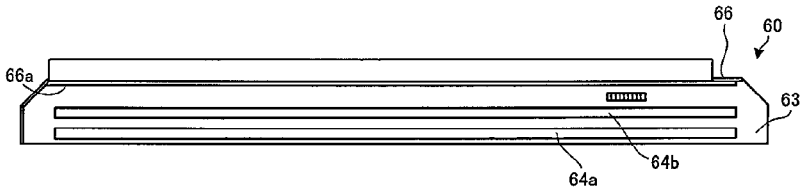
FIG. 22A is a plan view showing a lateral slide portion according to another embodiment.
Figure 22B:
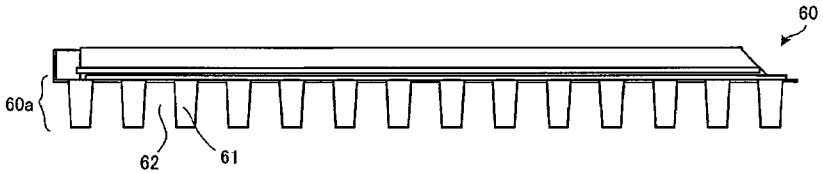
FIG. 22B is a rear view showing the lateral slide portion according to the other embodiment.
Figure 22C:
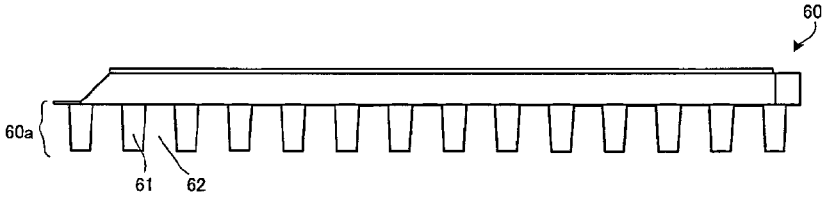
FIG. 22C is a front view showing the lateral slide portion according to the other embodiment.

FIGS. 22A-22C show a top view, a rear view, and a front view of a lateral slide portion 60 comprising a lateral slide blade 60*a* as another embodiment, respectively. The lateral slide portion 60 of the previous embodiment as described above has the same configuration except for the configuration of the tongue part 61 and the duplicated explanation will be omitted. Each tongue part 61 has the same shape and fourteen (14) of the ones are provided in the same manner with the tongue parts 41 of the securing portion 40 as described in the previous paragraph. However, pitches of the gaps 62 corresponding to the gaps 42 of the securing portion 40 are a little anomalistic such that gaps 62 become gradually narrower as it goes from the center (corresponding to the tongue parts of seventh (7th) and eighth (8th) if counted from the end) to either end part. In this way, when the lateral slide blade 60*a* is slid a little, the gaps 42 formed by the tongue parts 41 on both end sides can be easily covered by the tongue parts 61 of the lateral slide blade 60*a*.

Figure 23A:
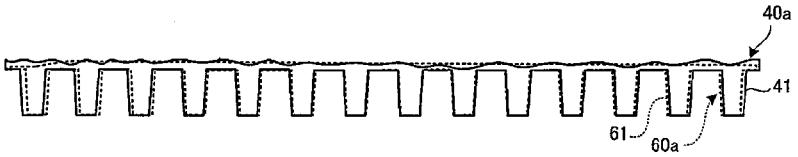
FIG. 23A is a partial diagram illustrating that the lateral slide blade of FIG. 22B is laid over the stationary blade of FIG. 21A.
Figure 23B:
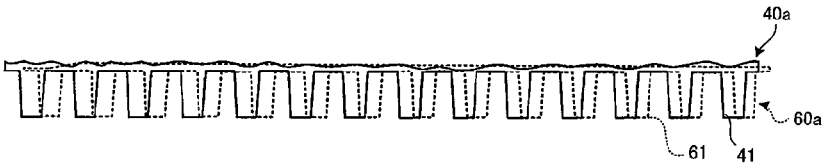
FIG. 23B is a partial diagram illustrating that the lateral slide blade of FIG. 22B is laid over the stationary blade of FIG. 21A.
Figure 23C:
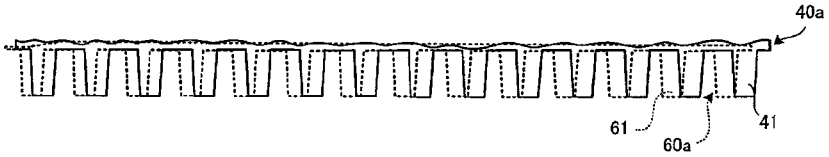
FIG. 23C is a partial diagram illustrating that the lateral slide blade of FIG. 22B is laid over the stationary blade of FIG. 21A.

FIGS. 23A-23C show partially a state of the stationary blade 40*a* and the lateral slide blade 60*a* viewed from the back side. In order to make the explanation easier, the lateral slide blade 60*a* is indicated by a broken line, which does not indicate a hidden outline. The diagram may be interpreted to be a figure in which the lateral slide blade 60*a* is made transparent. From the figure (FIG. 23A) in which the lateral slide blade 60*a* is matched at the center, it should be understood that respective tongue parts 41 and 61 have the same shape. Even though the lateral slide blade 60*a* is positioned at the reference position, the tongue parts 61 at both ends of the lateral slide blade 60*a* cover partially the gaps 42 on the inner side of the tongue parts 41 at both ends of the stationary blade 40*a*. Therefore, it should be understood that the formed ridge-and-groove shape of mortar has thinner ridges on both end sides than the other ridges such that the ridge at the center is the thickest and the ridges gradually become thinner towards the both ends.

When the lateral slide blade 60*a* is shifted to the right (FIG. 23B), the tongue part 61 of the lateral slide blade 60*a* on the right side end is shifted from the tongue part 41 of the stationary blade 40*a* to the right by the half width of the tongue part 61 such that a mortal passable area of the tongue part 41 on the right end is partially closed. It should be understood that, since a portion that is a little larger than an approximately half of the tongue part 61 covers the gap 42 with respect to the tongue part 41 located at the immediately left of the above-mentioned one, a mortal passable area is partially closed. When the tongue part 41 on the left side is considered in turn, it should be understood that a partially-closed area of the mortar passable area of the gap 42 by the tongue part 61 is gradually increasing. And with respect to the tongue part 41 at the leftmost end, the tip end of the tongue part 61 of the lateral slide blade 60*a* corresponding thereto is almost separated from the tip end of the tongue part 41. If it is farther shifted to the right, these tip ends are separated from each other such that it is considered that a small opening in a slit shape therebetween will be made, which is not preferable, and it is preferable that the current position is to be the rightmost position.

Conversely, if it is shifted to the left side (FIG. 23C), the situation will be bilaterally symmetric with the case where it is shifted to the right such that the explanation is omitted.

Figure 24A:
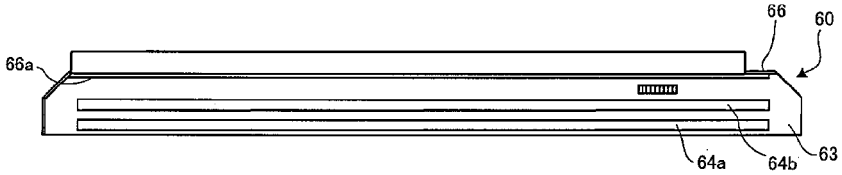
FIG. 24A is a plan view showing a lateral slide portion according to yet another embodiment.
Figure 24B:
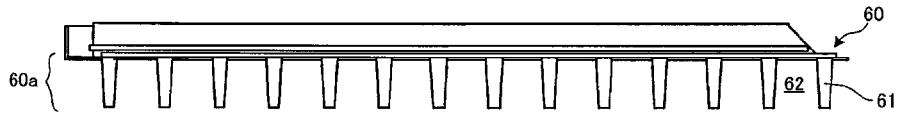
FIG. 24B is a rear view showing the lateral slide portion according to yet another embodiment.
Figure 24C:
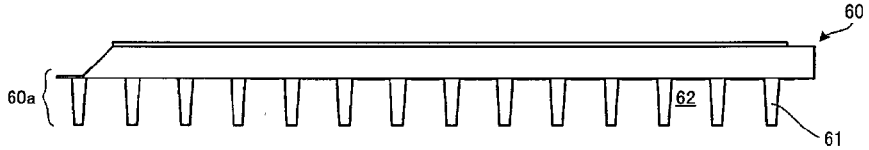
FIG. 24C is a front view showing the lateral slide portion according to yet another embodiment.

FIGS. 24A-24C show a top view, a rear view, and a front view of a lateral slide portion comprising a lateral slide blade 60*a* of yet another embodiment, respectively. Since it has the same configuration as the other embodiment if compared to the lateral slide blade 60*a* of the other embodiment shown in FIGS. 22A-22C except for that the width of the tongue part 61 is made to be about half and the gap 62 is made to be wider, the explanation is omitted.

Figure 25A:
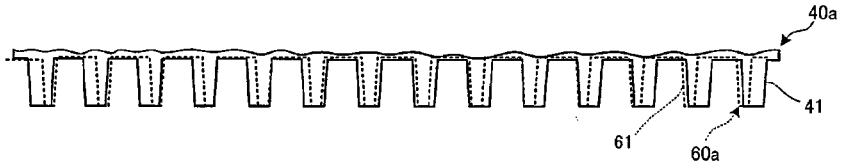
FIG. 25A is a partial diagram illustrating that the lateral slide blade of FIG. 24B is laid over the stationary blade of FIG. 21A.
Figure 25B:
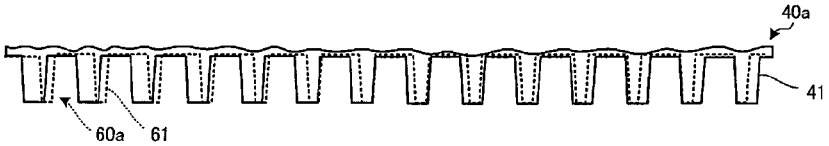
FIG. 25B is a partial diagram illustrating that the lateral slide blade of FIG. 24B is laid over the stationary blade of FIG. 21A.
Figure 25C:
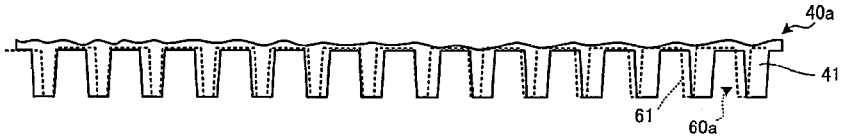
FIG. 25C is a partial diagram illustrating that the lateral slide blade of FIG. 24B is laid over the stationary blade of FIG. 21A.

FIGS. 25A-25C show partially a state of a stationary blade 40*a* and a lateral slide blade 60*a* of yet the other embodiment as shown in FIGS. 24A-24C, viewed from the rear. Since the configuration is basically the same as in the case of FIGS. 23A-23C, the duplicated explanation will be omitted. From the figure (FIG. 25A) in which the lateral slide blade 60*a* is matched at the center, it should be understood that the tongue part 61 of the lateral slide blade 60*a* has about one-half of the width of the tongue part 41 and exhibits an isosceles trapezoid having the same height as the tongue part 41. The tongue parts 61 of the lateral slide blade 60*a* at the both ends cover partially the gaps 42 inside of the tongue parts 41 of the stationary blade at both ends.

Further, when the lateral slide blade 60*a* is shifted to the right (FIG. 25B), the tongue part 61 of the lateral slide blade 60*a* at the right end overlaps entirely the tongue part 41 of the stationary blade 40*a* so as not to affect the mortar passable area of the tongue part 41 at the right end and not to cover the gap 42 on the left side. It should be understood that, with respect to the tongue part 41 located at the immediately left of the above-mentioned one, the whole tongue part 61 overlaps the tongue part 41 such that the gap 42 is not covered, but the tongue part 61 is shifted a little toward the right side. From this, it should be understood that the tongue parts 61 are shifted little by little towards the right side until the eighth (8th) tongue part 41 from the right and the entire tongue parts 61 overlap the respective tongue parts 41. After the ninth (9th) or subsequent tongue parts 41, the right side of each of the tongue parts 61 gradually shifts from the overlapped area with the corresponding tongue part 41 and covers part of the corresponding gap 42 and, with respect to the tongue part 41 at the leftmost end, the tip end of the corresponding tongue part 61 of the lateral slide blade 60*a* becomes almost separate from the tip end of the tongue part 41. That is, as mentioned with reference to FIGS. 23A-23C, the gap 42 at the left end is covered by the tongue part 61.

Conversely, if it is shifted to the left side (FIG. 23C), the situation will be bilaterally symmetric with the case where it is shifted to the right such that the explanation is omitted.

Figure 28:
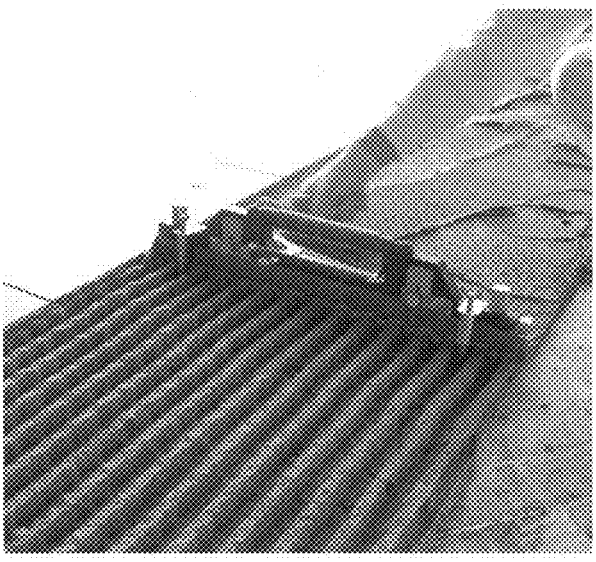
FIG. 28 is a diagram showing a state where a ridge-and-groove shape of the adhesive mortar is formed on the laying surface with an apparatus of an embodiment of the present invention.

The configuration in which the amount of covering the gap 42 (covering percentage) at either end is maximized and is minimized at the other end as described above may be an effective means to apply the mortar to the inclined surface to be described later. Here, a method of shaping the adhesive substance and a method of laying tiles with the present apparatus 11 will be explained in reference with FIGS. 28 and 29. FIG. 28 shows how a ridge-and-groove shape is formed with the present apparatus 11. An operator grasps the grasping portion 15 of the main body 21 and moves the present apparatus 11 in a traverse direction toward the back side in the figure. In the traveling direction of the movement, preliminarily provided mortar is prepared and leveled in a relatively flat state. Here, it is not necessary to level the mortar completely, but a trace of the operator's leveling attempts for several times in order to make the mortar as flat as possible can be seen. In this way, according to the pressure bonding method, it is necessary to scrape the surface and add mortar to the surface for several times in order to make the surface completely flat since a relatively small scale trowel is used to level the surface. However, as recognized by looking at mortar in a ridge-and-groove shape on the front side in the figure, one-time movement in the traverse direction can make a necessary amount of mortar and a desired shape of mortar. This is because the present apparatus 11 comprises a stationary blade 40*a* having tongue parts 41 formed in a predetermined shape. This is also because a storage space 70 is secured to store temporarily excess amount of mortar on the lower side of the main body 21. And, it is more preferable to include a lateral slide blade 60*a* that can easily modify the ridge-and-groove shape. Also, a rather large work space near and above the stationary blade 40*a* and/or the lateral slide blade 60*a* is provided to the grasping portion 15 in order to make it easier to move the stationary blade 40*a* and/or the lateral slide blade 60*a* as being kept in an approximately vertical to the laying surface. In general, since excess amount of mortar is at least temporarily stored in the above-mentioned storage space 70 during the movement in the lateral direction, a predetermined pressure from the mortar as a fluid is applied and rising force from the bottom surface of the main body 21 is applied as the apparatus is moved in the lateral direction. During this movement, the operator grasps the grasping portion 15 and pushes it from the above to make tip ends of the stationary blade 40*a* and/or the lateral slide blade 60*a* and the height adjusting part 91*a*, 91*b* contact the laying surface such that the height position of the present apparatus 11 may be easily kept constant and a necessary amount of mortar may be secured for laying the tile.

Vertical slide edge slide rails 86*a*, 86*b*, 86*c* to which notches are provided along each rail extending direction (here, up-and-down direction) at predetermined intervals (e.g., 2 mm) are arranged in approximately parallel to each other along an up-and-down direction on the back surface 22*b* side of the main body 21. Moveable slide members 88*a*, 88*b*, 88*c* to which a notch engaging spring 87 is installed so as to engage with the notches and be latched at every interval to sound tick-tick are inserted (refer to FIG. 8). The vertical slide edge slide lever 85*a*, 85*c* are attached to the vicinity of top ends of the slide members 88*a*, 88*c*, respectively. Also, vertical slide edge securing screws 83*a*, 83*b*, 83*c* are attached to the vicinity of bottom ends of the slide member 88*a*, 88*b*, 88*c*, respectively.

And, with respect to the back surface 22*b*, a vertical slide edge sliding plate 89 of a plate member is attached to the back surface, the main surface 89*a* on the opposite side contacts the rear surface of the vertical slide edge 81 (made of metal) and can smoothly slide thereon such that the main surface 89*a* is formed in a smooth manner and made of a material (e.g., hard synthetic resin) having a small friction coefficient against the rear surface (metal) of the vertical slide edge 81.

The vertical slide edge 81 is made of a thin plate member of a reed shape (belt-like) having a top edge 82*a* and a bottom edge 82*b*; is secured, respectively, to slide members 88*a*, 88*b*, 88*c* by the vertical slide edge securing screws 83*a*, 83*b*, 83*c* so as to be approximately parallel in the longitudinal direction L in FIGS. 1 to 8; and can move freely along the vertical slide edge slide rails 86*a*, 86*b*, 86*c*. If the vertical slide edge securing screws 83*a*, 83*b*, 83*c* are firmly tightened, the frictional resistance between the vertical slide edge sliding plate 89 and the main surface 89*a* is increased such that this type of movement can be regulated; and if the vertical slide edge securing screws 83*a*, 83*b*, 83*c* are loosened, it can relatively easily move together with the slide members 88*a*, 88*b*, 88*c*; but not much restriction against movement of the sliding members exists such that the slide member 88*a* can be slid almost without moving the slide member 88*c* if it is attempted to move only the slide member 88*a*. Therefore, not only the height of the vertical slide edge 81 relative to the main body 21, but also inclinations of the top edge 82*a* and the bottom edge 82*b* to the longitudinal direction L can be adjusted.

Figure 16:
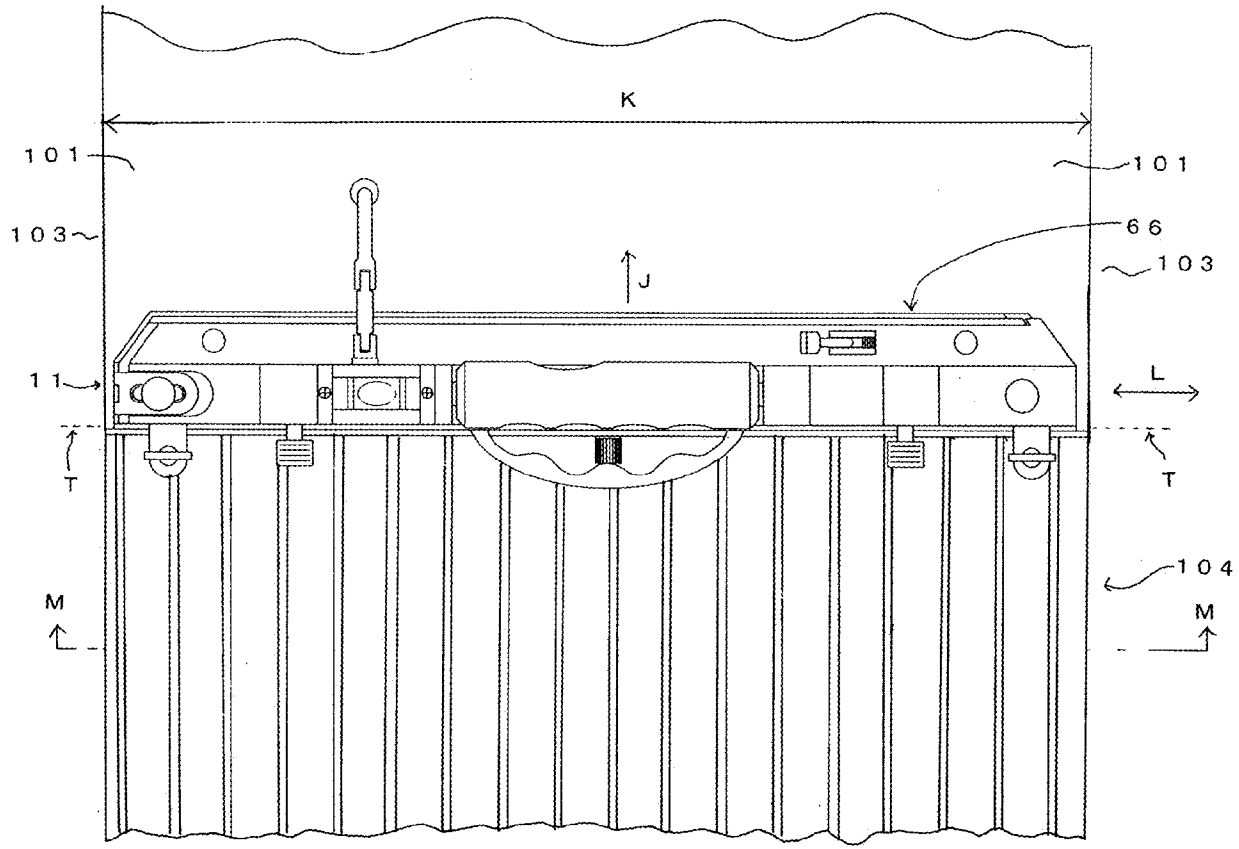
FIG. 16 is a plan view showing a state that a ridge-and-groove shape is formed by utilizing the present apparatus with adhesive mortar applied onto a surface of an attaching slab (concrete slab).

Here, the end face of the bottom edge 82*b* of the vertical slide edge 81 inclines as the left side is lower and constitutes a tip end having an acute angle together with a vertical surface on the left side of the vertical slide edge 81. In the case of shaping the adhesive substance as shown in FIG. 16, the present apparatus travels in the J direction such that excess amount of the adhesive substance above the tip end is blocked by the vertical surface on the left side of the vertical slide edge 81 and flows to make vortex in a dead zone formed between the vertical surface and the bottom surface of the lateral slide base palate 63. However, the tip end of the vertical slide edge 81 is sharp and it is so configured that the adhesive substance contacting the tip end of a blade edge is difficult to flow into the right side in FIG. 5 along the contact surface. The vertical surface corresponds to a rake of a single-point cutting tool and it is just like a clearance angle is provided at the end face of the bottom edge 82*b*.

Here, a gasket 53 made of rugger (a disk-like shape with a through hole in the center) is wrapped around the vertical slide edge securing screw 83*a* on the main body 21 side of the vertical slide edge securing screw 83*a* penetrating the vertical slide edge 81 and provided in the vicinity of the bottom end of the slide member 88*a*. The gasket 53 prevents or reduces the degree of intrusion of the mortar (not shown) to the vertical slide edge slide rail 86*a* side through a space between the tongue part 41 and the vertical slide edge 81 (refer to FIG. 8).

As mentioned above, both inclination to the longitudinal direction L and height of the vertical slide edge 81 relative to the main body 21 can be adjusted independently from the other adjustments. By this, the floor construction on the inclined surface, for example, is enabled. The initial application thickness of the adhesive substance may be about 10 mm or more, 20 mm or more, or 30 mm or more; and may be 60 mm or less, 50 mm or less, or 40 mm or less, but the range of thickness may be made by combining them as appropriate depending on the construction subject. And, the thickness may be made, for example, to be lower on one side and higher on the other side in the longitudinal direction L of the present forming apparatus. For example, if it is 10 mm on the one side and 40 mm on the other side, the height of the vertical slide edge 81 can be inclined such that heights of the ridges may be adjusted to be such heights. For example, even if the laying surface is deviated from the horizontal surface, the surfaces of the tiles after construction can be made horizontal by changing the thicknesses of the adhesive substance.

A height adjusting part 91 comprises a pair of height adjusting parts 91*a*, 91*b* arranged on both sides along the longitudinal direction L of the main body 21, and the duplicated explanation is omitted since both have a similar configuration. The height adjusting part comprises: a female threaded portion 93 of a sleeve-like shape having an interior threaded with female threads and attached to the main body 21; a male outside-threaded portion 92 inserted into the female threaded portion 93 so as to engage with the female threads of the female threaded portion 93; and a closing valve part 94 attached to the bottom end of the female threaded portion 93 so as to prevent ingress of mortar (not shown) into the inside of the female threaded portion 93 from the bottom end.

The female threaded portion 93 is configured to be in a hollow cylinder shape with an open top end and an open bottom end and the interior of the hollow cylinder is threaded with female threads. Here, with either of height adjusting parts 91*a*, 91*b*, a top end of the female threaded portion 93 is attached to each of the height adjusting part support portions 29*a*, 29*b* formed in the main body lower portion 23 such that the female threaded portion 93 is supported by the main body lower portion 23.

The male threaded portion 92 comprises an axis portion having an exterior threaded with male threads and a grasping portion attached to the top end so as to turn the male threaded portion 92. The male threaded portion 92 penetrated through the female threaded portion 93 is turned in a normal direction or in a reverse direction so as to move freely in the up-and-down direction and adjust the height.

The closing valve part 94 prevents ingress of mortar (not shown) from the bottom end of the female threaded portion 93 when the bottom end of the male threaded portion 92 is located above the bottom end of the female threaded portion 93.

As mentioned above, since the height adjusting parts 91*a*, 91*b* can allow the bottom end of the male threaded portion 92 to be freely moved in an upward or downward direction with respect to the main body 21, it is possible to apply the mortar on the underlying surface such as a concrete slab (not shown) to build up to the desired height. For example, to be described later, a predetermined amount of mortar can be applied in a constant manner whether with or without the tip ends of the tongue parts 41, 61 contacting the underlying surface. In particular, even if the underlying surface is inclined, the amount of mortar can be adjusted according to the inclination along the longitudinal direction L.

The stand 96 comprises: a base member 96*a* attached rotatably to the main body 21 at the base end thereof and an end member 96*b* attached rotatably along the longitudinal direction L at the end portion of the base member 96*a*. And the tip end of the end member 96*b* and another portion (for example, tip ends of the tongue part 61 and/or the tongue part 41, a bottom end of axis portion of the male threaded portion 92 of the height adjusting parts 91*a*, 91*b*) of the present apparatus 11 are in contact with the placing surface (for example, a surface of concrete slab (not shown) or the like) of the present apparatus 11 such that the present apparatus 11 may stand by itself on the placing surface (for example, a surface of the concrete slab (not shown) or the like). Here, both turnings: turning of the base end of the base member 96 with respect to the main body 21 and turning of the base end of the end member 96*b* with respect to the base member 96*a* require application of force to some degree such that it is possible to keep the present apparatus 11 standing with the desired angle on the placing surface.

In addition, the stand 96 has the base end configured to be attachable to and detachable from the main body 21 such that it can be detached when it is not necessary and it can be attached thereto when it is necessary.

Figure 15A:
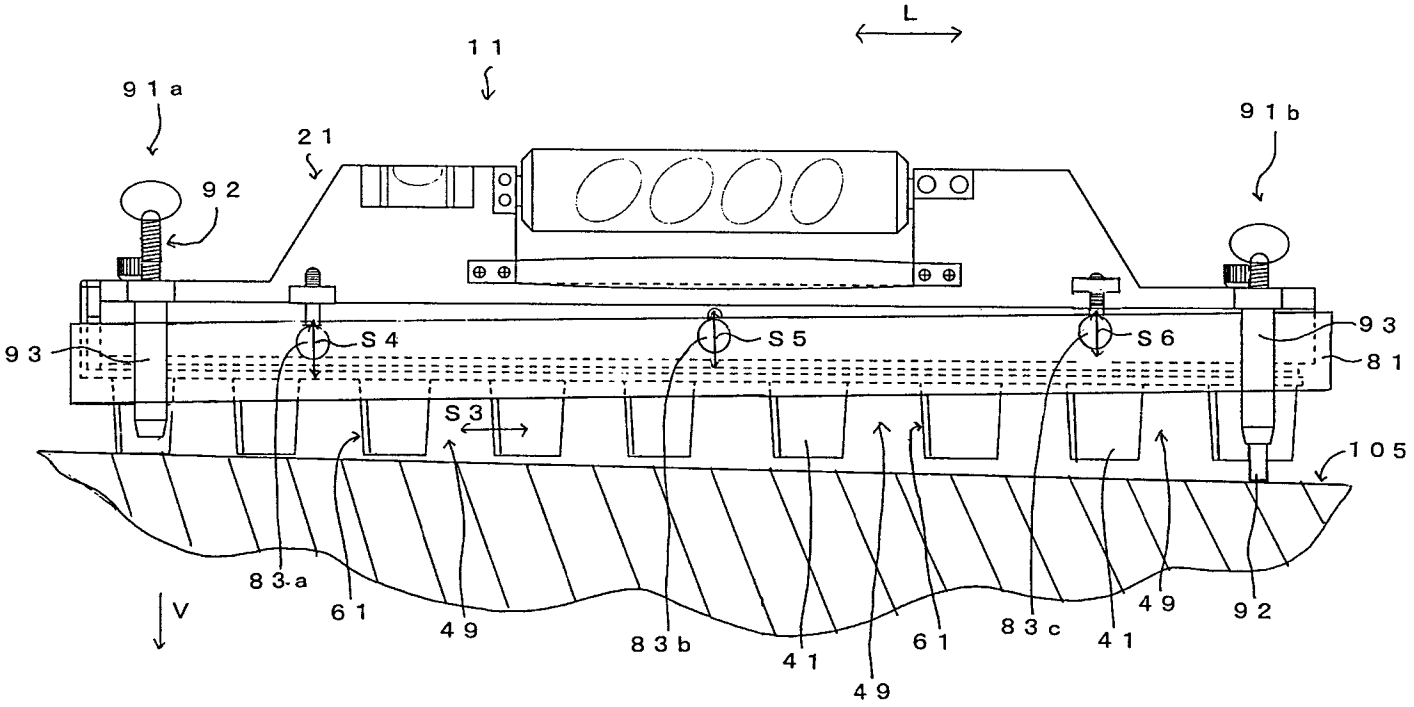
FIG. 15A is a diagram showing a state of a present apparatus mounted on a placing surface (cross-section view).
Figure 15B:
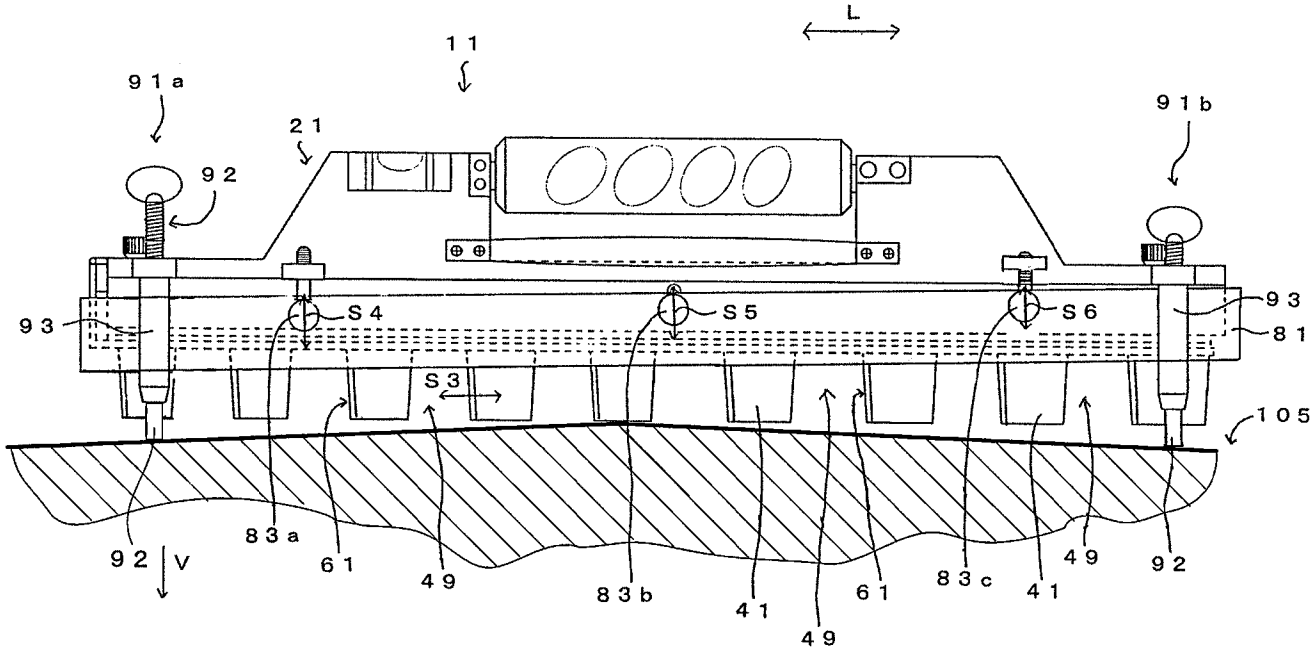
FIG. 15B is a diagram showing a state of the present apparatus mounted on a placing surface (cross-section view).

A state that such present apparatus 11 is placed on the placing surface 105 (plane) is shown in the rear view (FIG. 15A). With respect to the present apparatus 11, the inclination of the present apparatus 11 with respect to the placing surface 105 can be varied according to the following adjustments. (Adjustment 1) The width of the slit 49 formed between the tongue part 61 and the tongue part 41 is changed by S3 moving the lateral slide portion 60 along the longitudinal direction L with respect to the securing portion 40; (Adjustment 2) The height of the vertical slide edge 81 from the placing surface 105 is adjusted by S4, S5, S6 moving the position of the vertical slide edge securing screws 83*a*, 83*b*, 83*c* supporting the vertical slide edge 81 with respect to the main body 21; (Adjustment 3) The inclination of the vertical slide edge 81 with respect to the placing surface 105 is changed by S4, S5, S6 shifting the positions of the vertical slide edge securing screws 83*a*, 83*b*, 83*c* with respect to the main body 21; (Adjustment 4) The height of the height adjusting part 91*a* from the placing surface 105 is adjusted by moving forward or backward the male threaded portion 92 of the height adjusting part 91*a* with respect to the female threaded portion 93; (Adjustment 5) The height of the height adjusting part 91*b* from the placing surface 105 is adjusted by moving forward or backward the male threaded portion 92 of the height adjusting part 91*b* with respect to the female threaded portion 93; and (Adjustment 6) The height of the height adjusting part 91*a* and the height adjusting part 91*b* from the placing surface 105 are adjusted as described in (Adjustment 4) and (Adjustment 5). FIG. 15B shows a rear view showing a construction method when the placing surface is convex. The difference from FIG. 15A is that the male threaded portion 92 of the height adjusting part 91*a* has moved forward with respect to the female threaded portion 93 such that the tip end of the male threaded portion 92 is in contact with the placing surface 105. On such a placing surface, the present apparatus 11 can be stabilized by two contact points, which are provided by the height adjusting parts 91*a*, 91*b*, and a contact point of the tip end of the tongue part 41 located at the center.

Figure 17:
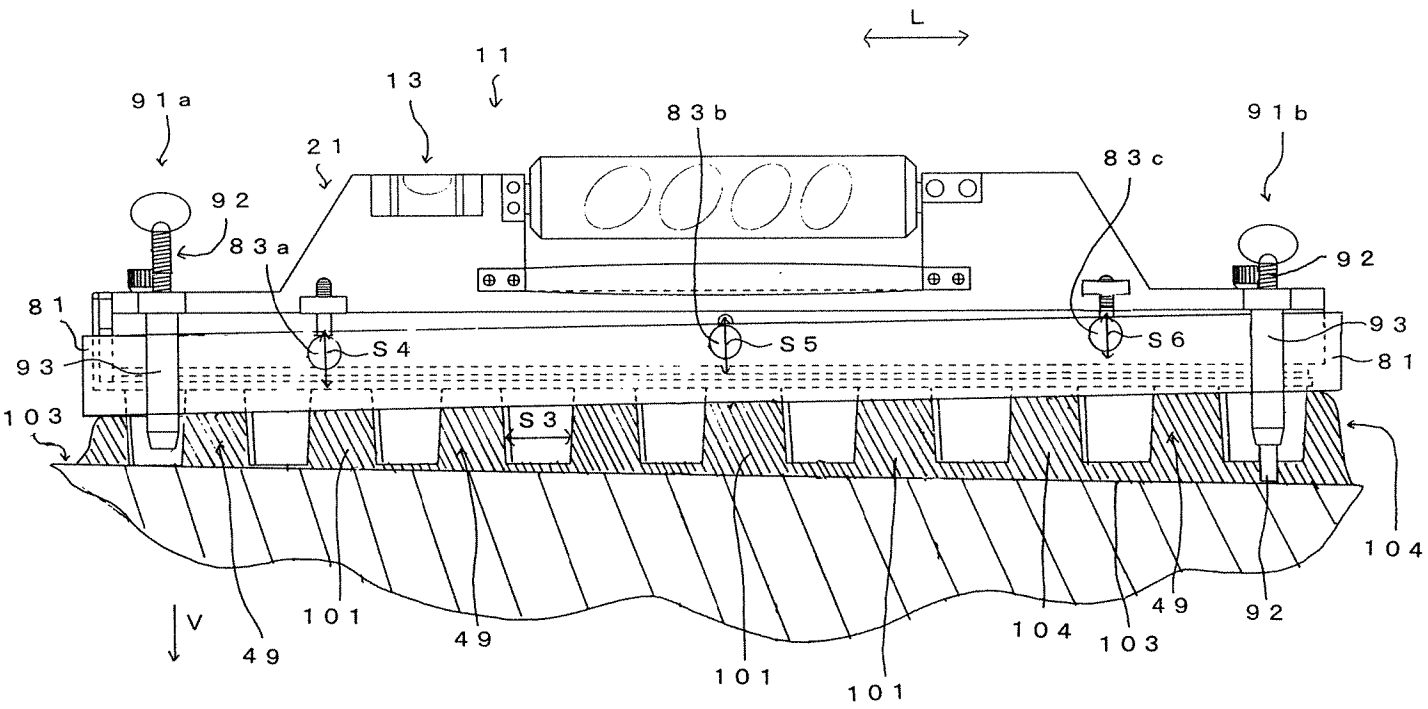
FIG. 17 is a cross-section view along M-M line of FIG. 16.

FIG. 16 is a plan view showing how a ridge-and-groove shape is formed by the present apparatus with adhesive mortar 101 (to adhere the tile and the subject slab 103) applied with a predetermined thickness to the surface of the subject slab (concrete slab) 103 on which tiles (not shown) are bonded. FIG. 17 is a cross-section view along M-M line of FIG. 16. The forming method of forming the ridge-and-groove shape of the adhesive mortar 101 will be explained with reference to FIGS. 16 and 17.

First, adhesive mortar 101 is applied to the surface of the subject slab 103 with a predetermined thickness (for example, 10 mm) and a predetermined width K (refer to FIG. 16). The predetermined width K is a little shorter than the width of the subject tile (not shown) to be bonded later (for example, 10 to 20 mm shorter than the tile width).

Next, the present apparatus 11 (what has the size along the longitudinal direction L being approximately the same as the width K is used) having been adjusted with respect to contents of the above (Adjustment 1) to (Adjustment 6) is moved in the arrow J direction (with the predetermined width K and a vertical direction) (the user (not shown) of the present apparatus 11 grasps the grasping portion 15 with the hand and moves the present apparatus 11 in the arrow J direction by applying force toward the arrow J direction to the present apparatus 11). In this way, the adhesive mortar 101 passes through the slits 49 of the present apparatus 11 such that the ridge-and-groove shape 104 corresponding to the shape of slits 49 can be formed with the adhesive mortar 101. Here, during the operation of forming a floor structure by forming the adhesive mortar 101 in the ridge-and-groove shape 104 with the present apparatus 11 and laying tiles (not shown), the present apparatus 11 can be retained (in this way, it is possible to prevent the adhesive substance from adhering to the present apparatus more effectively than the case where the present apparatus 11 is laid around on the surface of the subject slab (it is likely that the adhesive mortar 101 exists)) as the present apparatus 11 is standing by itself on the surface of the subject slab 103 with the stand 96 when the present apparatus 11 is not used. It is not necessary to say that the stand 96 can be detached as appropriate depending on the operation.

Here, when the ridge-and-groove shape 104 is formed with the adhesive mortar 101 by moving the present apparatus 11 in the arrow J direction, the front wall member 66 can prevent or reduce the degree of adhesion of the adhesive mortar 101 to the main body 21.

Figure 20A:
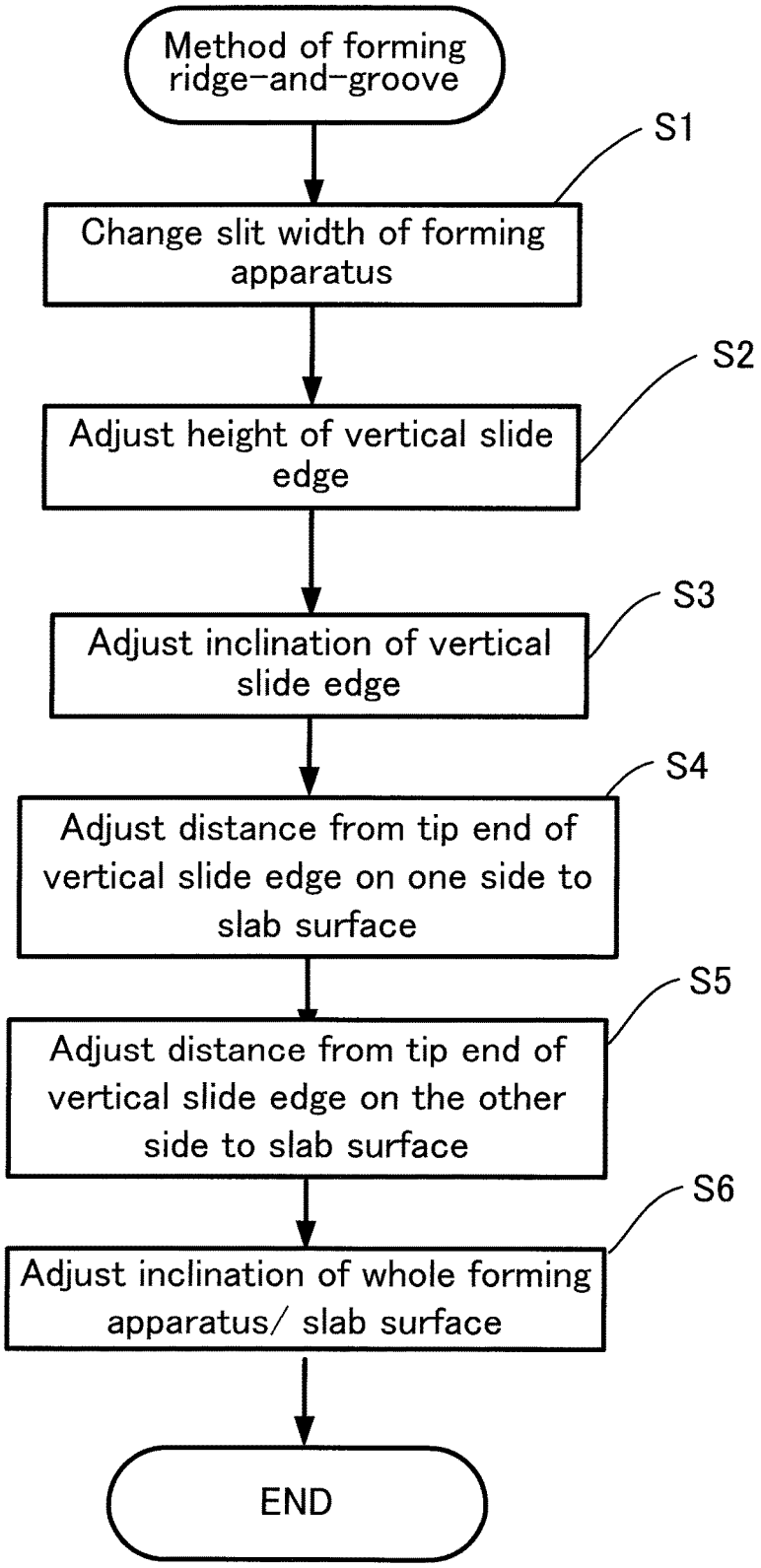
FIG. 20A is a flow chart of an example of a method of forming adhesive mortar in a ridge-and-groove shape with the present apparatus.
Figure 20B:
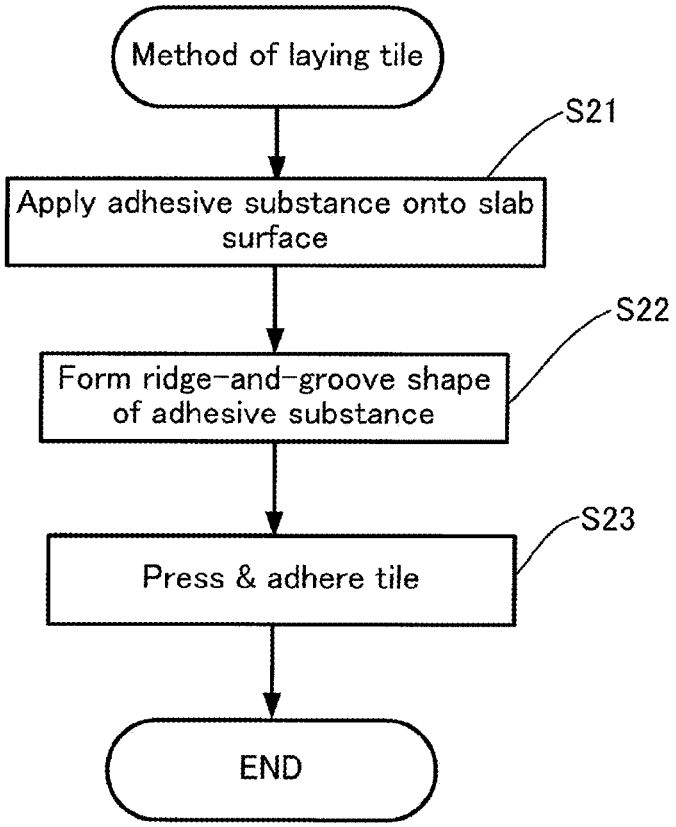
FIG. 20B is a flow chart of an example of a method of adhering a tile on a surface of a slab with the present apparatus.

The above (Adjustment 1) to (Adjustment 6) will be explained in detail as follows (refer to FIG. 20A). As shown in FIG. 17, with respect to the ridge-and-groove shape 104 to be formed with the adhesive mortar 101, the following may be conducted freely. (Adjustment 1, S1 (FIG. 20A)) Each width of each ridge formed with the adhesive mortar 101 is changed by changing each width of each slit 49 by moving the lateral slide portion 60 along the longitudinal direction L with respect to the securing portion 40; (Adjustment 2, S2) The height from the ridge portion (upper surface) of the ridge-and-groove shape to the valley is changed by S4, S5, S6 moving the position of the vertical slide edge securing screws 83*a*, 83*b*, 83*c* supporting the vertical slide edge 81 with respect to the main body 21; (Adjustment 3, S3) The inclination of the ridge portion (upper surface) of the ridge-and-groove shape with respect to the width direction is changed by changing the inclination of the vertical slide edge 81 with respect to the placing surface 105 by S4, S5, S6 shifting the positions of the vertical slide edge securing screws 83*a*, 83*b*, 83*c* with respect to the main body 21; (Adjustment 4, S4) The thickness of the adhesive mortar 101 from the valley portion of the ridge-and-groove shape to the surface of the subject slab 103 on the height adjusting part 91*a* side is changed by adjusting the height of the height adjusting part 91*a* from the surface of the subject slab 103 by moving forward or backward the male threaded portion 92 of the height adjusting part 91*a* with respect to the female threaded portion 93; (Adjustment 5, S5) The thickness of the adhesive mortar 101 from the valley portion of the ridge-and-groove shape to the surface of the subject slab 103 on the height adjusting part 91*a* side is changed by moving forward or backward the male threaded portion 92 of the height adjusting part 91*b* with respect to the female threaded portion 93; and (Adjustment 6, S6) The thickness of the adhesive mortar 101 from the valley portion of the ridge-and-groove shape to the surface of the subject slab 103 with respect to the width direction (longitudinal direction L) is changed by changing the inclination of the present apparatus 11 with respect to the surface of the subject slab 103 by adjusting the heights of the height adjusting part 91*a* and the height adjusting part 91*b* from the surface of the subject slab 103 in such a way according to (Adjustment 4) and (Adjustment 5). Here, these adjustments 1 to 6 can be performed while the present apparatus 11 is checked with the bubble tube level 13 if it is horizontal (in the longitudinal direction L). FIG. 20B shows a flowchart illustrating a method of bonding a tile 106 over the subject slab 103 in accordance with the method of forming the ridge-and-groove shape 104 with the mortar 101. That is, the adhesive substance is first applied to the slab surface as the subject member in the method of laying tiles (S21). Next, as illustrated above with FIG. 20A and the like, the surface structure of the adhesive substance is modified. That is, the ridge-and-groove shape is formed on the surface (S22). And the tile is laid and pressed over it such that the tile is bonded (S23).

FIGS. 18A-18C and 19A-19C show end views (showing the M-M end view of FIG. 16) illustrating examples of the ridge-and-groove shape formed with the adhesive mortar 101 by the present apparatus 11.

Figure 18A:
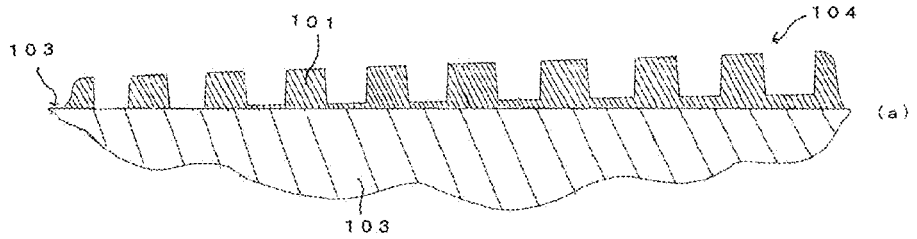
FIG. 18A is an end view (M-M end face of FIG. 16 (state of FIG. 17)) illustrating an example of a ridge-and-groove shape of the adhesive mortar formed with the present apparatus.

FIG. 18A shows the ridge-and-groove shape 104 of the adhesive mortar 101 formed by the present apparatus 11 in condition shown in FIG. 17.

Figure 18B:
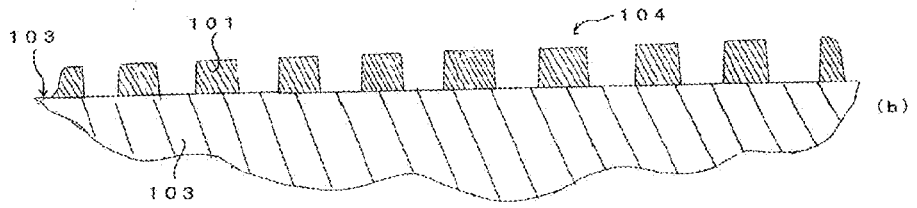
FIG. 18B is an end view (M-M end face of FIG. 16 (Adjustments 5, 6)) illustrating an example of a ridge-and-groove shape of the adhesive mortar formed with the present apparatus.

FIG. 18B shows the ridge-and-groove shape 104 of the adhesive mortar 101 in a state that the thickness of the adhesive mortar 101 from the valley portion of the ridge-and-groove shape to the subject slab 103 on the height adjusting part 91*b* side is reduced (set to approximately 0 mm in the same way as with the height adjusting part 91*a* side) by moving up the male threaded portion 92 of the height adjusting part 91*b* of the present apparatus with respect to the female threaded portion 93 from the state as shown in FIG. 18A (Adjustments 5 and 6).

Figure 18C:
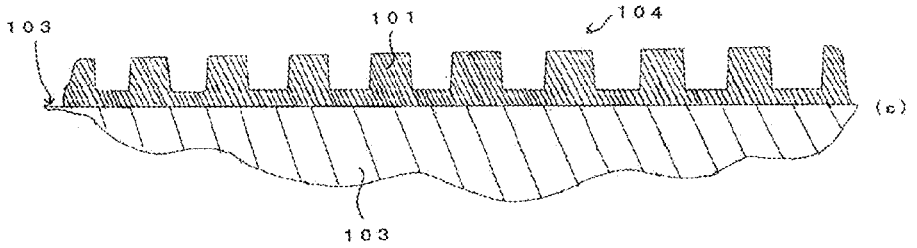
FIG. 18C is an end view (M-M end face of FIG. 16 (Adjustments 4, 6)) illustrating an example of a ridge-and-groove shape of the adhesive mortar formed with the present apparatus.

FIG. 18C shows the ridge-and-groove shape 104 of the adhesive mortar 101 in a state that the thickness of the adhesive mortar 101 from the valley portion of the ridge-and-groove shape to the subject slab 103 on the height adjusting part 91*a* side is increased (set approximately the same as the height adjusting part 91*b* side) by moving down the male threaded portion 92 of the height adjusting part 91*a* of the present apparatus with respect to the female threaded portion 93 from the state as shown in FIG. 18A (Adjustments 4 and 6).

Figure 19A:
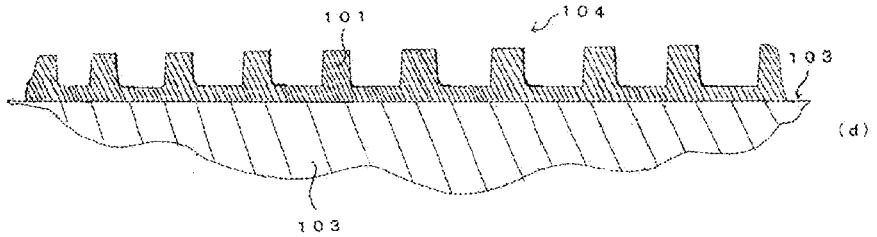
FIG. 19A is an end view (M-M end face of FIG. 16 (Adjustment 1)) illustrating an example of a ridge-and-groove shape of the adhesive mortar formed with the present apparatus.

FIG. 19A shows the ridge-and-groove shape 104 in which the width of the ridge portion formed with the adhesive mortar 101 is reduced by reducing the width of the slit 49 by S3 moving the lateral slide portion 60 along the longitudinal direction L with respect to the securing portion 40 in the present apparatus 11 from a state as shown in FIG. 18C.

Figure 19B:
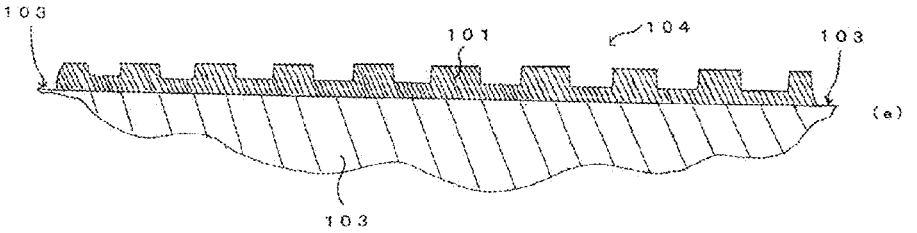
FIG. 19B is an end view (M-M end face of FIG. 16 (Adjustment 2)) illustrating an example of a ridge-and-groove shape of the adhesive mortar formed with the present apparatus.

FIG. 19B shows the ridge-and-groove shape 104 in which the height from the ridge portion (upper surface) of the ridge-and-groove shape to the valley portion is reduced by S4, S5, S6 moving (here, dropping) the positions of the vertical slide edge securing screws 83*a*, 83*b*, 83*c* supporting the vertical slide edge 81 with respect to the main body 21 in the present apparatus 11 from a state as shown in FIG. 18C (Adjustment 2).

Figure 19C:
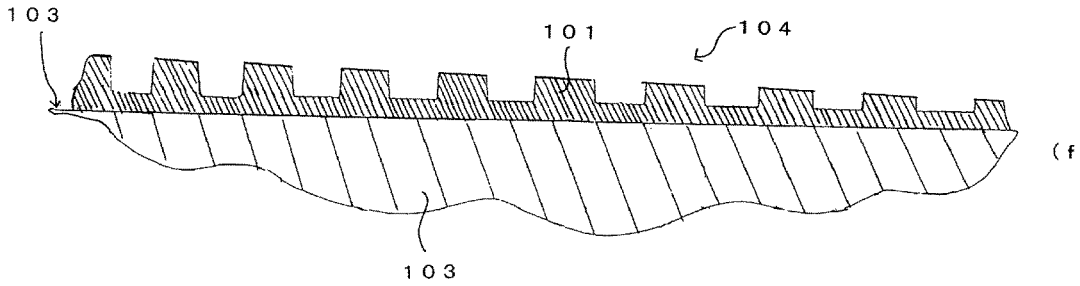
FIG. 19C is an end view (M-M end face of FIG. 16 (Adjustment 3)) illustrating an example of a ridge-and-groove shape of the adhesive mortar formed with the present apparatus.
Figure 19D:
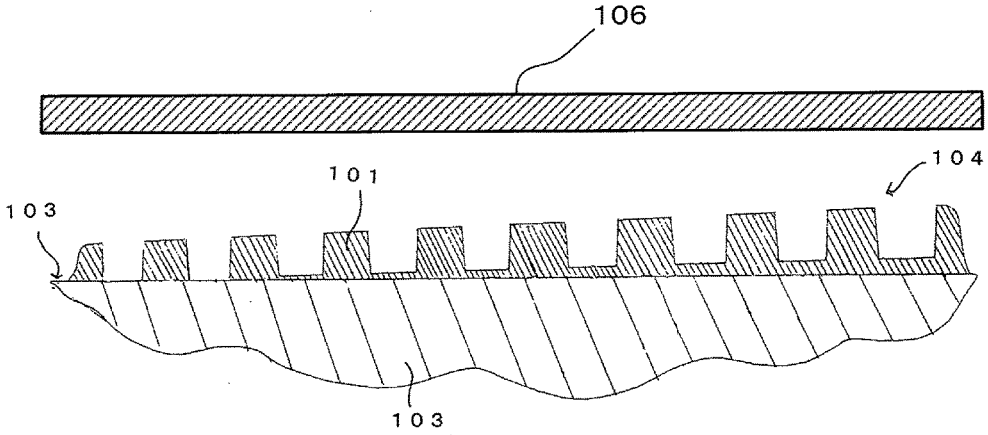
FIG. 19D is a diagram illustrating a relationship between a tile and a ridge-and-groove shape of FIG. 17.

FIG. 19C shows the ridge-and-groove shape 104 in which the inclination of the ridge portion (upper surface) of the ridge-and-groove shape with respect to the width direction (longitudinal direction L) is changed by changing the inclination of the vertical slide edge 81 with respect to the surface of the subject slab 103 by S4, S5, S6 shifting (here, respective movement amounts are different) the positions of the vertical slide edge securing screws 83*a*, 83*b*, 83*c* with respect to the main body 21 in the present apparatus 11 from a state as shown in FIG. 18C (Adjustment 3). FIG. 19D shows the relationship between the ridge-and-groove shape 104 of the adhesive mortar 101 formed by the present apparatus 11 in condition as shown in FIG. 17 and the tile 106 to be pressed and bonded over it.

As described above, the floor structure may be completed by laying tiles (not shown) by laying and pressing the tiles (not shown) over the mortar in the way as conventionally utilized while the ridge-and-groove shape 104 of the adhesive mortar 101 is formed by the present apparatus 11.

As explained above, the present apparatus 11 is a forming apparatus to form the upper surface of the adhesive substance (here, adhesive mortar 101) in a ridge-like shape (ridge-and-groove shape 104) to adhere the laying surface (here, the surface of the subject slab 103) over which tiles are laid and the tile. The present apparatus 11 comprises: tongue forming means (here, a securing portion 40) including: a plurality of tongue parts 41 being provided with gaps 42 therebetween and protruding from respective base ends thereof (upper base Y1 of tongue part 41) existing on a bottom defining line to respective tip ends thereof (lower base Y2 of tongue part 41) as free ends in a protrusion direction V of two directions over a tongue existence plane and perpendicular to the bottom defining line (a line segment along the long side 43*a*) as a line segment existing in the tongue existence plane (plane which is indicated by a dotted line T and the tongue part 41 exists in (FIG. 16)) of a flat surface; grasping means (here, a main body 21) grasped by a user and directly or indirectly fixed to the tongue securing portion; and contact means (a tongue part 41 and height adjusting parts 91*a*, 91*b*) directly or indirectly fixed to the tongue forming means and having at least two contact points contacting at least two points on a virtual plane of a flat surface perpendicular to the direction of protrusion V, wherein legs of perpendicular lines standing on the tongue existence plane from the at least two contact points or the at least two contact points themselves exist on a contact defining line of a line segment located on a protrusion direction V side from the bottom defining line in the tongue existence plane. Here, at least two points on the virtual plane on which the at least two contact points contact exist, with respect to the protrusion direction V, at the same positions as the tip ends of the tongue parts 41 or at positions located towards the protrusion direction V therefrom.

The present apparatus further comprises passing gap changing means, provided between the bottom defining line and the contact defining line (for example, a line showing a placing surface 105 (FIG. 15A)), which changes orthographic projection of each of the passing gaps (corresponding gaps to adhesive mortar 101 (FIG. 17)) which are open in both directions perpendicular to the tongue existence plane. The passing gap changing means comprises a lateral slide portion 60, a vertical slide edge and a mechanism to slide the same (a vertical slide edge slide rail 86*a*, 86*b*, 86*c*, a vertical slide edge slide lever 85*a*, 85*c*, a slide member 88*a*, 88*b*, 88*c*, a vertical slide edge securing screw 83*a*, 83*b*, 83*c*), and a height adjusting part 91. The lateral slide portion 60 changes a width of a slit 49 (Adjustment 1), and the vertical slide edge 81 changes a height from a ridge (upper surface) to a valley of the ridge-and-groove shape (Adjustment 2) and also changes a slope of the ridge (upper surface) of the ridge-and-groove shape with respect to the width direction (Adjustment 3). The height adjusting part 91 changes a thickness of the adhesive mortar 101 from the valley part of the ridge-and-groove shape to a surface of a subject slab 103 on the height adjusting part 91*a* side (Adjustment 4), changes a thickness of the adhesive mortar 101 from the valley part of the ridge-and-groove shape to a surface of a subject slab 103 on the height adjusting part 91*b* side (Adjustment 5), and changes a thickness of the adhesive mortar 101 from the valley part of the ridge-and-groove shape to a surface of a subject slab 103 with respect to the width direction (longitudinal direction "L") (Adjustment 6).

In the present apparatus 11, the additional contact portion (height adjusting parts 91*a*, 91*b*) is configured to comprise a male screw member (a male threaded portion 92) having male threads inscribed on an outer circumference thereof, and a female screw member (a female threaded portion 93) having female threads inscribed on an inner surface thereof to engage with the male screw. Since one of the male screw member and the female screw member (in this example, the female threaded portion 93) is directly or indirectly secured to the tongue forming means (the securing portion 40) and the other one (in this example, the male threaded portion 92) is turned in a normal direction or in a reverse direction, an end part of one of the male screw member and the female screw member provided on the protrusion direction "V" side is moved in the protrusion direction "V."

The present apparatus 11 has a closing valve (for example, the closing valve part 94) capable of allowing in-and-out movement such that the closing valve closes the end part of the female screw member when the end part of the male screw member disposed on the protrusion direction "V" side does not stick out beyond the corresponding end part of the male screw member and that the closing valve can even allow the end part of the male screw member to stick out. Anything having such functions can be used as the closing valve and a rubber tube that is normally in a flatly-collapsed shape, by way of example, can be used.

In the present apparatus 11, the passing gap changing means including: the lateral slide portion 60, the vertical slide edge 81 and the mechanism to slide the same, and the height adjusting part 91, comprises: gap width adjusting means (the lateral slide portion 60) to close the gaps 42 formed between the plurality of tongue parts 41 in a parallel direction with respect to the bottom defining line.

Also, the gap width adjusting means comprises a width adjusting member (here, the member comprises the lateral slide base plate 63 and a plurality of tongue parts 61) that is provided slidably relatively along the bottom defining line with respect to the gaps 42 such that at least part of the gaps 42 formed between the plurality of tongue parts 41 can be closed.

Also, the width adjusting member comprising the lateral slide base plate 63 and the plurality of tongue parts 61 is provided as a plate member in which notches 62 (the gaps 62 that are formed between the plurality of tongue parts 61) are formed in approximately the same shape as the gaps 42 formed between the plurality of tongue parts 41.

Furthermore, the passing gap changing means including the lateral slide portion 60, the vertical slide edge 81 and the mechanism to slide the same, and the height adjusting part 91 comprises variable weir means (here, the variable weir means comprises the vertical slide edge 81 and the mechanism to slide the same) to close the gaps 42 formed between the plurality of tongue parts 41 with a variable width toward the protrusion direction "V" from the bottom defining line.

Also, the variable weir means comprises a weir member (the vertical slide edge 81) having a belt shape to close the plurality of gaps 42 formed between the plurality of tongue parts 41 along the bottom defining line direction and to slide freely relative to the tongue forming means in the protrusion direction "V" and in the opposite direction thereto, the weir member having a main surface that is approximately parallel to the tongue existence plane.

Also, the edge portion (the bottom edge 82*b*) of the weir member on the protrusion direction "V" side is formed in a straight line shape, and the weir member slides such that the angle formed between a straight line including an orthographic projection of the edge portion of the weir member on the protrusion direction "V" side onto the tongue existence plane and a straight line including the bottom defining line may be changed. In this way, the inclination of the vertical slide edge 81 (and its bottom edge 82*b*) with respect to the surface of the subject slab 103 can be changed such that the inclination of the ridge portion (upper surface) of the ridge-and-groove shape with respect to the width direction and the height from the ridge portion to the valley portion may be changed (Adjustment 3).

Furthermore, the contact means includes at least two or more tip end portions (the lower bottom Y2 of the tongue part 41) of the plurality of tongue parts 41.

Also, the grasping means (here, with respect to the main body 21) is attachable to and detachable from the securing portion 40, which is a tongue forming means. Here, the securing portion fixing bolts 45*a*, 45*b* are inserted into the through hole 23*h* that is formed in the main body lower portion 23 of the main body 21, and the securing portion fixing nuts 47*a*, 47*b* are engaged with the securing portion fixing bolts 45*a*, 45*b* from the top end, so that the securing portion 40 is secured to the main body lower portion 23. Therefore, it is possible to prepare a variety of securing portions 40 and make various changes, and it is also possible to make repairs for the wear of the tongue parts 41 and so on or replace the parts easily.

The present apparatus 11 comprises a front rising wall member (front wall member 66) that is formed in a rising manner in an opposite direction to the protrusion direction "V" on the front surface 22*a* side, which is the outer surface of the main body 21, which is grasping means. As described above, in order to form mortar in a ridge-and-groove shape with the present apparatus 11, mortar is provided in advance to accumulate higher than the above-described tongue parts 41, 61 on the front surface side of the present apparatus 11, and the present apparatus 11 is moved in the direction of J to allow the mortar to pass to the back surface 22*b* side of the present apparatus 11 through the gaps 41 or the slits 49, the top end of which is defined by the bottom defining line or the bottom edge 82*b* of the vertical slide edge 81. Since this mortar is provided to accumulate higher than the above bottom defining line or the bottom edge 82*b*, the upper surface of the ridge portion of the ridge-and-groove shape is formed uniformly. At this time, the excess mortar is accumulated under the lower surface of the lateral slide base plate 63 and spreads in the longitudinal direction L, which is the width direction, so that mortar may be supplied within the width to a place where the amount of mortar may be short. Furthermore, the excess mortar may be accumulated on the front surface 22*a* side of the present apparatus 11 as well and may be piled up such that this front wall member 66 can prevent the mortar from directly contacting the main body 21.

Figure 9E:
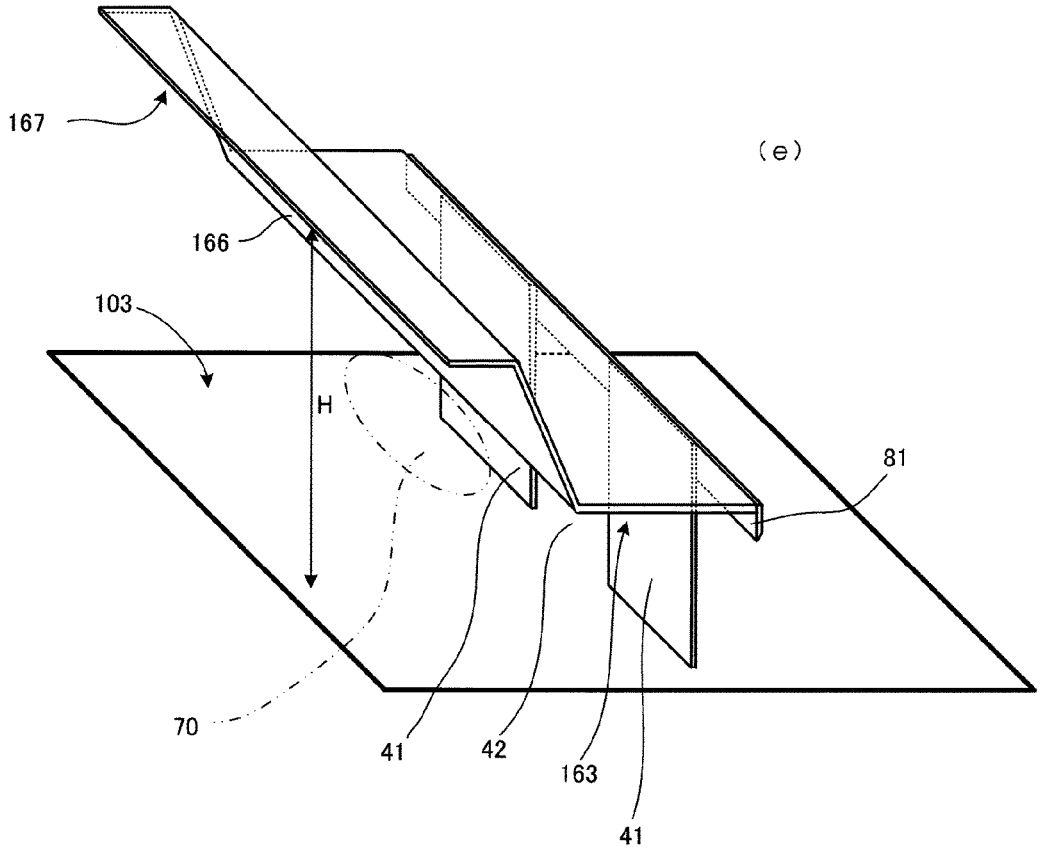
FIG. 9E is a schematic perspective view showing a position relationship of a stationary blade, a vertical slide edge, and so on as the main body of the present apparatus is omitted.

FIG. 9E is a schematic perspective view of one embodiment of the present forming apparatus to show the positional relationship among the stationary blade, the vertical slide edge, and so on, where the main body part is omitted. Here, for ease of understanding, part of the stationary blade and part of the vertical slide edge are omitted. The tongue parts 41 of the stationary blade contact the laying surface 103 approximately vertically. A vertical slide edge 81 is provided to traverse the plurality of tongue parts at positions between the base end (the top end of the tongue parts 41 in the figure) and the tip end (the portion contacting the laying surface 103 in the lower end of the tongue parts 41 in the figure) of the tongue parts 41 of this stationary blade in a manner that a side edge portion of the vertical slide edge 81 that is parallel to or inclined at a predetermined angle to the laying surface 103 is in contact with the surface of the right side of the two tongue parts 41 in the figure. In this embodiment, the forming apparatus is configured to be moved to the left in the figure so as to produce the mortar that is formed in a ridge-and-groove shape on the right side over the laying surface 103. Consequently, the direction of movement is left, and a storage space 70 is provided on the movement direction side. This storage space 70 is surrounded and defined by the laying surface 103, the surfaces of the tongue parts 41 of the stationary blade and the vertical slide edge 81 on the movement direction side, and the first pressing surface 163, the second pressing surface 166 and the third pressing surface 167 facing the laying surface 103. The first pressing surface 163 is at approximately right angles to the above tongue parts 41, the second pressing surface 166 is inclined with respect to the tongue parts 41, and the third pressing surface 167 is provided at approximately right angles to the tongue parts 41. In this way, the pressing surfaces may include surfaces that, when arranged in this way, are inclined with respect to the above tongue parts 41 such that the distance from the laying surface 103 increases toward the movement direction. The angle of inclination with respect to the tongue parts 41 may be selected as appropriate from the range of 0 to 90 degrees, such as, for example, 0 to 30 degrees, 30 to 45 degrees, 45 to 60 degrees, and 60 to 90 degrees.

The present apparatus 11 may comprise a stand 96, which, by contacting a horizontal virtual surface (for example, the surface of the subject slab 103 such as a concrete slab) by its tip end, allows the present apparatus 11 to stand by itself.

The present apparatus 11 may also comprise a bubble tube level 13, which is a horizontal level confirming means, for checking whether the bottom defining line is horizontal or not.

Also, in the step of forming the ridge-and-groove shape with the above-mentioned present apparatus 11, the step of applying adhesive mortar 101 onto the surface of the subject slab 103 with a predetermined width K as shown in FIG. 16 corresponds to the providing step of providing the adhesive mortar 101, which is the adhesive substance according to the present method, onto the surface of the subject slab 103, which is the laying surface. Then, the step of forming the ridge-and-groove shape 104 of the adhesive mortar 101 corresponding to the shape of slits 49 as the adhesive mortar 101 passes through the slits 49 of the present apparatus 11 is conducted during the step of moving the present apparatus 11 in the arrow J direction, which is approximately vertical with respect to the predetermined width K. The step of forming the ridge-and-groove shape 104 corresponds to the shape forming step of forming the ridge-and-groove shape corresponding to the gaps 42 between the plurality of tongue parts 41 or the slits 49 and the upper end defined by the bottom defining line or the lower edge 82*b*. In this manner, the present apparatus 11 may be moved over the surface of the subject slab 103 where the adhesive mortar 101 is arranged, as at least one of the contact means, including the tongue parts 41 and the height adjusting parts 91*a*, 91*b*, is kept in contact with the surface of the subject slab 103, which is the laying surface. In this way, the providing step and the shape forming step constitute the forming method of forming the adhesive mortar 101 in a ridge-and-groove shape.

Also, in this shape forming method, the shape forming step may be performed while the additional contact portion (the height adjusting parts 91*a*, 91*b*) is in a protrusion condition.

Figure 29:
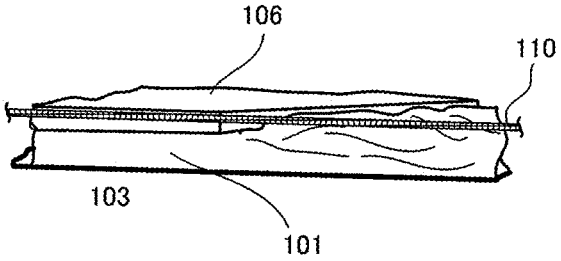
FIG. 29 is a diagram illustrating a method of determining a height position of a tile surface in laying tiles with mortar.
Figure 30:
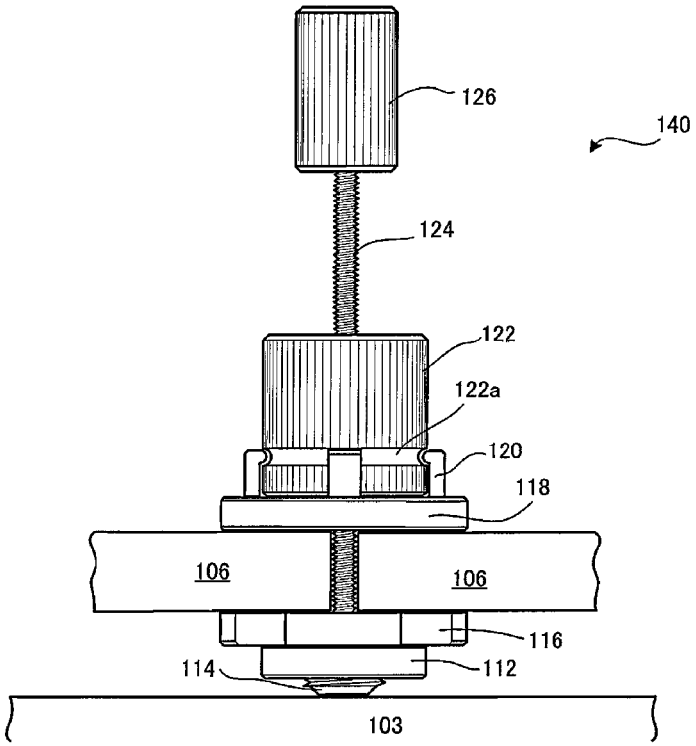
FIG. 30 is a side view showing a surface height adjustment apparatus of an embodiment of the present invention.

FIG. 29 illustrates a method of aligning the upper surface of tiles to be laid to a certain height in a pressure bonding method. Mortar 101 is applied onto the surface of the laying surface 103 of a concrete slab and so on, and tiles 106 having a thickness of 10 to 30 mm are laid. Although there are tiles 106 that are already laid on the left side, as to the height of the upper surface thereof, the tiles 106 are pressed and bonded with reference to a thread 110 that is adhered to the side end part thereof. That is to say, in the laid mortar method using mortar with a low water content (in Japanese, "basa bari" method), pressure bonding is not necessary because the method can be conducted simply by placing tiles 106 in places where the laying surface is made flat. However, in the pressure bonding method, not only tiles 106 are placed on the mortar 101 that is applied thereto, but also, in order to make the adhesion strength stronger, the tiles 106 are pressed from the upper surface to come closer to the laying surface 103, until the upper surface of the tiles 106 reaches the height of the above thread 110. In this way, the tiles 106 that are laid and the laying surface 103 come sufficiently close to the mortar that is present therebetween, so that the coupling strength improves significantly. Therefore, with respect to the mortar 101 formed in a ridge-and-groove shape with the present apparatus 11, in this pressing step, the mortar 101 existing in the upper part of the ridge-and-groove shape is effectively filled in the valley part of the ridge-and-groove shape, and, as a result, it is preferable that the mortar is fully filled such that so-called air pockets may not be produced between the tiles 106 and the laying surface 103. The details will be described later. Note that, when there is too much excess mortar, the mortar 101 cannot be compressed to shrink the volume, no matter how much the tiles 106 are pressed from the upper surface. Therefore, it is considered preferable to remove the tile 106 and take out the excess mortar, then re-make the desired mortar shape, and lay the tile 106 again. That is, it is preferable to set the target amount of mortar less than 100% of the packing factor (for example, 95% or less in the packing factor, and it is further preferable to set the target amount 90% or less in the packing factor if quantitative measurement is difficult) although it is preferable to fill between the tiles 106 and the laying surface 103 fully with mortar since huge damages may be caused in the case of too much excess amount of mortar. In addition, in consideration of a local packing factor, a partial packing factor, corresponding to the packing factor at each point, may also be kept constant.

Figure 26A:
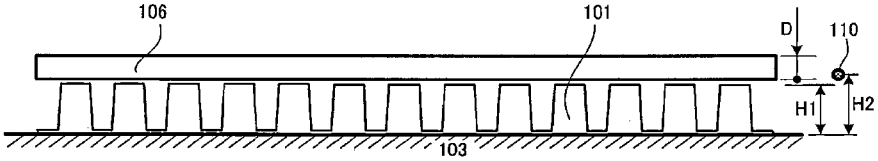
FIG. 26A is a diagram illustrating a relationship between a ridge-and-groove shape of the adhesive mortar and a tile pressed and bonded thereon.
Figure 26B:
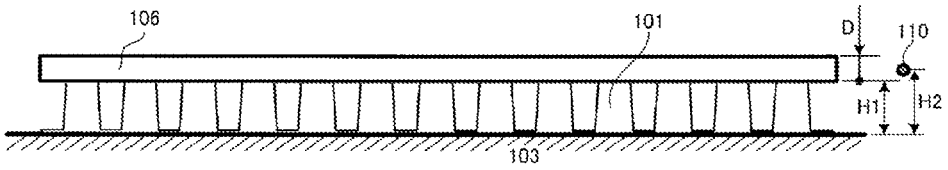
FIG. 26B is a diagram illustrating a relationship between a ridge-and-groove shape of the adhesive mortar and a tile pressed and bonded thereon.
Figure 26C:
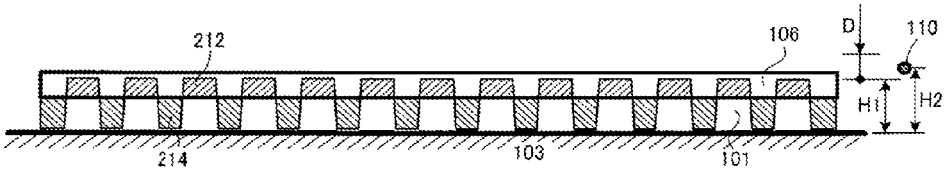
FIG. 26C is a diagram illustrating a packing factor of the mortar with respect to the ridge-and-groove shape of the adhesive mortar and the tile pressed and bonded thereon.
Figure 26D:
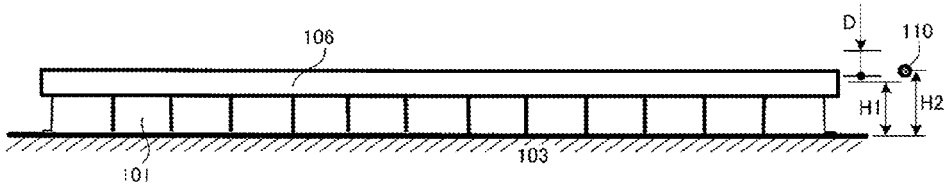
FIG. 26D is a diagram illustrating a packing factor of the mortar with respect to the ridge-and-groove shape of the adhesive mortar and the tile pressed and bonded thereon.

FIGS. 26A to 26D are diagrams illustrating the method of forming adhesive substance using the present apparatus 11 and the concept of the packing factor of the adhesive substance. In a similar manner as in FIG. 19D, FIG. 26A shows the relationship between the ridge-and-groove shapes of adhesive mortar 101 formed with the present apparatus 11 on the laying surface 103, and the tiles 106 pressed and adhered thereon. The ridge-and-groove shapes are formed uniformly on the laying surface, which is flat at a height of H1. The thickness D of the tiles 106 is approximately ¼ of H1 here. Then, the thread 110 defining the upper surface of the tiles 106 is stretched at the height H2 from the laying surface 103. The tiles 106 are placed on the upper surface of the ridge-and-groove shapes (FIG. 26B), and, furthermore, the tiles 106 are pressed to reach the position of the upper surface of the tiles 106 (FIG. 26C). In this figure, the portions indicated by the diagonal lines that go upward to the right represents the amount of mortar 101 that becomes excess by the press of the tiles 106, and the portions indicated by the diagonal lines that go downward to the right represents the volume of the space forming the valley parts that are located on both sides of each ridge-and-groove shape. That is to say, if, by pressing the tiles 106, the portions indicated by the diagonal lines that go upward to the right and the portions indicated by the diagonal lines that go downward to the right match completely, the packing factor becomes 100%, and this is considered the most preferable state in terms of the adhesion strength. However, as described above, when the above-described portions indicated by the diagonal lines that go upward to the right become predominant, the mortar becomes excess, and the tiles 106 are laid in a condition of being lifted up too much. On the other hand, even when the above-described portions indicated by the diagonal lines that go upward to the right are somewhat less, it is still considered that there is not much negative influence on the adhesion strength. Therefore, for example, when the packing factor is assumed to be approximately 98%, each ridge-and-groove shape receives the mortar of the above-described portions indicated by the diagonal lines that go upward to the right to cause pillars thicker and a pillar structure with thick pillars leaving gaps in a small amount so as to adhere the tiles 106 an the laying surface 103.

Figure 27A:
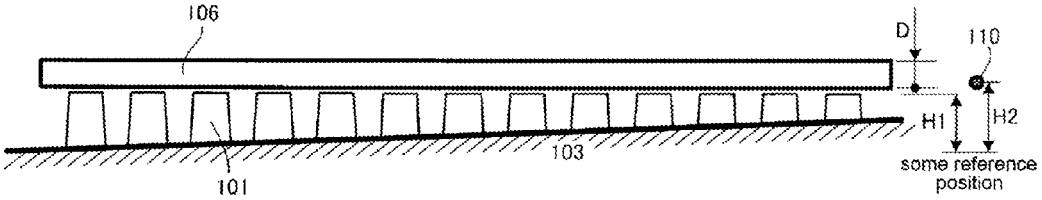
FIG. 27A is a diagram illustrating a relationship between a ridge-and-groove shape of the adhesive mortar and a tile pressed and bonded thereon in case the laying surface is an inclined surface.
Figure 27B:
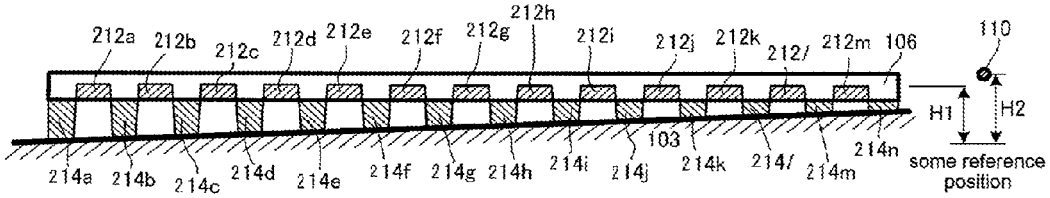
FIG. 27B is a diagram illustrating a packing factor of the mortar with respect to the ridge-and-groove shape of the adhesive mortar and the tile pressed and bonded thereon in case the laying surface is an inclined surface.
Figure 27C:
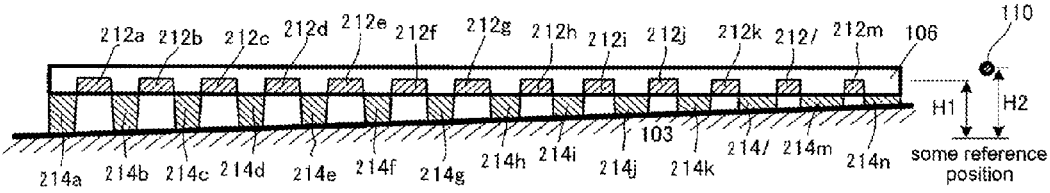
FIG. 27C is a diagram illustrating a packing factor of the mortar with respect to the ridge-and-groove shape of the adhesive mortar and the tile pressed and bonded thereon in case the laying surface is an inclined surface.

FIGS. 27A to 27C show the concept of the packing factor when the laying surface is an inclined surface. In the present apparatus 11, if the vertical slide edge 81 is inclined in accordance with the inclined surface of the laying surface 103, ridge-and-groove shapes, such as the ones shown in FIG. 27A, can be formed. In this case, since the laying surface 103 is inclined, a reference surface is at least virtually provided in another way and evaluation is made based on the height H1 of the ridge-and-groove shape and the height H2 of the tile therefrom. Similar to the case of FIG. 26C, when the tiles 106 are pressed into for a predetermined amount (FIG. 27B), the portions indicated by the diagonal lines that go upward to the right, namely 212*a*, 212*b*, 212*c*, 212*d*, 212*e*, 212*f*, 212*g*, 212*h*, 212*i*, 212*j*, 212*k*, 2121 and 212*m*, represent the amount of mortar 101 that becomes excess by the press of the tiles 106, and the portions indicated by the diagonal lines that go downward to the right, namely 214*a*, 214*b*, 214*c*, 214*d*, 214*e*, 214*f*, 214*g*, 214*h*, 214*i*, 214*j*, 214*k*, 2141, 214*m* and 214*n*, represent the amount of space to form the valley parts that are located on both sides of each ridge-and-groove shape. As obvious from this figure, the portions indicated by the diagonal lines that go upward to the right are nearly uniform from the left to the right, whereas the portions indicated by the diagonal lines that go downward to the right decrease gradually from the left to the right. Therefore, in the width direction of the tiles 106, there is an inclination of packing factor, and, especially on the right edge, there is a threat that the packing factor exceeds 100%. In such a case, it is anticipated that the tiles cannot be laid well, or the upper surface of the tiles does not become horizontal.

On the other hand, in FIG. 27C, mortar is formed such that the ridge-and-groove shape has thinner ridge portions toward the right side, and, even at the right end, the portions indicated by the diagonal lines that go upward to the right are not excess. This can be realized by using the present apparatus 11 using the stationary blade 40*a* and the lateral slide blade 60*a* such as the ones shown in FIG. 23C or 25C.

Figure 47:
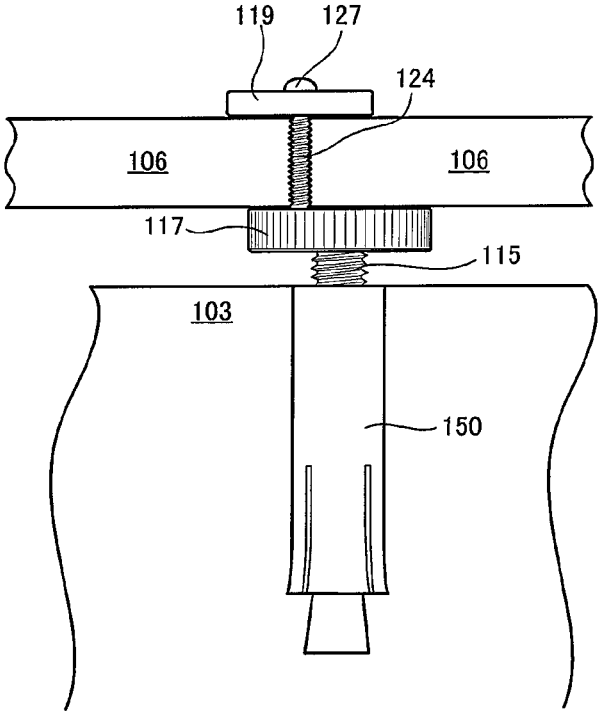
FIG. 47 is a side view showing a surface height adjustment apparatus of another embodiment of the present invention.
Figure 48:
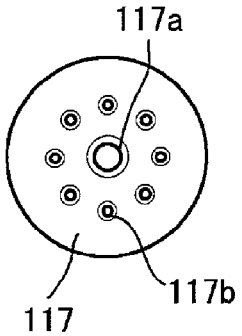
FIG. 48 is a top view showing a part used in a surface height adjustment apparatus of another embodiment of the present invention.
Figure 49:
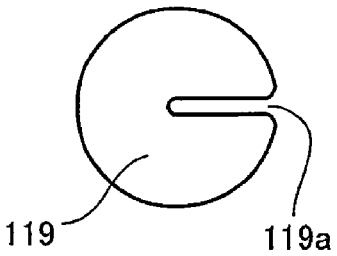
FIG. 49 is a top view showing a part used in a surface height adjustment apparatus of another embodiment of the present invention.

FIGS. 30 to 57 illustrate the method of laying tiles 106 using the present apparatus 11 and the apparatus to be used for the laying. FIGS. 30, and 31A-D are a side view and a schematic cross section view of apparatus to enable the height adjustment of tiles to be used in this laying method. FIGS. 32 to 42 are diagrams illustrating the laying method with the apparatus, and FIGS. 43 to 46 are diagrams showing another embodiment of the apparatus and parts that can be used therefor. FIGS. 47 to 49 show still yet another embodiment of the apparatus, and FIGS. 50 to 57 are diagrams illustrating another laying method with this apparatus.

FIGS. 30 and 31A-D are a side view and a schematic cross section view of a surface height adjustment apparatus 140, which is one of the embodiments of the present invention.

The surface height adjustment apparatus 140 is configured to comprise:

a base bottom part 112 provided with a hole having female threads inscribed on an inner surface thereof in approximately a center thereof such that the hole may engage with a protrusion member 114 having male thread inscribed on an outer surface thereof, which may be brought into contact with the laying surface 103 such as concrete slab; a lower part receiving member 116 being supported by and positioned above the base bottom part 112; an upper part pressing member 118 to clamp side end parts of the tiles 106; a pressing nut 122 being arranged above the upper part pressing member 118 as an example of an engaging movable body; a main screw 124, which is an example of a distance adjustment member that can engage with the lower part receiving member 116, pass through approximately the center of the upper part pressing member 118, and engage with the inscribed threads of the through hole being opened at approximately the center of the pressing nut 122, wherein the distance between the lower part receiving member 116 and the upper part pressing member 118 may be changed by the rotation of this pressing nut 122 such that the tile 106 can be clamped and squeezed therebetween; and a finger grip 126 that is attached to the main screw 124 so as to rotate and pick it up. In the upper part pressing member 118, anti-fall hooks 120, which are engagement members being capable of preventing the pressing nut 122 from falling off, are sticking out and respective tip end parts thereof engage rotatably with a groove 122*a* provided in an lower outer surface of the pressing nut 122 where a knurling is formed such that the pressing nut 122 may be difficult to be removed therefrom in the axial direction.

The base bottom part 112 may be formed in a shape like a nut, perform functions thereof, and have a shape appearing nearly circular or polygonal (especially a regular polygon) in the top view. The protrusion member 114 engages with the base bottom part 112 in the male threaded portion of the outer surface in a similar manner as with the bolt, and is rotated to set a reference height of the tiles from the laying surface 103. The base bottom part 112 further comprises a female screw to engage with the main screw 124 and have an opening in the upper surface, and the tiles 106 are squeezed between the lower part receiving member 116 and the upper part pressing member 118 as the pressing nut 122 is rotated to clamp the tiles 106 such that the positions of both tiles from the laying surface 103 are set. The lower part receiving member 116 being received on the upper surface of the base bottom part 112 has an upper surface thereof as a tile receiving surface and is typically formed in a disk shape having a through hole in the center such that the main screw 124 can rotate inside with clearance like the washer. Since the tile receiving surface receives lower surfaces near the side end parts of two adjacent tiles on respective two half-circular parts or quarter-circular parts excluding a portion corresponding to the joint spacing between the two tiles from the center so as to set the reference height, it is preferable to assemble the lower part receiving member 116, the base bottom part 112, and the protrusion member 114 such that the tile receiving surface becomes horizontal or substantially horizontal. Here, although the lower part receiving member 116 and the base bottom part 112 are described as separate members, as shown in the schematic cross section view of FIG. 31A, these may be formed as one piece as well. Also, it is not necessary for the base bottom part 112 to have female threads to engage with the main screw 124, but the protrusion member 114 may have the female threads instead. Since the protrusion member 114 and the base bottom part 112 have a certain relationship, and further the positional relationship between the base bottom part 112 and the lower part receiving member 116 is fixed, clamping and squeezing can be effectively made by the main screw 124.

Figure 31A:
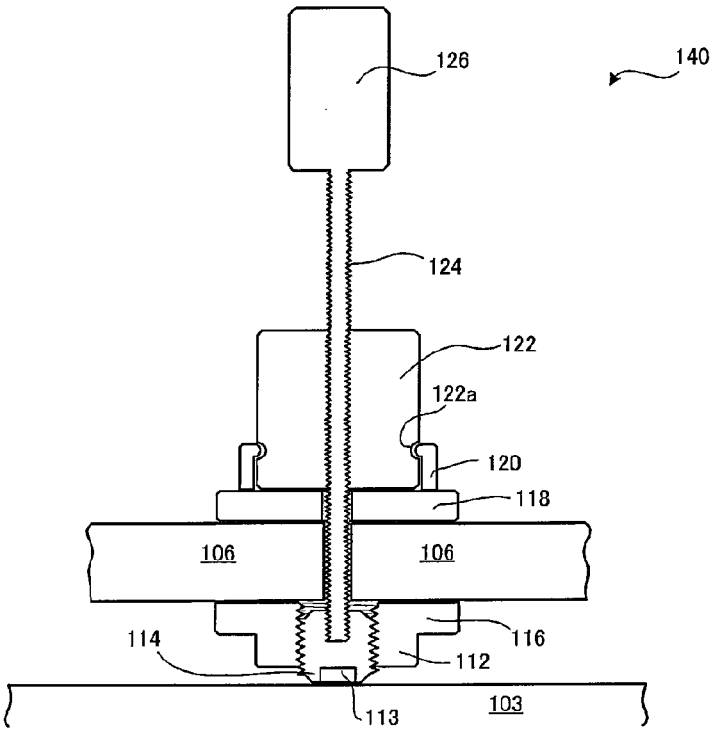
FIG. 31A is a schematic section view showing a surface height adjustment apparatus of an embodiment of the present invention.
Figure 31B:
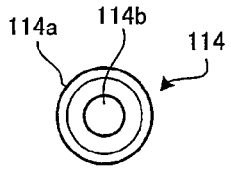
FIG. 31B is a top view showing a protrusion member of the surface height adjustment apparatus of FIG. 31A.
Figure 31C:
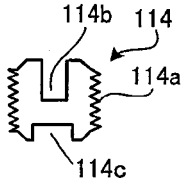
FIG. 31C is a cross section view showing a protrusion member of the surface height adjustment apparatus of FIG. 31A.
Figure 31D:
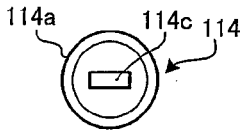
FIG. 31D is a bottom view showing a protrusion member of the surface height adjustment apparatus of FIG. 31A.

FIGS. 31B-31D show a top view, a schematic cross section view, and a bottom view of the protrusion member 114. The protrusion member 11 has male threads 114*a* in an outer surface, has a hole 114*b* that is opened in a circular shape in approximately the center of the upper surface but that does not penetrate, and has a groove part 114*c* like a key groove in the bottom surface. The hole 114*b* is a cylindrical hole having a diameter that is just big enough to be tapped by means of the threaded part of the main screw 124, and may be, for example, slightly smaller than the outer diameter of the main screw 124. Also, this protrusion member 114 may be made of a soft material (for example, soft metal or organic material such as synthetic resin). Therefore, when the main screw 124 is screwed in, the main screw 124 engages with the hole 114*b* having female threads inscribed on an inner surface thereof and having a predetermined depth which can reliably support the engagement with the main screw, and secured at the end. After that, if the main screw is turned in the pushing direction, the protrusion member 114 rotates, and the protrusion member 114 protrudes downward from the base bottom part 112. Then, the lower surface of the protrusion member 114 contacts the laying surface 103 directly or via the mortar that is applied therebetween, and it becomes difficult to push beyond that point. At this time, part of the mortar enters the groove part 114*c* of the lower surface, and solidifies over time with the surrounding mortar, so that it is possible to secure this protrusion member 114 to the laying surface 103.

Figure 46:
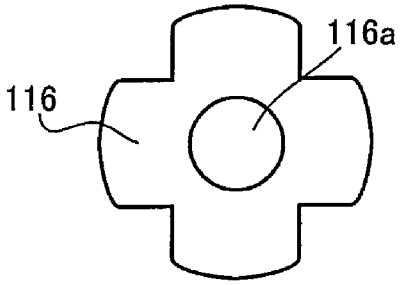
FIG. 46 is a top view showing yet another part used in a surface height adjustment apparatus of another embodiment of the present invention.

FIG. 46 shows another embodiment of the lower part receiving member 116, which is formed in the cross shape with thick arms and has a through hole 116*a* in the center. As will be described later, in many cases, this surface height adjustment apparatus 140 is used in a portion of corner where four corner parts are get together such that the thick cross shape such as this embodiment may provide sufficient support and cut wastes so as to contribute to the efficient use of the resources. This is the part that cannot be taken out after the tile laying, as will be described later, and therefore this point is important. As long as the function as a tile receiving surface is provided in this way, it is not necessary to have the circular shape.

Figure 44A:
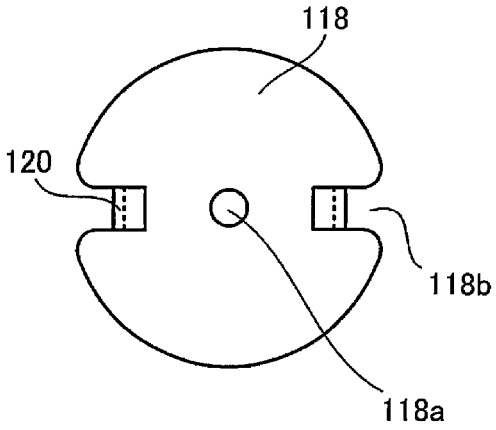
FIG. 44A is a top view showing a part used in a surface height adjustment apparatus of another embodiment of the present invention.
Figure 44B:
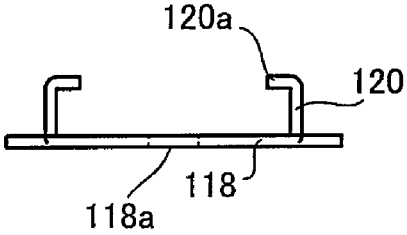
FIG. 44B is a front view showing the part used in the surface height adjustment apparatus of the other embodiment of the present invention.
Figure 44C:
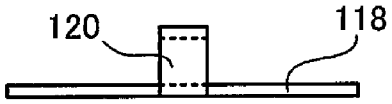
FIG. 44C is a side view showing the part used in the surface height adjustment apparatus of the other embodiment of the present invention.
Figure 45:
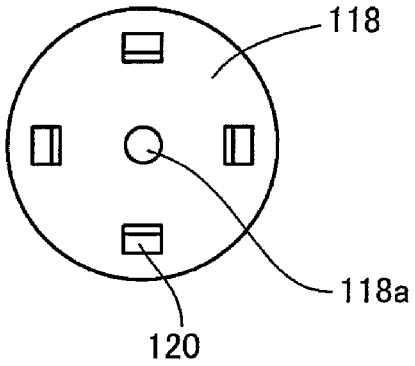
FIG. 45 is a top view showing another part used in a surface height adjustment apparatus of another embodiment of the present invention.

The upper part pressing member 118 is primarily configured with a disk shape having in the center a through hole 118*a* which the main screw 124 can penetrate (FIG. 45), and four anti-fall hooks 120 are built in the circumferential direction (at 90-degree intervals). Another embodiment of the upper part pressing member 118 is shown in FIGS. 44A to 44C. Here, two anti-fall hooks 120 are built in the circumferential direction, at regular intervals (at 180-degree intervals). The pressing nut 122 has a female screw to engage with the main screw 124 and the female screw has openings in the center or approximately the center on both upper and lower surfaces. When the pressing nut 122 is turned clockwise, the pressing nut 122 pushes the upper part pressing member 118 downward to perform what may be referred to as clamping, and, when the pressing nut 122 is turned counterclockwise, the pressing nut 122 loosens the clamping, and allows the upper part pressing member 118 to be pushed up by the elastic rebound force of the object that is clamped between the pressing nut 122 and the lower part receiving member 116. The finger grip 126 having knurling formed on the outer surface is provided at the top end of the main screw 124, and is used to release the engagement between the main screw 124 and at least one of the protrusion member 114, the base bottom part 112, and the lower part receiving member 116.

Figure 32:
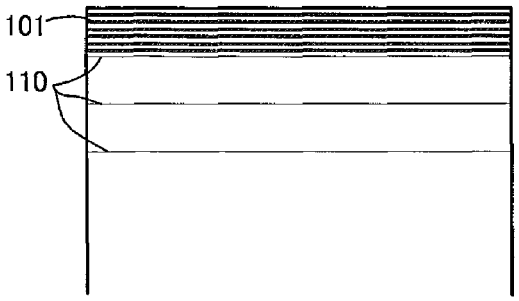
FIG. 32 is a diagram illustrating a method of laying tiles in an embodiment of the present invention.

With reference to FIGS. 32 to 42, the method of using these surface height adjustment apparatuses 140 in the actual practice will be described. FIG. 32 shows the step in the preparatory stage for laying tiles 106 on the laying surface 103 such as a concrete slab and so on. A thread 110 to serve as the reference for the height of the upper surface of the tiles in the tile laying is provided in the laying surface according to the tile width (the length in the up-and-down direction in the figure). The laying surface 103 is preferably horizontal, and even though the laying surface 103 is inclined, it is still possible to apply the tile laying method of the present invention by using the present apparatus 11 of the present invention as described above. This is because the amount of mortar between the laying surface 103 and the tiles 106 can be changed depending on places where the method applies. This is the point significantly different from the basa-bari method (laid mortar method), in which the actual laying surface (the surface on which tiles are actually placed and laid) is formed so as to be equivalent to the underlying surface. Also, with the conventional pressure bonding method, the adjustment of the amount of mortar relies heavily on the artisan's intuition and skills from experiences, and therefore the tile laying lacks in the stable quality.

Next, the amount of mortar to match the height of the upper surface of the tiles that is set in advance is determined, and one of the present apparatuses 11 is selected in order to use a blade thereof having the same length as the width of the tiles to be used this time or a slightly shorter length than the width (that is, the length Ln1 in the longitudinal direction L). In addition to the length in the longitudinal direction L, the shape of the tongue parts 41 (and 61 if necessary) and so on (height, width, and a shape like an isosceles trapezoid) are determined, and an adequate stationary blade 40*a* (and the lateral slide blade 60*a* if necessary) is selected. Next, depending on the inclination of the laying surface, the inclination of the vertical slide edge 81 and the distance from the tip end of the tongue parts 41 (and 61 if necessary) are determined. The amount of the mortar having been calculated in advance is supplied to be as flat as possible in the traveling direction of the lateral movement of the present apparatus 11 as shown in FIG. 28, and the present apparatus 11 is moved laterally along the laying surface 103 so as to obtain a predetermined ridge-and-groove shape by the one-time movement. The forming of the ridge-and-groove shape of mortar 101 is executed with respect to all in the first lateral line (hereinafter referred to as first row) where the thread 110 is stretched. Here, it is noted that the tile may be laid one by one as the ridge-and-groove shape of mortar is applied and formed for the one tile (the same will apply hereinafter).

Figure 33:
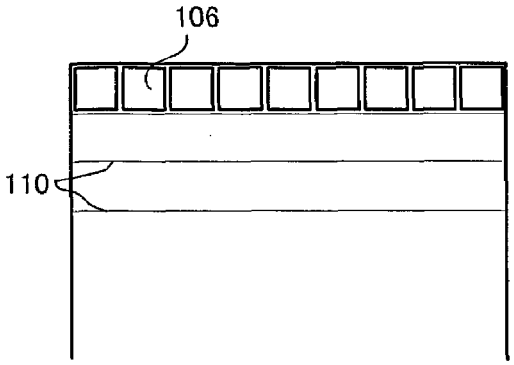
FIG. 33 is a diagram illustrating a method of laying tiles in an embodiment of the present invention.
Figure 34:
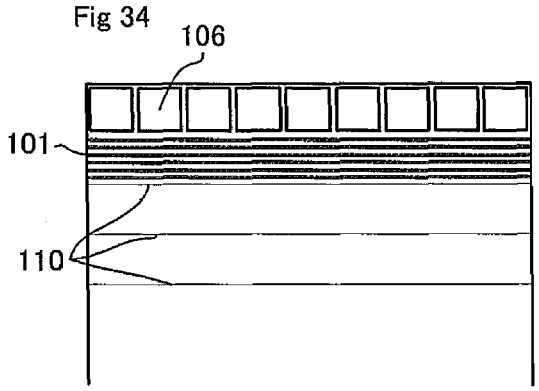
FIG. 34 is a diagram illustrating a method of laying tiles in an embodiment of the present invention.
Figure 35:
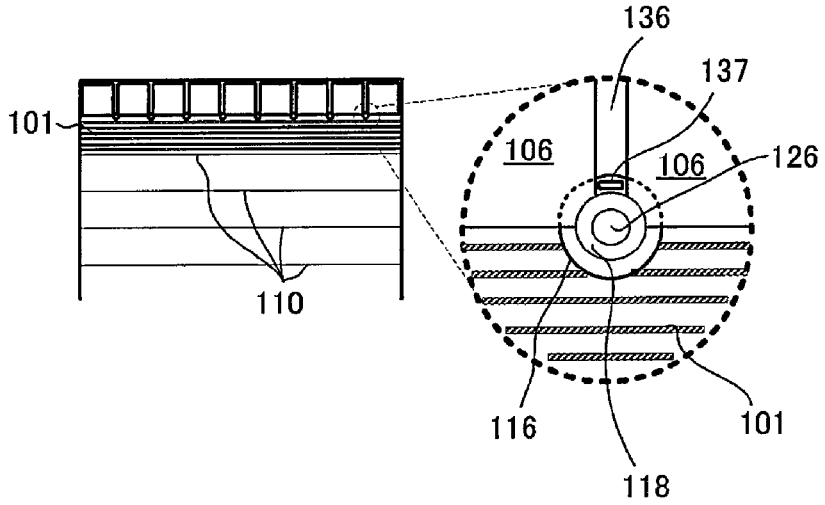
FIG. 35 is a diagram illustrating a method of laying tiles in an embodiment of the present invention.
Figure 36A:
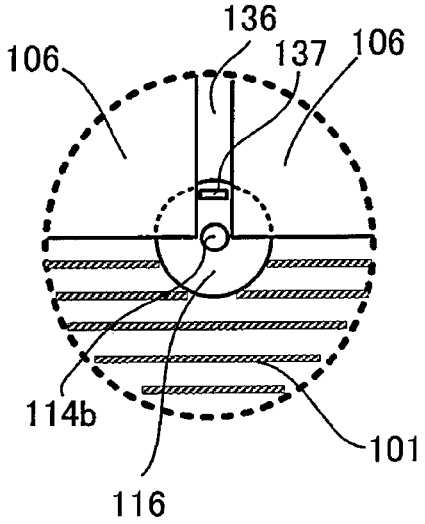
FIG. 36A is a diagram from the top showing a state of using a surface height adjustment apparatus in a step of laying tiles according to an embodiment of the present invention.
Figure 36B:
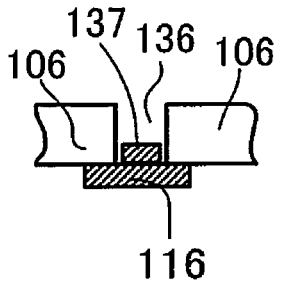
FIG. 36B is a side cross section view showing a state of using a surface height adjustment apparatus in a step of laying tiles according to an embodiment of the present invention.
Figure 37:
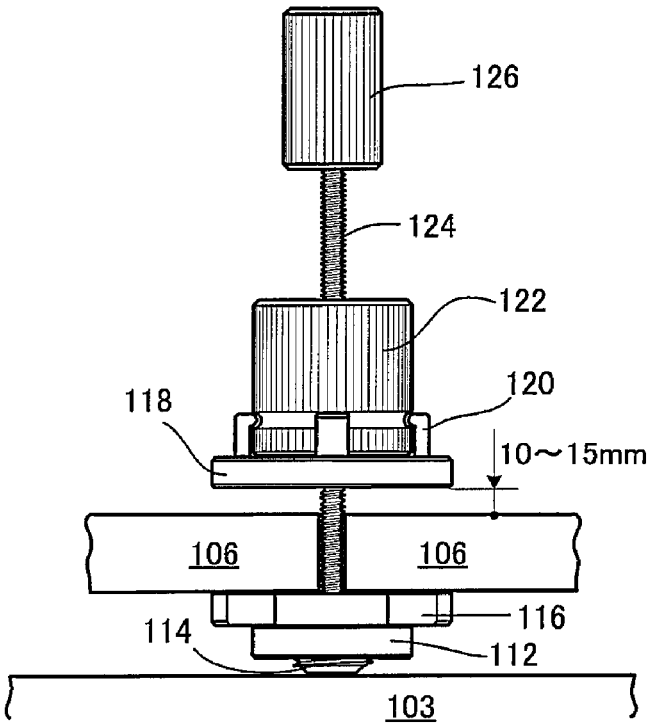
FIG. 37 is a side view showing a state of using a surface height adjustment apparatus of an embodiment of the present invention.
Figure 38:
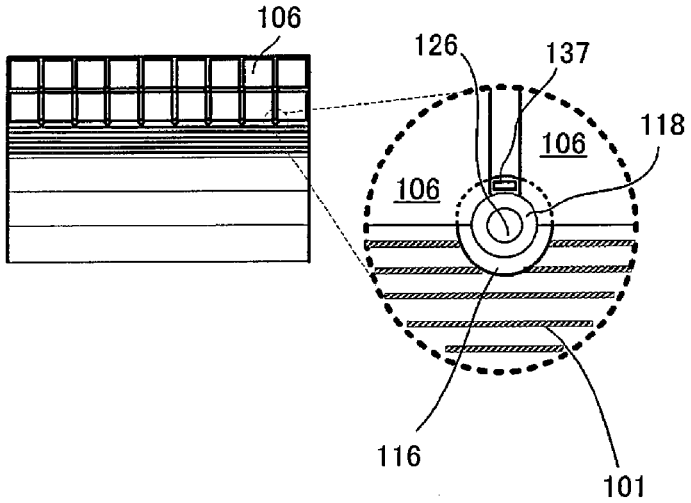
FIG. 38 is a diagram illustrating a method of laying tiles according to an embodiment of the present invention.
Figure 39:
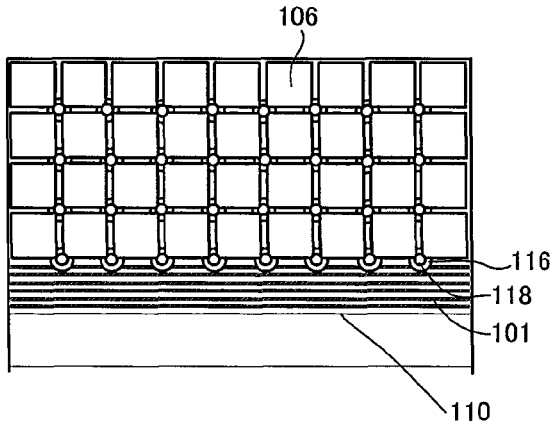
FIG. 39 is a diagram illustrating the method of laying the tiles according to the embodiment of the present invention.

FIG. 33 shows the step of placing the tiles 106 on the upper surface of the mortar 101 formed in the ridge-and-groove shape (hereinafter referred to as the "actual laying surface") and pushing the tiles 106 downward according to the height of the thread 110 so as to achieve a predetermined height of the tiles. Next, similar to FIG. 32, forming of the ridge-and-groove shape of mortar 101 is performed with respect to the second row in the laying surface 103 (FIG. 34). Then, with respect to the tiles 106 having been laid in FIG. 33, the surface height adjustment apparatus 140 in the state as shown in FIG. 37 is arranged in the joint space as a border of neighboring tiles located in a place facing so-called the second row in the laying surface (that is, in a portion of corners of the respective neighboring tiles 106. That is, the protrusion member 114 is placed in a predetermined position and the distance between the lower part receiving member 116 and the upper part pressing member 118 is widened for about 10 to 15 mm in addition to the equivalent distance to the thickness of the tiles 106, then the surface height adjustment apparatus 140 is inserted in the above portion of the corners as the distance is being kept as stated above (FIGS. 35 and 37). At this time, the main screw 124 enters the hole 114*b* of the protrusion member 114 midway, but does not necessarily have to be inserted completely. In the vicinity of the side end parts facing the second row of the tiles 106, since the mortar 101 is not stuffed to the full, this surface height adjustment apparatus 140 can be inserted relatively with ease. As shown in FIG. 35, the lower part receiving member 116 having a larger tile receiving surface cannot be seen in the top view except portions being located in the joint space and facing the second row when it is arranged under the tiles. Also, the upper part pressing member 118 having the pressing surface slightly smaller than the tile receiving surface can be seen in the top view entirely except for the pressing nut 122 portion. A top view and a cross-section shape of this configuration is partially enlarged and shown in FIGS. 36A and 36B. An adjacent border area 136, which is a border area between neighboring tiles, may include the joint space that is used in laying the tiles. The rectangular projection portion 137 existing in this adjacent border area 136 can perform a stop-turning function with the adjacent tiles. Then, the main screw 124 is turned so that the tip end of the main screw 124 is thrust to the depth of the hole 114*b*. At this time, the inner surface is inscribed. Then, if there is little resistance in the engagement of the protrusion member 114 and the base bottom part, the protrusion member 114 rotates with the thrust of the main screw and goes downward. The main screw 124 is secured upon reaching the depth of the hole 114*b*, so that, even if there is some resistance in the engagement with the base bottom part 112, the protrusion member 114 rotates and moves downward. When the laying surface 103 is contacted, the protrusion member 114 cannot be moved downward anymore because of the weight of the tiles, and then the position of the lower surface of the tiles 106 is determined. The main screw 124 and the outer surface threads of the protrusion member 114 are preferably threaded in the same direction.

Figure 40:
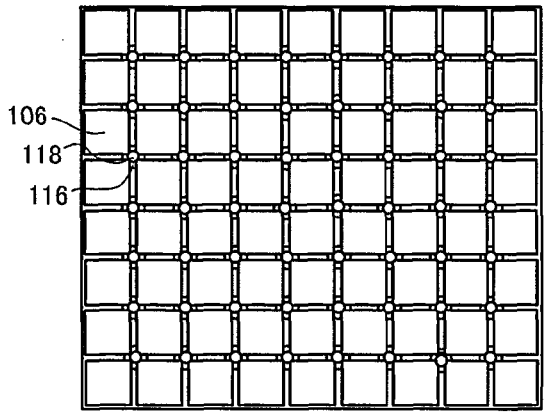
FIG. 40 is a diagram illustrating the method of laying the tiles according to the embodiment of the present invention.

Next, in a similar manner as described for the first row, the tiles 106 are placed on the actual laying surface of the mortar 101 and pressed. In this step, since the lower part receiving member 116 of the surface height adjustment apparatus 140 having been inserted under the tiles 106 of the first row maintains a predetermined height from the laying surface 103, the tiles 106 can be supported by this member and prevented from being pushed down more than necessary. Then, the pressing nut 122 of each surface height adjustment apparatus 140 inserted between the first row and the second row is tightened, and, in addition to the height adjustment by pressing the tiles 106 from the above upon the above-described lower part receiving member 116, the height adjustment of the upper surface of the tiles 106 by the pressing surface of the upper part pressing member 118. Subsequently, the surface height adjustment apparatus 140 is similarly inserted in the portion of corners facing the third row. In this way, the tiles 106 are laid for each row one after another (FIG. 39), and the tiles are continued to be laid finally up to the last row. Then, each pressing nut 122 of each surface height adjustment apparatus 140 is tightened, and the height adjustment is finished (FIG. 40).

Figure 41:
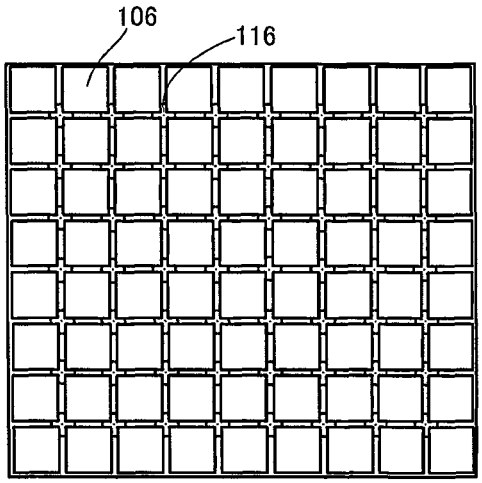
FIG. 41 is a diagram illustrating the method of laying the tiles according to the embodiment of the present invention.
Figure 42:
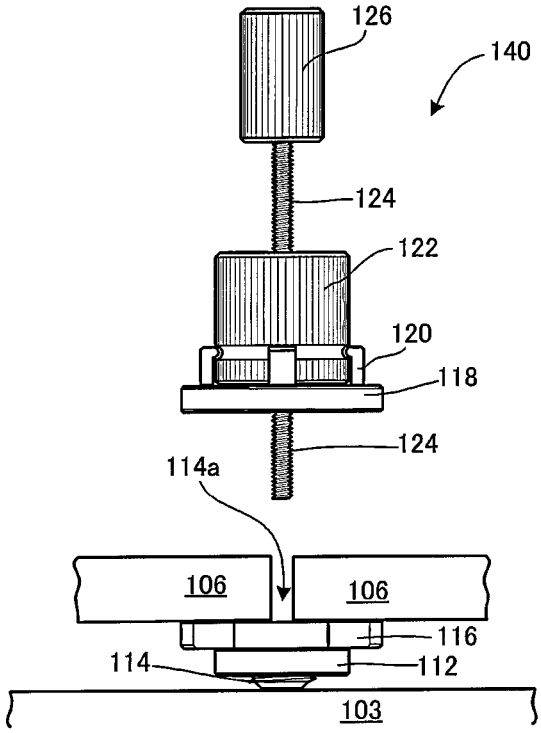
FIG. 42 is a side view showing another state of using a surface height adjustment apparatus of an embodiment of the present invention.

After a predetermined period of time passes, when the adhesion is almost complete, the members such as upper part pressing member 118 and so on remaining on the upper surface of the tiles 106 are collected. That is, the pressing nut 122 is first loosened if necessary, the finger grip 126 is turned, and the main screw 124 is pulled out of the hole 114*b* of the protrusion member 114 as shown in FIG. 42. In this step, the tip end portion of the main screw 124 has inscribed threads, the main screw 124 is relatively easily removed by turning the main screw 124 in the direction of pulling-out. In this way, the engagement of the base bottom part 112 of the main screw and the lower part receiving member 116 is released, and the members such as the main screw 124, the upper part pressing member 118 and so on having been left on the upper surface of the tiles 106 are removed. In this way, only the lower part receiving member 116 and so on having been left in the portion of corners exist under the tiles 106 as shown in FIG. 41 and no other remaining material are left such that the tile laying can be completed in a very clean state. Although the adjacent border areas are shown bigger than they really are in the figures having been referred to for ease of understanding, one of skill in the art should readily understand that this size can be changed depending on the surface height adjustment apparatus to be used. Also, the width of the joint space corresponding to the adjacent border area in the case that tiles of a 600 mm width are laid is, for example, approximately 5 to 15 mm such that the decorative aspect may not be damaged. Furthermore, the joint space can be filled with additional mortar and the lower part receiving member 116 and so on cannot be seen completely in this case such that the decorative aspect should not be damaged at all.

Figure 43:
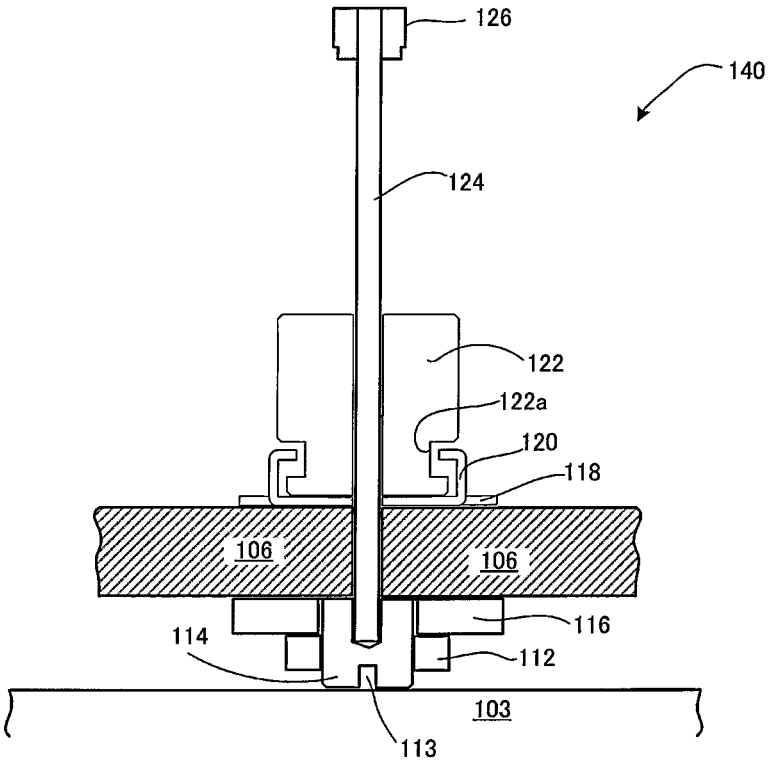
FIG. 43 is a schematic cross section view showing a surface height adjustment apparatus of another embodiment of the present invention.

FIG. 43 shows another embodiment of the surface height adjustment apparatus 140 of the present invention. since the same configuration as the above-described surface height adjustment apparatus is basically provided, duplicated explanations will be omitted. The protrusion member 114 to contact the laying surface 103 has a key groove 113 in the bottom for rotating the member and the groove can be used for securing the member as described above.

As described above, the main screw 124, which serves as a distance adjustment member and has a role to couple with the base bottom part 112 and so on of the surface height adjustment apparatus 140 of the present invention, penetrates approximately the center of the lower part receiving member 116 since the surface height adjustment apparatus 140 is primarily arranged in the portion of corners of the tiles 106. That is, in order to adjust the heights of tiles 106 mutually with each other, it is preferable to have contact with at least two or more tiles 106 and the portion of corners is the most efficient place where four tiles 106 face with each other. Therefore, it is the most efficient way to have the distance adjustment member such as this penetrate in the center or approximately in the center.

In FIGS. 47 to 57, a tile laying method and a surface height adjustment apparatus of another embodiment will be further explained. FIG. 47 is a side view including a schematic cross section view of a surface height adjustment apparatus 140, which is different from the one described above. With this surface height adjustment apparatus 140, an anchor 150 is provided on the laying surface 103 and the heights of the tiles 106 are adjusted with reference to this anchor 150.

While the anchor 150 may be a commercially-supplied anchor, it is preferable to have an engaging part of the upper surface exposed in a state in which the engaging part is flush with the laying surface or almost in such a state. This anchor 150 has an approximately circular cylindrical shape, the upper surface that is exposed outside has a hole of a female screw having female threads inscribed on the inner surface thereof, and a bolt 115, which is an example of the protrusion member, is engaged with the female screw. Alternatively, an integrated bolt, a head of which serves as a lower part receiving member, may be used as well. This bolt 115 engages with the tapped hole 117*a* in the center of the disk 117 having an outer surface processed with knurling and serving as a lower part receiving member. In the disk 117, a plurality of tapped holes 117*b* which have respective centers thereof in a circumferential direction of a circle having a circumference drawn a predetermined distance apart from the center of the disk (FIG. 48). With these tapped holes, fastening screws 124, which are examples of distance adjustment members, are engaged. This fastening screw 124 can clamp and fasten the tiles 106 between the upper surface of the disk 117 and the lower surface of a disk with a slit 119, which is an example of the upper part pressing member. While the disk with the slit 119 has a slit 119*a* that is so opened as to allow the fastening screw 124 to be inserted therein, a head 127 of the fastening screw is bigger than the width of the slit 119*a* and cannot pass therethrough such that the tiles 106 can be clamped and fastened by turning the fastening screw in the same way as described above with the main screw (FIG. 49). With the surface height adjustment apparatus of this embodiment, height adjustment to arrange the tiles 106 at a predetermined height (or distance) with reference to the anchor 150, that is, the laying surface 103, can be performed. Also, by providing many supports, it is possible to get the laid tiles stabilized and therefore, in particular, tiles of a large area or a large size as well as tiles of a relatively thin thickness can be laid with ease.

Figure 57:
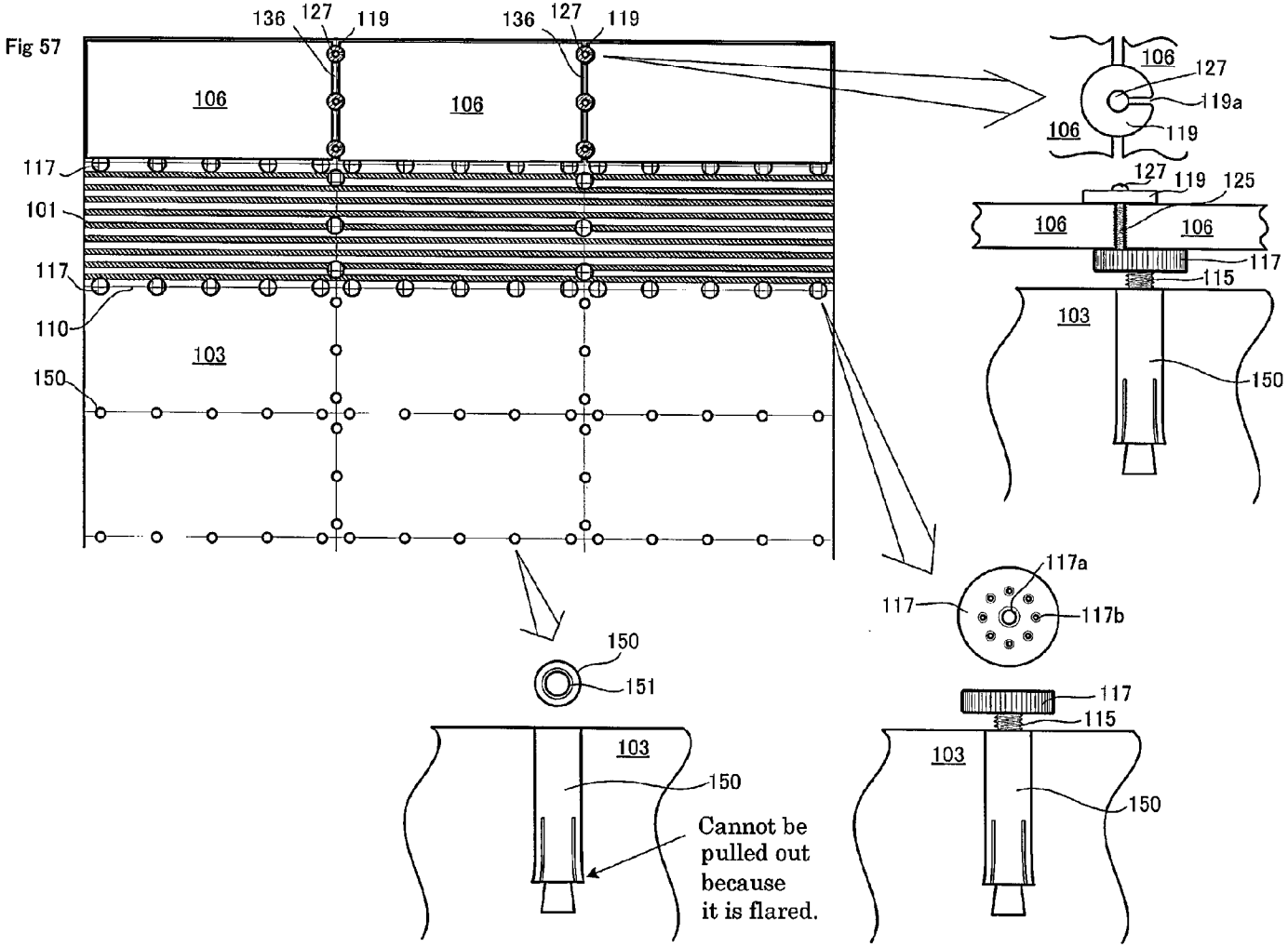
FIG. 57 is a diagram illustrating the method of laying the tiles according to the other embodiment of the present invention.

The anchor 150 is driven into the laying surface 103 such as a concrete slab, a lower skirt part thereof is opened as illustrated in FIG. 57, and the anchor 150 cannot be pulled out of the laying surface 103. Then, a bolt 115 engages with this anchor 150, the bolt 115 engages with a female screw of the disk 117, and the position of the disk 117 from the laying surface is secured. Furthermore, the disk with the slit 119 and the disk 117 can clamp and fasten an edge portion of a side end part of one or more tiles 106 therebetween. In this step, the position of the anchor 150 does not change and the position of the tiles 106 having been clamped is finally secured from the laying surface.

Figure 50:
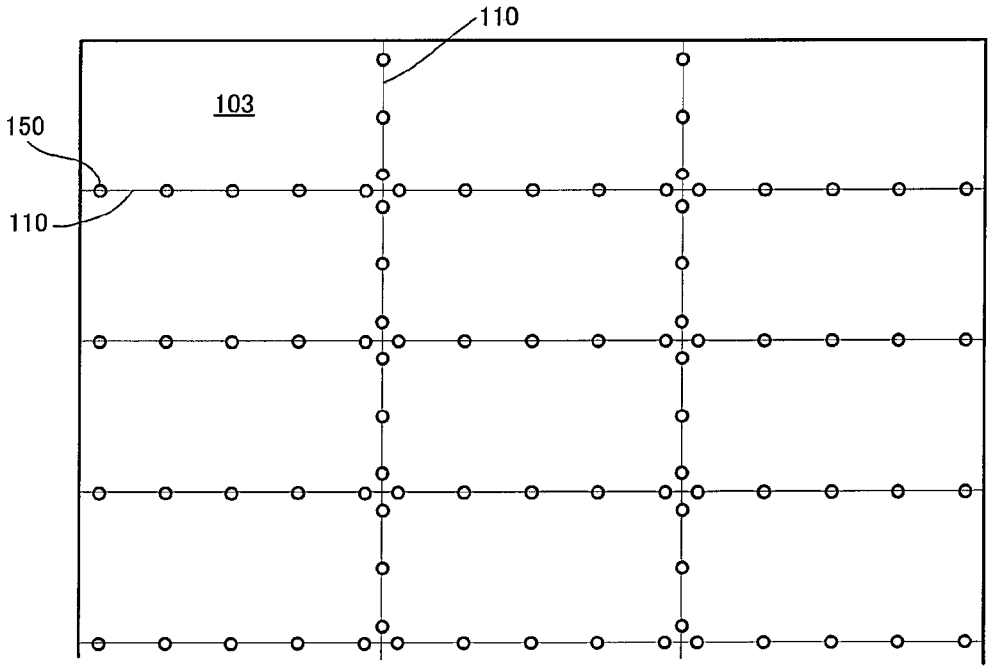
FIG. 50 is a diagram illustrating a method of laying tiles according to another embodiment of the present invention.

Hereinafter, concrete steps will be explained with reference to the drawings. FIG. 50 shows the step of preparing for laying tiles 106 onto the laying surface 103 such as a concrete slab and so on. A thread 110 to serve as the reference for the height of the upper surface of the tiles is provided above the laying surface in the tile laying with widths (lengths in the up-and-down direction in the figure) of the tiles aligned each other. Along with the above step, locations in which the tiles 106 are laid are clearly indicated on the laying surface 103 and a plurality of anchors 150 are driven into the laying surface 103 in areas to become borders, each of which is located between a tile 106 and a tile 106. The number of anchors can be determined in accordance with the width of the tile to be laid. For example, as larger tiles are laid, it is preferable to drive more anchors. This is because the amount of deflection may be increased by the own weight of the tile itself as the width changes significantly even though the thickness of the tile does not change much. The inclination of the laying surface is managed in the same way as described above. The positions where the anchors 150 are driven into are in locations on the laying surface corresponding to the adjacent border areas, each of which is between a tile 106 and a tile 106 and it is preferable to nail the anchors 150 at as equal an interval as possible in order to reduce the deflection.

Next, the amount of mortar to achieve the height of the upper surface of the tile having been set in advance is determined and the present apparatus 11 is selected such that a blade having the same width (that is, length L in the longitudinal direction) or a slightly narrower width may be used. With respect to the selection, steps are explained in the same way as having been described in reference to FIG. 32 and so on such that explanation thereof will be omitted hereinafter.

Figure 51:
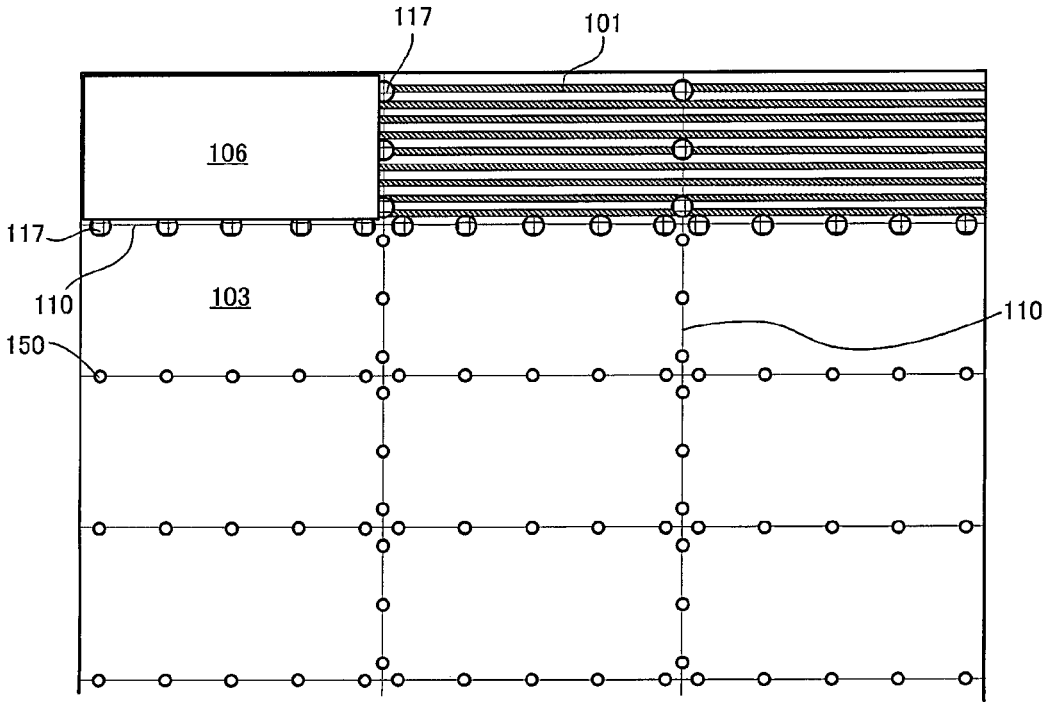
FIG. 51 is a diagram illustrating the method of laying the tiles according to the other embodiment of the present invention.
Figure 52:
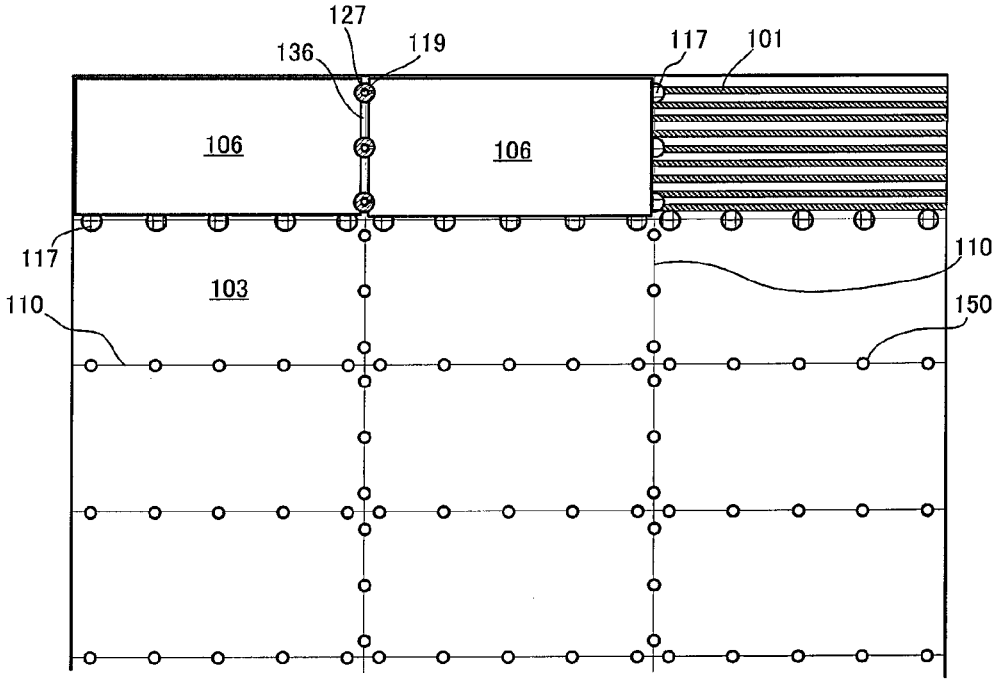
FIG. 52 is a diagram illustrating the method of laying the tiles according to the other embodiment of the present invention.
Figure 53:
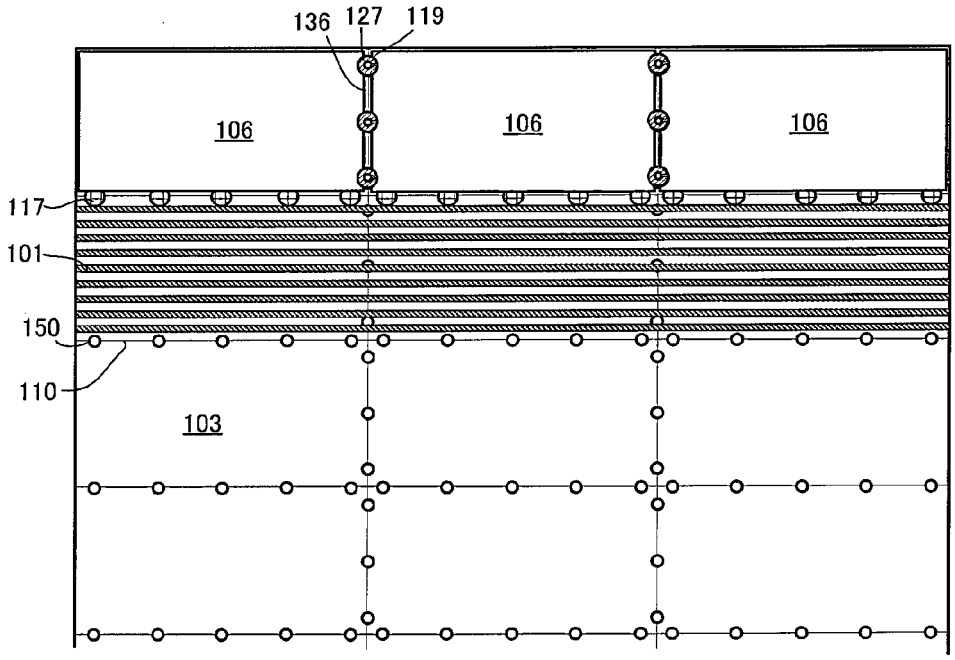
FIG. 53 is a diagram illustrating the method of laying the tiles according to the other embodiment of the present invention.
Figure 54:
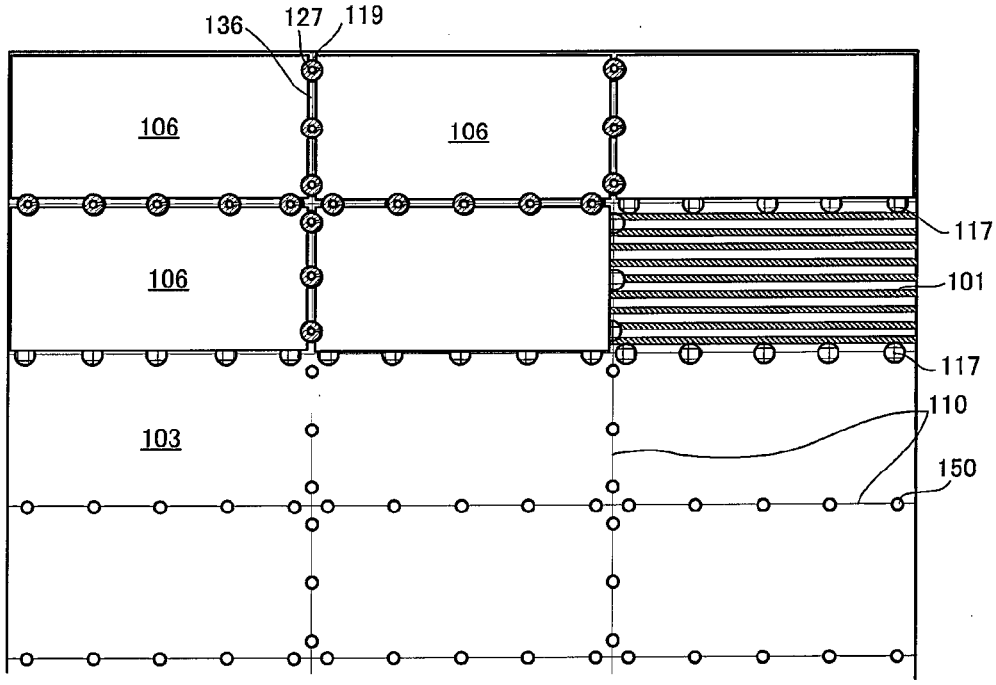
FIG. 54 is a diagram illustrating the method of laying the tiles according to the other embodiment of the present invention.
Figure 55:
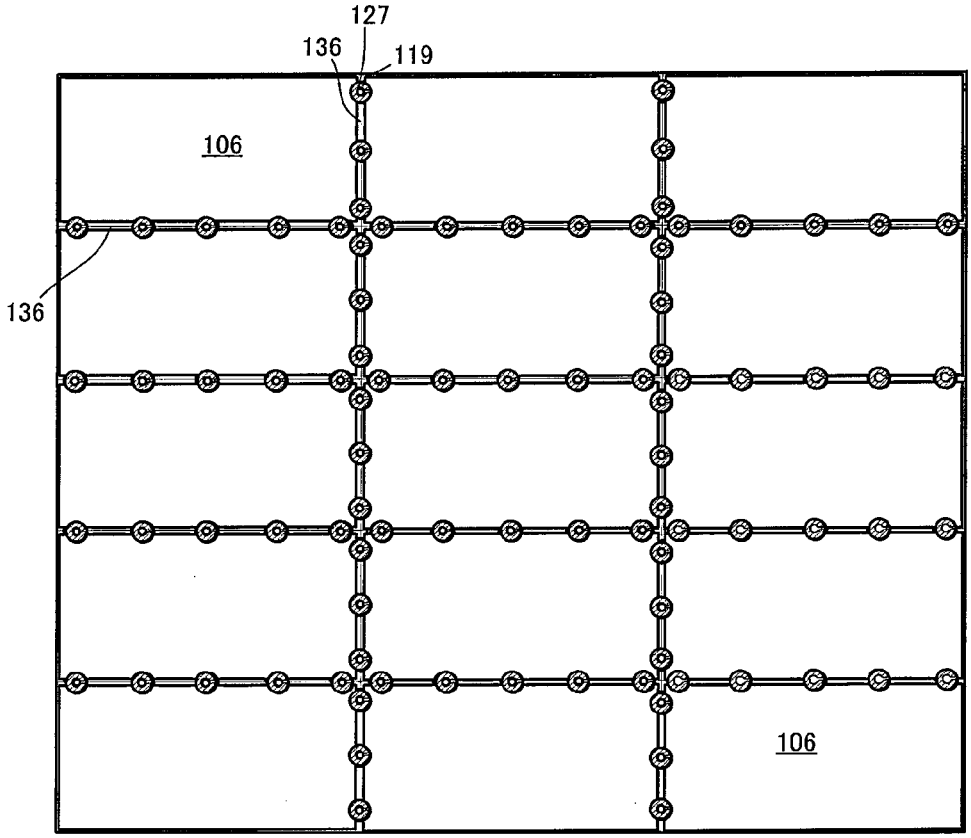
FIG. 55 is a diagram illustrating the method of laying the tiles according to the other embodiment of the present invention.

Next, in a similar manner as described in the explanation of FIG. 32, mortar is applied to form a predetermined ridge-and-groove shape. In this step, it is preferable not to apply much mortar in the anchor portion and a vicinity thereof so as not to undermine usefulness of the anchor 150. Next, the disk 117 is secured with the bolt 115 engaged and secured with the anchor 150. The tiles 106 are placed on the top of the disk, and pressed to be arranged at a predetermined height (FIG. 51). After, next to the first tile 106, another tile 106 is placed and pressed such that the tiles 106 are arranged at a predetermined height, the tiles 106 having been clamped between the upper surface of the disk 117 and the bottom surface of the disk with the slit 119 are squeezed with the fastening screw 124. Here, although the disk 117 has a plurality of tapped holes 117*a*, a suitable tapped hole 117*a* may be selected appropriately such that the suitable tapped hole 117*a* is located in an adjacent border areas 136 of a gap to serve as the joint space between the tiles. For example, as shown in FIG. 47, even when the adjacent border area 136 is not located in the center of the disk 117 in FIG. 48 (for example, when the tapped holes 117*b*1 and 117*b*5 do not appear from the adjacent border area 136), other tapped holes (for example, tapped hole 117*b*2 or 117*b*4, which is slightly shifted to the left, or the tapped hole 117*b*3, which is shifted further to the left) may be utilized as well.

Figure 56:
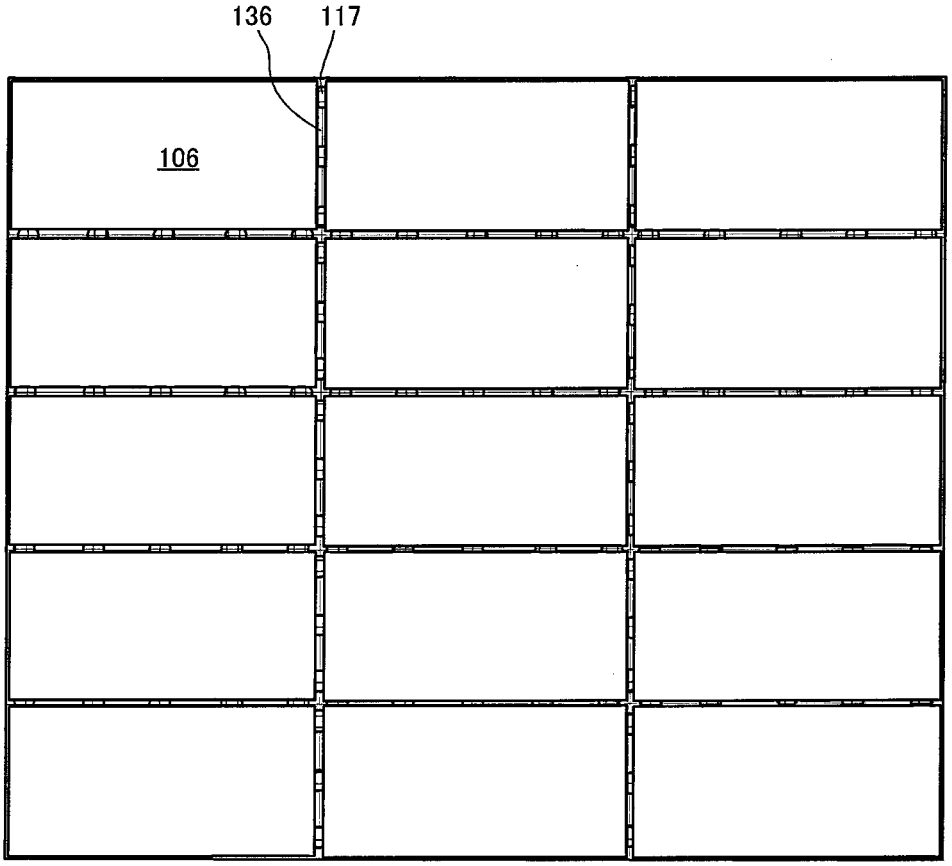
FIG. 56 is a diagram illustrating the method of laying the tiles according to the other embodiment of the present invention.

Furthermore, by repeating laying the tiles 106, arranging the disk with the slit 119 in a position, squeezing the tiles with the fastening screw 124, applying the mortar 101, and attaching the anchor 150 to the disk 117, the tiles are laid on the laying surface one after another (see FIGS. 52 to 55 and 57). Finally, after a predetermined period of time passes, all the members staying above the upper surface of the tiles 106 having been laid, such as the disk with the slit 119 and the fastening screw 124, are removed such that a floor surface made of the laid tiles having an excellent decorative feature may be completed (FIG. 56).

With such a tile laying method, the tile laying having an extremely flat surface and a strong adhesivity can be achieved since the distance from the laying surface can be made constant by means of the anchors 150.

The following can also be provided as embodiments.

A forming apparatus to form an adhesive substance into a ridge-and-groove shape on a laying surface after the apparatus is moved along the laying surface on which tiles are laid can be provided. The forming apparatus comprises: a stationary blade (40*a*) configured to have a plurality of tongue parts, neighboring two of which are connected to the stationary blade (40*a*) on their respective base end sides with a predetermined space, wherein the plurality of tongue parts being flat and extending in an extending direction from their base ends to their tip ends, respectively, are arranged at regular intervals of the predetermined gap and aligned in a flat plane linearly along a direction substantially perpendicular to the extending direction so as to be connected to the stationary blade (40*a*) as positions of their respective tip ends are aligned with each other and the direction from the base end to the tip end of each of the plurality of tongue parts is arranged in the same manner; a main body (21) securing the stationary blade and having a grasping portion with such a workspace that the grasping portion may be grasped, the grasping portion being positioned on an opposite side from the tip end of the tongue part along the extending direction in the stationary blade, wherein the main body (21) extends in a direction substantially perpendicular to the extending direction; a pressing surface provided to the main body, wherein the pressing surface receives mortar entering from a movement direction with the laying surface and a surface being provided on the movement direction side of the tongue part and facing the laying surface on the movement direction side of the tongue part of the stationary blade; and an end part to define an upper surface of the ridge-and-groove shape formed, the end part being provided at the predetermined interval between neighboring two tongue parts, respectively, wherein the ridge-and-groove shape to be formed is designed to make a volume packing factor of the mortar between the tile and the laying surface become from 50% to 100% in consideration of a settling distance of the tile laid on the laying surface.

Here, if the above-described apparatus is moved along the laying surface, the adhesive substance is provided and formed in a ridge-and-groove shape on the surface after the apparatus moves along the surface. The above-described tongue parts may be a plate of an isosceles trapezoid shape which extends in an extending direction from the base end to the tip end (also corresponding to a pushing direction of the apparatus). The base end is secured and the tip end extends toward the laying surface. The predetermined intervals may be the same or may be different. The above-described working space may be a space that is sufficiently large enough to allow an operator to grip the grasping portion and is preferably configured to allow the operator to push the stationary blade easily on the laying surface. It can also be said that the upper surface of the ridge-and-groove shape is formed and cut out by the above-mentioned end part as if a single-point cutting tool of the cutting tool cut material from the cutting surface. The above volume packing factor may refer to the proportion of the volume occupied by the adhesive substance having been applied thereto to the space having a height to match the height at which the tile is secured after being laid, and being located between the lower surface of the tile and the corresponding laying surface. That is to say, assuming that the volume of the above space is Vt and the volume of the adhesive substance is Vm, the packing factor $R=Vm/Vt\times100$ (percent) can be represented. Here, this volume of the adhesive substance is one as of when the adhesive substance is applied and, since the volume decreases only slightly even when the adhesion is completed, this volume can be used as the volume of the adhesive substance, practically speaking, as of when the adhesion is completed. The packing factor is preferably 50% or higher, and preferably 60% or higher. When the packing factor becomes 70% or higher, not only the adhesion strength increases, but also it becomes easy to protect the tile from local pushing force applied onto the tile upper surface. When the packing factor is 80% or higher, the effects improve even more. On the other hand, the packing factor is preferably less than 100% and it is also possible to make the packing factor 95% or less when it is difficult to control the amount of application. Also, it is more preferable that the packing factor has less variation partially or locally. It is also possible to use an apparatus having tongue parts of varying widths, means to utilize lateral slide blades and so on, for execution for inclined surfaces.

The above forming apparatus may be provided, in which the end part comprises an end part on the tip end side of a linking member to connect every two neighboring tongue parts on the respective base end sides.

The above forming apparatus may be provided, in which the end part comprises a side edge portion of a belt member extending laterally as the belt member traverses the plurality of tongue parts.

The above forming apparatus may be provided, in which the belt member is slidably provided such that the side edge portion of the belt member crosses each of the plurality of tongue parts laterally at a position between a base end and a tip end thereof.

The above forming apparatus may be provided, in which the pressing surface has an inclined surface in which the distance with the laying surface increases toward the direction of movement.

The above forming apparatus may be provided, in which the stationary blade is shorter than one side of the tile to be laid by a margin of operation.

Further, the above forming apparatus further comprising a lateral slide blade (60*a*), which can slide over the stationary blade (40*a*) as being overlaid thereon and has a plurality of slide blade tongue parts (61) respectively corresponding to the plurality of tongue parts (41) of the stationary blade (40*a*) and being arranged with slide blade gaps therebetween respectively corresponding to the gaps, wherein the slide tongue parts (61) of the lateral slide blade (60*a*) can cover at least part of the gaps (42) by the slide, can be provided.

The above forming apparatus can be provided, in which each of the gaps (42) has the same size, and the slide blade gaps (62) of the lateral slide blade (60*a*) are variable gaps that become narrower toward both ends.

It is also possible to provide the above forming apparatus, in which the maximum distance between the pressing surface and the laying surface is at least twice as long as the length of the at least one tongue part in the extending direction when at least one tongue part of the stationary blade (40*a*) contacts the laying surface in a substantially vertical manner.

The linking member to connect two adjacent tongue parts on the respective base end sides may be the main body. Also, the linking member may be part of the stationary blade as well. The above belt member may include a vertical slide edge. Also, the side edge portion may be the lower end of the vertical slide edge (the lower end may also be referred to as the "side end" of the belt shape).

The above pressing surface may include a surface that has an unchangeable distance from the laying surface as it goes in the movement direction. It is preferable that this distance is greater than the height of the tongue part (the distance between the base end and the tip end). Furthermore, the maximum value of this distance may preferably be 1.5 or more times as great as the height of the tongue part. Depending on conditions, twice or greater may be preferable. Considering the increase of the size of the apparatus, the maximum value of the distance may preferably be less than ten times as great as the height of the tongue part.

The size (length) of the stationary blade may preferably be the same as or slightly shorter than that of one side of the tiles (for example, one of the shorter sides). For example, the stationary blade may preferably be shorter to some extent taking into account a shaking range of the operator's handwork. For such a working clearance, 5 mm or greater, 10 mm or greater, 15 mm or greater, or 20 mm or greater may be selected as appropriate. However, if the size (length) of the stationary blade is too short, forming cannot be performed by a single operation such that it may preferably not be too short. For example, 100 mm or less is preferable, but selection can be made as appropriate.

There may be provided a surface height adjustment apparatus to be used when laying tiles on a laying surface, and the surface height adjustment apparatus comprises a base bottom part (112) to define a reference height from the laying surface, a protrusion member (114) capable of engaging with the base bottom part and protruding from the base bottom part, a lower part receiving member (116) to be held at a predetermined height by the base bottom part, an upper part pressing member (118) capable of clamping side end parts of the tiles between the upper part pressing member and the lower part receiving member, a distance adjustment member (124) capable of being secured by engaging with the protrusion member and changing the distance between the lower part receiving member and the upper part pressing member when having a constant relationship with the lower part receiving member through the base bottom part, and an engaging movable body (122) capable of engaging with the distance adjustment member so as to shorten the distance between the lower part receiving member and the upper part pressing member.

The surface height adjustment apparatus characterized in that the protrusion member has male threads inscribed on an outer surface thereof and that the base bottom part has female threads inscribed on an inner surface thereof to engage with the male threads may be provided.

The surface height adjustment apparatus characterized in that the protrusion member has a hole of a predetermined depth approximately in the center from the top view and that the tip end of the distance adjustment member enters the hole of the protrusion member so as to inscribe the inner surface of the hole to make male threads thereon to engage with the member may be provided.

The surface height adjustment apparatus characterized in that the distance adjustment member has male threads inscribed on an outer surface thereof so as to engage with the engaging movable body and that the engaging movable body has female threads inscribed on an inner surface thereof to engage with the male threads of the outer surface of the distance adjustment member so as to engage with the male threads such that the upper part pressing member can be adjustably moved closer to or more distant from the lower part receiving member, may be provided.

Further, the surface height adjustment apparatus further comprising an anchor member driven into the laying surface may be provided wherein the anchor member has a connecting part capable of connecting the base bottom part such that the reference height from the laying surface can be defined.

The surface height adjustment apparatus characterized in that the lower part receiving member comprises an adjustment connecting part to be connected with the distance adjustment member approximately in the center from the top view and in a vicinity thereof may be provided.

The surface height adjustment apparatus characterized in that the lower part receiving member comprises an adjustment connecting part to be connected with the distance adjustment member in a place other than approximately the center from the top view or a vicinity thereof may be provided.

A method of laying tiles on a laying surface using any one of the above forming apparatuses may be provided. The method of laying the tiles comprises the steps of: measuring inclination of the laying surface, determining a position of upper surfaces of the tiles to be laid, estimating an amount of adhesive substance to be used based on a result obtained in the steps of measuring and the determining, applying the estimated amount of adhesive substance by spreading the adhesive substance over an approximately same area as or a slightly smaller area than that of a tile to be laid on the laying surface, adjusting a weir member of the forming apparatus in accordance with the inclination of the laying surface and adjusting the width adjusting member in accordance with the inclination of the laying surface, forming the adhesive substance in a ridge-and-groove shape with the forming apparatus, placing the tile over the adhesive substance formed in the ridge-and-groove shape, and pushing down the tile from a top of the tile to the height determined in the step of determining.

Also, the present apparatus may generally comprises: a main body, a plurality of tongue parts, a weir member, and a width adjusting member. The present apparatus may also comprise tongue forming means, grasping means, and contact means in general.

The tongue forming means comprises: the plurality of tongue parts with gaps formed between adjacent two of them and the tongue securing portion securing the base ends of the plurality of tongue parts. The bottom defining line is a virtual line segment existing in the tongue existence plane of a virtual plane. The direction of the protrusion is one of the two directions in the tongue existence plane and perpendicular to the bottom defining line. Every one of the plurality of tongue parts extends from a base end existing on a bottom defining line to a tip end as a free end protruding toward a protrusion direction as the tip end protruding toward the protrusion direction is a free end and the base end is secured to the tongue securing portion along the bottom defining line. The tongue securing portion secures each base end of each tongue part along the bottom defining line as respective base ends of the plurality of tongue parts are fixed to the edge portion of the tongue securing portion along the bottom defining line such that gaps are formed between the plurality of tongue parts.

The grasping means is directly or indirectly fixed to the tongue securing portion of the tongue forming means and is grasped by the user of the present apparatus when the present apparatus is used.

The contact means is directly or indirectly fixed to the tongue forming means. The contact means has at least two contact points contacting at least two points on a virtual plane (a surface assumed as the laying surface on which tiles are laid) of a flat surface perpendicular to the protrusion direction. And legs of the perpendicular lines extending to the tongue existence plane of the at least two contact points (when the at least two contact points does not exist on the tongue existence plane) or the at least two contact points approximately exists on the contact defining line existing on the tongue existence plane (when the at least two contact points exists on the tongue existence plane). The contact defining line is a line segment (virtually) existing on the protrusion side from the bottom defining line in the tongue existence plane.

According to the present apparatus, the present apparatus is moved over the laying surface (virtual surface) on which the adhesive substance is laid (the present apparatus is moved relative to the adhesive substance applied onto the laying surface) as the contact means is kept in contact with the laying surface (virtual surface) such that the adhesive substance passes the gaps between the plurality of tongue parts. Thus, the upper surface of the adhesive substance applied on the laying surface can be formed in the ridge-and-groove shape corresponding to the respective gaps between the plurality of tongue parts. The upper surface (ridge portion) of the ridge-and-groove formed by the base ends of the plurality of tongue parts of the tongue forming means fixed directly or indirectly to the contact means contacting the laying surface (virtual surface) has a position (normally height) determined relatively to the laying surface (virtual surface) in accordance with the distance between the bottom defining line and the contact defining line. Therefore, according to the present apparatus, it can be prevented or alleviated that the upper surface of a ridge (ridge portion) of the adhesive substance waves or has an unintended inclination.

With respect to the present apparatus, the apparatus (hereinafter, referred to as "passing gap changing main device") may comprise passing gap changing means which changes orthographic projection of each of the passing gaps which is open in both directions perpendicular to the tongue existence plane, the passing gaps existing between the bottom defining line and the contact defining line.

The passing gaps exist between the bottom defining line and the contact defining line in the tongue existence plane. The passing gaps are open in both directions perpendicular to the tongue existence plane (the gaps are space through which straight lines perpendicular to the tongue existence plane pass (but none of the straight lines hit any part of the present apparatus)). A cross-section shape (a cross-section shape on the tongue existence plane) of the adhesive substance applied on the laying surface is formed in a shape (including the ridge-and-groove shape) corresponding to shapes of the passing gaps by making the adhesive substance passing through the passing gaps. Therefore, the cross-section shape (including the ridge-and-groove shape) of the adhesive substance applied on the laying surface is made suitable in accordance with conditions and so on for laying tiles by changing the orthographic projection of each of the passing gaps on the tongue existence plane with the passing gap changing means.

In the case of a passing gap changing main device, the passing gap changing means is constituted of what the contact means configures (hereinafter, referred to as "protrusion status changing main device") including an additional contact portion which can be in both conditions: a protrusion condition in which legs of the perpendicular lines extending to the tongue existence plane from the at least two contact points or the at least two contact points themselves exist beyond a tip end portion toward the protrusion direction; and a non-protrusion condition in which the legs of the perpendicular lines extending to the tongue existence plane from the at least two contact points or the at least two contact points themselves exist in a counter direction opposite to the protrusion direction from a minimum protrusion tip end portion which is located at one position of the most opposite direction among the positions where the tip end portions of the plurality of the tongue parts exist to the protrusion direction or at the same one position as that of the minimum protrusion tip end portion in the protrusion direction.

The additional contact portion can be in one of both conditions: a protrusion condition in which legs of the perpendicular lines extending to the tongue existence plane from the at least two contact points contacting at least two points in the virtual plane (a surface assumed as the laying surface on which tiles are laid) (when the at least two contact points does not exist on the tongue existence plane), or the at least two contact points themselves exist beyond any one of the tip end portions of the plurality of tongue parts toward the protrusion direction (when the at least two contact points exists on the tongue existence plane); and a non-protrusion condition in which the legs of the perpendicular lines extending to the tongue existence plane from the at least two contact points contacting at least two points in the virtual plane, or the at least two contact points themselves exist in a counter direction opposite to the protrusion direction from the minimum protrusion tip end portion which is located at the one position of the most opposite direction among the positions where the tip end portions of the plurality of the tongue parts exist to the protrusion direction or at the same one position as that of the minimum protrusion tip end portion in the protrusion direction. Therefore, the contact point of the additional contact portion contacts the virtual surface (laying surface) in the protrusion condition such that the tip ends of the plurality of tongue parts may separate from the virtual surface (laying surface) and that an adhesive substance layer may be formed on the virtual surface (laying surface) in a valley part of the ridge-and-groove shape (formed by tip ends of a plurality of tongue parts) formed on the upper surface of the adhesive substance. Further, in the non-protrusion condition of the additional contact portion, tip ends of the plurality of tongue parts contact the virtual surface (laying surface) and the adhesive substance on the virtual surface (laying surface) in the valley part (formed by tip ends of the plurality of tongue parts) of the ridge-and-groove shape formed on the upper surface of the adhesive substance can be removed.

That is, since the contact means including the additional contact portion constitutes the passing gap changing means as mentioned above, it is possible to choose existence or non-existence of the adhesive substance layer or thickness of the layer on the virtual surface (laying surface) in the valley part of the ridge-and-groove shape formed on the upper surface of the adhesive substance.

With respect to a protrusion status changing main device (hereinafter, referred to as "screw additional contact member main device"), the additional contact portion is constituted by including a male screw member having male thread inscribed on an inner surface thereof to engage with the male thread. One of the male screw member and female screw member is directly or indirectly fixed to the tongue forming means and the other of the male screw member and female screw member is turned in a normal direction or a reverse direction relatively to the one such that an end part existing on a protrusion direction side of the other is displaced to have a displacement component in the protrusion direction. The end part existing on the other protrusion direction side may be at least one of the at least two contact points.

With such a simple configuration (the present apparatus can be configured easily and inexpensively) constituted of the male screw member and the female screw member, which engage with each other, the one of the male screw member and female screw member is directly or indirectly fixed to the tongue forming means such that the other of the male screw member and female screw member is turned in the normal direction or the reverse direction relatively to the one such that the end part existing on the protrusion direction side of the other is displaced to have the displacement component in the protrusion direction. Thus, the end part existing on the protrusion side of the other being displaced to have the component in the protrusion direction.

With respect to a screw additional contact member main device, in the case where the end part on the protrusion direction side of the female screw member is located on the protrusion direction side of the male screw member, the screw additional contact member main device may comprise a closing valve with which the end part on the protrusion direction side of the female screw member is closes and the end part on the protrusion direction side of the male screw member is allowed to stick out of or retreat from the end part of the projection direction of the female screw member.

In the screw additional contact member main device, the end part existing on the protrusion direction of the other among the male screw member and the female screw member, which constitute the screw additional contact member main device, is displaced relative to the one (directly or indirectly attached to tongue forming means) such that the end part may have a component in the protrusion direction. Since the end part on the protrusion direction of the female screw member faces the adhesive substance and is stuck into the adhesive substance, some of the adhesive substance may enter inside the female screw member from the end part of on the protrusion direction side of the female screw member and adhere to the threaded female screw (it is likely to have trouble in removing hardened adhesive substance attached to the female screw). Therefore, when the end part on the protrusion direction side of the female screw member is located on the protrusion direction side from the end part on the protrusion direction side of the male screw member (that is, when the end part of the female screw member on the protrusion direction side is not plugged by the male screw member), the closing valve member may be comprised of such that the end part on the protrusion direction side of the female screw member is closed and the end part on the protrusion direction side of the male screw member is allowed to stick out of and retreat from the end part on the protrusion direction of the female screw member. Thus, the end part on the protrusion direction side of the male screw member can freely stick out and retreat from the end part on the protrusion direction side of the female screw member and the end part on the protrusion direction side of the female screw member can be closed by the closing valve when the end part on the protrusion direction side of the female screw member is not closed with the male screw member. Therefore, it is possible to prevent or alleviate to some degree that the adhesive substance enters into the interior of the female screw member from the end part on the protrusion direction of the female screw member.

With respect to the screw additional contact member main device, a finger grip portion may be provided to the male screw member projecting from the female screw member in an opposite direction to the protrusion direction such that force to turn the male screw member is applied thereto.

It may be performed in various ways to turn the other of the male screw member and the female screw member which constitute the screw additional contact member main device in the normal direction or the reverse direction relative to the one. For example, a method of turning it by an electric motor or the like with electric power, a method of turning it manually with a hand of the user of the present apparatus, and so on can be named. In particular, the present apparatus may be simply and inexpensively configured with the method of turning it manually by the hand of the user of the present apparatus since the electric motor or the like is not necessary. Further, in the case of turning it manually with the hand of the user of the present apparatus, it would become convenient to use the present apparatus since tools such as spanner, screw driver, wrench, and so on are not necessary if the finger grip is provided to apply force to turn the male screw member to part of the male screw member protruding toward the opposite direction to the protrusion direction from the female screw member.

With respect to the passing gap changing main device, the passing gap changing means (hereinafter, referred to as "gap width adjusting main device") may comprise gap width adjusting means to close the gap in a parallel direction to the bottom defining line, which is formed between the plurality of tongue parts.

If the gap width adjusting means included by the passing gap changing means can close (movement of the adhesive substance across the tongue existence plane is prohibited) gaps formed between the plurality of tongue parts in a parallel direction to the bottom defining line such that the gap width (size in a parallel direction to the bottom defining line) can be adjusted, it is possible to adjust the width of the ridge appearing in the cross section (cross-section shape on the tongue existence plane) of the adhesive substance applied on the laying surface.

With respect to a gap width adjusting main device, the gap width adjusting means (hereinafter, referred to as "width adjusting member main device") can close at least partially the gap formed between the plurality of tongue parts and may comprise a width adjusting member disposed slidably along the bottom defining line relative to the gap.

Since it is simply configured to dispose the width adjusting member slidably along the bottom defining line relative to the gap formed between the plurality of tongue parts as mentioned above, it is possible to adjust the width of gap (size in a parallel direction to the bottom defining line) formed between the plurality of tongue parts by closing (movement of the adhesive substance across the tongue existence plane is prohibited) at least partially in a parallel direction to the bottom defining line.

With respect to a width adjusting member main device, the width adjusting member may be a plate member having a notch formed in approximately the same shape of the gap formed between the plurality of tongue parts.

In this way, it is possible to adjust widths of a plurality of gaps (size in a parallel direction to the bottom defining line) formed between the plurality of tongue parts by sliding the plate member as the width adjusting member along the bottom defining line relatively with respect to the gaps formed between the plurality of tongue parts.

With respect to the passing gap changing main device, the passing gap changing means (hereinafter, referred to as "variable weir main device") may comprise variable weir means to close the gaps formed between the plurality of tongue parts with a variable width toward the protrusion direction from the bottom defining line.

If the height of the gap (size toward the protrusion direction) can be adjusted by closing (movement of the adhesive substance across the tongue existence plane is prohibited) the gaps formed between the plurality of tongue parts with variable width (size in the protrusion direction) from the bottom defining line toward the protrusion direction, the variable weir means included by the passing gas changing means can adjust the height (height from the laying surface) of the ridge appearing on the cross-section shape (cross-section shape on the tongue existence plane) of the adhesive substance applied to the laying surface.

With respect to a variable weir main device, the variable weir means may comprise (hereinafter, referred to as "variable weir main device") a weir member in a belt shape, a main surface of which can slide freely with respect to the tongue forming means in the protrusion direction and an opposite direction thereto and in approximately parallel to the tongue existence plane, such that the weir member closes the plurality of gaps formed between the plurality of tongue parts.

In this way, the belt-like weir member to close the plurality of gaps formed between the plurality of tongue parts over the bottom defining line direction is disposed such that a main surface of the weir member is approximately parallel to the tongue existence surface, and is configured to freely slide relatively with respect to the tongue forming means in the protrusion direction and an opposite direction thereto. In this way, the heights (size toward the protrusion direction) of the plurality of gaps formed between the plurality of tongue parts can be adjusted and the heights (height from the laying surface) of the ridge appearing on the cross-section shape (cross-section shape on the tongue existence plane) of the adhesive substance applied to the laying surface can be adjusted easily.

With respect to a weir member main device, an edge portion on the protrusion direction side of the weir member is formed along the line segment and the weir member may slide such that the angle between a straight line including an orthographic projection of the edge portion of the protrusion side of the weir member on the tongue existence plane and a straight line including the bottom defining line may be variable.

In this way, the weir member slides such that the inclination (an angle between a straight line including an orthographic projection of the edge portion of the protrusion direction side of the weir member on the tongue existence plane and a straight line including the bottom defining line) of the edge portion of the protrusion side of the weir member formed along the line segment is variable to the plurality of the tongue parts and hence the inclination of the upper surface of the ridge appearing on the cross-section shape (cross-section shape on the tongue existence plane) of the adhesive substance applied to the laying surface can be adjusted.

With respect to the present device, the contact means may comprise at least two or more edge portions of the plurality of tongue parts.

In this way, the end portions of the tongue parts can serve as the at least two contact points (at least two contact points contacting at least two points on a virtual plane) of the contact means such that the present device can be so configured that the end portion contacts the virtual surface (laying surface). Here, in this case, the adhesive substance on the virtual surface (laying surface) in the valley parts of the ridge-and-groove shape of the adhesive substance formed by the end portions of the tongue parts serving as the at least two contact points is removed.

With respect to the present device, the grasping means may be freely attached to and detached from the tongue forming means.

The tongue forming means having the plurality of tongue parts forms a ridge-and-groove shape corresponding to the gaps between the plurality of tongue parts on the upper surface of the adhesive substance applied on the laying surface by passing the adhesive substance through the gaps between the plurality of tongue parts such that the tongue forming means may be configured to be exchangeable depending on the desired ridge-and-groove shape. For example, a plurality of kinds of tongue forming means may be attachable to one grasping means (the grasping means is freely attached to and detached from the tongue forming means) such that the one grasping means can be used with various kinds of tongue forming means attached thereto.

With respect to the present device, a front rising wall member formed separately from the grasping means may be comprised of such that an orthographic projection of an outer surface of the grasping means on the tongue existence plane, which has at least a portion appearing on an opposite direction to the protrusion direction from the bottom defining line overlapping the orthographic projection on the tongue existence plane, may rise in the opposite direction to the protrusion direction.

The front rising wall member is formed separately from the grasping means such that the member may rise in the opposite direction to the protrusion direction such that at least portion of part appearing in the opposite direction to the protrusion direction from the bottom defining line in the orthographic projection on the tongue existence plane of the outer surface of the grasping means may overlap an orthographic projection of the front rising wall member on the tongue existence plane. In this way, the front rising wall member is provided. Hence, the present apparatus is moved such that the front rising wall member exists in the front direction of the traveling direction over the laying surface (virtual surface) on which the adhesive substance is disposed as the contact means of the present apparatus is kept in contact with the laying surface (virtual surface) and the upper surface of the adhesive substance applied on the laying surface is formed in the ridge-and-groove shape by passing the adhesive substance through the gaps of the plurality of tongue parts. Then, it is possible to prevent the adhesive substance from adhering to the grasping means since the front rising wall member plows the adhesive substance.

With respect to the present apparatus, a stand which can have the forming apparatus stand by itself may be provided thereto such that a tip end of the stand contacts on the horizontal virtual surface.

In this way, since the present apparatus can stand by itself on the laying surface (virtual surface) (for example, the present apparatus may be configured to stand by itself by making a tip end of the stand contact on the laying surface (virtual surface)), it is possible to let the present apparatus stand by itself when the present apparatus is not used in the middle of operation with the present apparatus. It is possible to prevent or alleviate that the adhesive substance may adhere to the present apparatus unexpectedly if compared with the case of letting the present apparatus lie around on the laying surface (virtual surface).

With respect to the present apparatus, means for checking the horizontal level may be provided thereto in order to check if the bottom defining line is horizontal or not.

It is often required that the upper surface of the ridge (ridge portion) of the ridge-and-groove shape formed on the upper surface of the adhesive substance applied on the laying surface is constructed horizontally among the ridges adjacent to the subject ridge. For this reason, the means for checking the horizontal level may be provided thereto in order usually to check if the bottom defining line which defines the upper surfaces of the adjacent ridges (ridge portions) is horizontal or not. As the means for checking the horizontal level, various kinds of devices can be utilized such that they are not limited thereto, but a bubble tube (level) or the like which is attached in parallel to the bottom defining line can be named.

With respect to the present apparatus, the grasping means may comprise a grasping bar shaped in a bar shape extending approximately in parallel to the bottom defining line.

In the case where the upper surface of the adhesive substance applied on the laying surface is formed in the ridge-and-groove shape by moving the present apparatus over the laying surface (virtual surface) on which the adhesive substance is provided thereto as the contact means of the present apparatus is kept in contact with the laying surface (virtual surface) such that the adhesive substance is passed through the gaps between the plurality of tongue parts, the present apparatus can be surely grasped and moved easily by the user of the present apparatus. From this, the grasping means may comprise a grasping bar of a bar shape extending approximately in parallel to the bottom defining line such that the user of the present apparatus may grasp the grasping bar with the user's hand.

As mentioned above, since the grasping bar is arranged substantially or approximately in the tongue existence plane and positioned approximately on the top end of the present apparatus, when the user of the present apparatus grasps it, the user can push down the present apparatus substantially or approximately from straight above against the laying surface (virtual plane) such that the above-mentioned construction work can be conducted with ease. Since a handle 2 is fixed to a center portion of a flat plate on one side of a trowel body 1 formed in a plate-like rectangular shape as shown in FIG. 1 of Patent Reference 1, it is difficult to let the trowel body 1 stand vertically on the laying surface and it is not easy to achieve a constant shaping of the adhesive substance or push-down of the trowel body 1 against the laying surface.

Further, the present invention may provide a forming method (hereinafter, referred to as "present method") utilizing the present apparatus to form the upper surface of the adhesive substance applied on the laying surface in the ridge-and-groove shape.

The present method is a forming method of forming an upper surface of adhesive substance applied on a laying surface in a ridge-and-groove shape. The present method comprises: a providing step of providing the adhesive substance on the laying surface; and a shape forming step of forming the ridge-and-groove shape corresponding to gaps between a plurality of tongue parts by passing the adhesive substance through the gaps between the plurality of tongue parts as the present forming apparatus is moved over the laying surface on which the adhesive substance is provided in the providing step as contact means is kept in contact with the laying surface.

The present method comprises: a proving step of providing the adhesive substance on the laying surface; and a shape forming step of forming the ridge-and-groove shape on the upper surface of the adhesive substance provided in the providing step. In the providing step, the adhesive substance is provided onto the laying surface (for example, applied thereto). In the shape forming step, the present apparatus is moved over the laying surface as the contact means (contact point) is kept in contact with the laying surface on which the adhesive substance is provided thereto in the providing step such that the adhesive substance is passed through gaps between the plurality of tongue parts such that a ridge-and-groove shape corresponding to the gaps between the plurality of tongue parts is formed. In this way, the upper surface of the adhesive substance applied onto the laying surface is formed in the ridge-and-groove shape. The upper surface of the ridge (ridge portion) formed by base ends of the plurality of tongue parts of the tongue forming means fixed directly or indirectly to the contact means of the present apparatus contacting the laying surface (virtual surface) is determined to be positioned at a position (normally height) relative to the laying surface (virtual surface) corresponding to the distance between the bottom defining line and the contact defining line. Hence, according to the present method, it is possible to prevent or alleviate that the upper surface of the adhesive substance waves and is subject to an unintended inclination.

With respect to the present method, the protrusion status changing main device may be utilized as the present device and the shape forming step may be conducted while the additional contact portion is in a protrusion condition.

In this way, the shape forming step is conducted while the additional contact portion is in the protrusion condition such that end portions of the plurality of tongue parts are apart from the virtual surface (laying surface) as a contact point of the additional contact portion is in contact with the virtual surface (laying surface), and an adhesive substance layer can be formed on the virtual surface (laying surface) in valley portions (formed by tip ends of a plurality of tongue parts) of the ridge-and-groove shape formed on the upper surface of the adhesive substance (the laying surface and the tile can be surely bonded by forming the adhesive substance layer at any area on the virtual surface (laying surface)).

EXPLANATION OF NUMERALS

11 present apparatus 13 bubble tube level 15 grasping portion 15*a* bar-shaped grasping portion 15*ac* groove 15*b* finger catch 15*bc* convex-and-concave 15*c*1, 15*c*2 engaging part 15*d*1, 15*d*2 fixing bracket 21 main body 22*a*, 22*b* surface 23 main body lower portion 23*h* through hole 24 tongue part receiving groove 25 main body upper portion 25*c* notch 29*a*, 29*b* height adjusting part support portion 40 securing portion 41 tongue part 42 gap 43 securing portion base plate 43*a*, 43*b* long side 43*h*1, 43*h*2 tapped hole 43*k*1, 43*k*2 lever support plate 43*s* slit 43*q* lever support bar 44 ridge 45*a*, 45*b* securing portion fixing bolt 47*a*, 47*b* securing portion fixing nut 49 slit 51, 53 gasket 60 lateral slide portion 61 tongue part 63 lateral slide base plate 63*a*, 63*b* long side 64 groove 64*a*, 64*b* ridge 65 lateral slide portion supporting portion 65*a* rising portion 65*b* hinge portion 65*c* tongue portion 65*ch* elongated hole 66 front wall member 66*a* ridge 67*f* rack part 68*a*, 68*b* lateral slide portion securing screw 69 lateral slide portion slide lever 69*a* bar main body 69*c* pinion portion 81 vertical slide edge 82*a* top edge 82*b* bottom edge 83*a*, 83*b*, 83*c* vertical slide edge securing screw 85*a*, 85*c* vertical slide edge slide lever 86*a*, 86*b*, 86*c* vertical slide edge slide rail 87 notch engaging spring 88*a*, 88*b*, 88*c* slide member 89 vertical slide edge slide plate 89*a* main surface 91, 91*a*, 91*b* height adjusting part 92 male threaded portion 93 female threaded portion 94 closing valve 96 stand 96*a* base member 96*b* end member 101 adhesive mortar 103 subject slab (concrete slab) 104 ridge-and-groove shape 105 placing surface 114 protrusion member 112 base bottom part 116 lower part receiving member 117 disk 118 upper part pressing member 119 disk with a slit 122 pressing nut 124 main screw 126 finger grip 150 anchor

What is claimed is:

1. A surface height adjustment apparatus to be used in laying tiles on a laying surface, comprising:

a base bottom part to define a reference height from the laying surface;

a protrusion member being configured to engage with the base bottom part and further protruding from the base bottom part to contact the laying surface, a relative position of the protrusion member to the base bottom part being adjusted;

a lower part receiving member to be kept at a predetermined height from the base bottom part, the lower part receiving member comprising a through-hole;

an upper part pressing member capable of clamping a side end part of a tile between the lower part receiving member and the upper part pressing member, the upper part pressing member comprising a through-hole;

a distance adjustment member capable of being secured by engaging with the protrusion member and changing a distance between the lower part receiving member and the upper part pressing member when having a constant relationship with the lower part receiving member through the base bottom part, the distance adjustment member comprising male threads inscribed on an outer surface thereof and penetrating the through-hole of the lower part receiving member and the through-hole of the upper part pressing member wherein both through-holes are aligned; and an engaging movable body comprising a through-hole and female threads inscribed on an inner surface of the through-hole capable of engaging with the distance adjustment member so as to adjustably shorten the distance between the lower part receiving member and the upper part pressing member by pressing the upper part pressing member toward the lower part receiving member.

2. The surface height adjustment apparatus according to claim 1 wherein the protrusion member has male threads inscribed on an outer surface thereof and the base bottom part has female threads inscribed on an inner surface thereof to engage with the male threads of the protrusion member.

3. The surface height adjustment apparatus according to claim 2 wherein the protrusion member has a hole of a predetermined depth approximately in a center from a top view and a tip end of the distance adjustment member comprising male threads enters the hole of the protrusion member so as to inscribe female threads on an inner surface of the hole such that the tip end is stuck in the hole as the tip end approaches a bottom.

4. The surface height adjustment apparatus according to claim 3, comprising:

a finger grip disposed on an opposite end of the tip end.

5. The surface height adjustment apparatus according to claim 1 wherein the lower part receiving member comprises an adjustment connecting part to be connected with the distance adjustment member approximately in a center from a top view and in a vicinity thereof.

6. The surface height adjustment apparatus according to claim 1 wherein the lower part receiving member comprises an adjustment connecting part to be connected off-center from a top view with the distance adjustment member.

7. The surface height adjustment apparatus according to claim 1, comprising:

an anti-fall hook disposed on an upper surface of the upper part pressing member comprising a tip end part extending toward inside wherein the engaging movable body comprises a pressing nut including an groove around the pressing nut in a lower outer surface thereof such that the anti-fall hook engages rotatably with the groove.

8. A surface height adjustment apparatus to be used in laying tiles on a laying surface comprising:

an anchor member driven into the laying surface wherein the anchor member comprises a hole including female threads in an upper surface of the anchor member;

a bolt to engage with the hole including the female threads;

a disk including a hole including female threads in a center thereof from a top view so as to engage with the bolt in the hole including female threads and make a horizontal face on a top face of the disk wherein the disk comprises a plurality of tapped holes a predetermined distance apart from the center of the disk;

a fastening screw engaging with one of the plurality of tapped holes wherein the fastening screw comprises a head on a top of the fastening screw; and a disk with a slit, a width of which is smaller than the head of the bolt but larger than a threaded portion of the bolt such that a tile can be clamped between a lower face of the disk with the slit and the horizontal face of the disk.

* * * * *